US006413153B1

(12) United States Patent
Molar

(10) Patent No.: US 6,413,153 B1
(45) **Date of Patent: *Jul. 2, 2002**

(54) FINISHING ELEMENT INCLUDING DISCRETE FINISHING MEMBERS

(75) Inventor: Charles J Molar, Wilmington, DE (US)

(73) Assignee: Beaver Creek Concepts Inc, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/556,509

(22) Filed: Apr. 24, 2000

Related U.S. Application Data

(60) Provisional application No. 60/131,016, filed on Apr. 26, 1999, provisional application No. 60/132,329, filed on May 3, 1999, provisional application No. 60/136,954, filed on Jun. 1, 1999, provisional application No. 60/141,302, filed on Jun. 28, 1999, provisional application No. 60/141,304, filed on Jun. 28, 1999, and provisional application No. 60/158,797, filed on Oct. 12, 1999.

(51) Int. Cl.[7] ..... B24B 7/20
(52) U.S. Cl. ..... 451/259; 451/539
(58) Field of Search ..... 451/41, 527, 530, 451/539, 290, 921, 259; 438/692–694; 252/79.4; 51/298; 523/206, 216; 524/425, 430, 492

(56) References Cited

U.S. PATENT DOCUMENTS

| | | | | |
|---|---|---|---|---|
| 3,925,034 A | | 12/1975 | Anna | 51/296 |
| 4,548,617 A | | 10/1985 | Miyatani et al. | 51/293 |
| 4,575,396 A | | 3/1986 | Matsumoto et al. | 134/7 |
| 4,913,708 A | * | 4/1990 | Kalinowski | 51/295 |
| 5,325,639 A | | 7/1994 | Kuboyama | 51/320 |
| 5,476,416 A | | 12/1995 | Kodate | 451/526 |
| 5,578,362 A | | 11/1996 | Reinhardt et al. | 428/147 |
| 5,624,303 A | | 4/1997 | Robinson | 451/285 |
| 5,823,855 A | | 10/1998 | Robinson | 451/41 |
| 5,976,000 A | | 11/1999 | Hudson | 451/534 |
| 5,990,244 A | | 11/1999 | Warakomski et al. | 525/179 |
| 6,100,334 A | | 8/2000 | Abdou-Sabet | 525/191 |
| 6,126,532 A | | 10/2000 | Sevilla et al. | 451/526 |
| 6,156,446 A | * | 12/2000 | Bruckner et al. | 428/701 |
| 6,234,875 B1 | | 5/2001 | Pendergrass, Jr. | 451/41 |
| 6,296,550 B1 | * | 10/2001 | Liu et al. | 451/41 |

* cited by examiner

*Primary Examiner*—Joseph J. Hail, III
*Assistant Examiner*—David B. Thomas

(57) ABSTRACT

Unitary finishing elements having discrete finishing members fixedly attached to unitary resilient body are disclosed for finishing semiconductor wafers. The discrete finishing members can be comprised of a multiphase polymeric composition. The new unitary finishing elements have lower cost to manufacture and high precision. The unitary finishing elements can reduce unwanted surface defect creation on the semiconductor wafers during finishing.

76 Claims, 9 Drawing Sheets

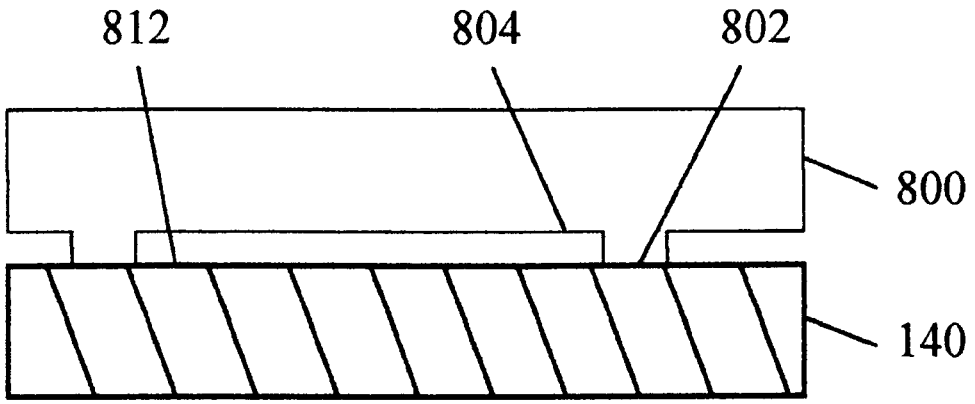
Fig. 9a
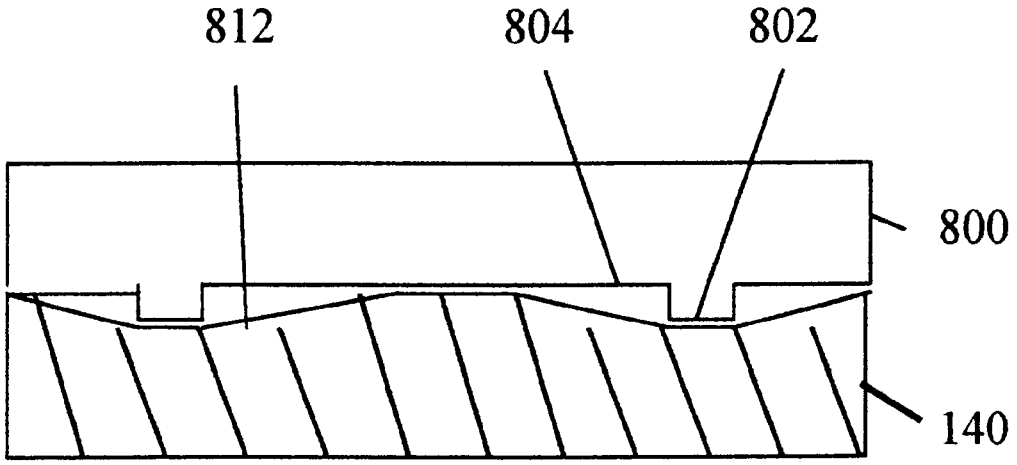
Fig. 9b
Figure 9

FINISHING ELEMENT INCLUDING DISCRETE FINISHING MEMBERS

This application claims the benefit of the Provisional Application with Ser. No. 60/131,016 filed on Apr. 26, 1999 entitled "Finishing element having discrete finishing members"; Provisional Application with Ser. No. 60/132,329 filed on May 3, 1999 entitled "Finishing element having new discrete finishing members"; Provisional Application Ser. No. 60/136,954 filed on Jun. 1, 1999 entitled "Finishing element with discrete finishing members"; Provisional Application with Ser. No. 60/141,302 filed on Jun. 28, 1999 entitled "Finishing element with new discrete finishing members"; Provisional Application with Ser. No. 60/141,304 filed on Jun. 28, 1999 entitled "Finishing element having at least one new discrete finishing member"; and Provisional Application with Ser. No. 60/158,797 filed on Oct. 12, 1999 entitled "Finishing element with new discrete finishing members". The Provisional Patent Applications which this application claims benefit to are included herein by reference in their entirety

BACKGROUND ART

Chemical mechanical polishing (CMP) is generally known in the art. For example U.S. Pat. No. 5,177,908 issued to Tuttle in 1993 describes a finishing element for semiconductor wafers, having a face shaped to provide a constant, or nearly constant, surface contact rate to a workpiece such as a semiconductor wafer in order to effect improved planarity of the workpiece. U.S. Pat. No. 5,234,867 to Schultz et al. issued in 1993 describes an apparatus for planarizing semiconductor wafers which in a preferred form includes a rotatable platen for polishing a surface of the semiconductor wafer and a motor for rotating the platen and a non-circular pad is mounted atop the platen to engage and polish the surface of the semiconductor wafer. Fixed abrasive finishing elements are known for polishing. Illustrative examples include U.S. Pat. No. 4,966,245 to Callinan, U.S. Pat. No. 5,823,855 to Robinson, and WO 98/06541 to Rutherford.

An objective of polishing of semiconductor layers is to make the semiconductor layers as nearly perfect as possible. Current finishing elements can suffer from being costly to manufacture. Also current finishing elements for semiconductor wafers have relatively homogenous surfaces which inherently limits their versatility in some demanding finishing applications. Still further, current finishing elements do not have built into their construction a local region of material on their surface which can help reinforce them, prolong their useful life, and also improve finishing performance while also improving manufacturability and versatility. Still further, lack of a continuous phase matrix on their surface can reduce the flexibility to add finishing enhancers. Still further, a lack of the above characteristics in a finishing element reduces the versatility of the finishing method which can be employed for semiconductor wafer surface finishing. Still further, current finishing pads are limited in the way they apply pressure to the abrasives and in turn against the semiconductor wafer surface being finished. These unwanted effects are particularly important and can be deleterious to yield and cost of manufacture when manufacturing electronic wafers which require extremely close tolerances in required planarity and feature sizes.

It is an advantage of this invention to improve the finishing method for semiconductor wafer surfaces to make them as perfect as possible. It is an advantage of this invention to make finishing elements with a lower cost of manufacture and thus also reduce the cost of finishing a semiconductor wafer surface. It is an advantage of this invention develop a heterogeneous finishing element surface having local regions which improve versatility of the finishing elements and the methods of finishing semiconductor wafers which result. It is also an advantage of the invention to develop finishing element having local regions reinforced with a continuous phase material. It is further an advantage of the invention to develop a finishing element having local regions for including finishing enhancers such as finishing aids. It is further an advantage of the invention to develop an finishing element with a new method of cooperating between its elements to improve die planarity, global planarity, and finishing performance. It is an advantage of the invention to develop a finishing element which has a unique way of applying pressure to the unitary discrete finishing member and to the workpiece surface being finished. It is further an advantage of this invention to help improve yield and lower the cost of manufacture for finishing of workpieces having extremely close tolerances such as semiconductor wafers.

These and other advantages of the invention will become readily apparent to those of ordinary skill in the art after reading the following disclosure of the invention.

BRIEF DESCRIPTION OF DRAWING FIGURES

Figure 4A:
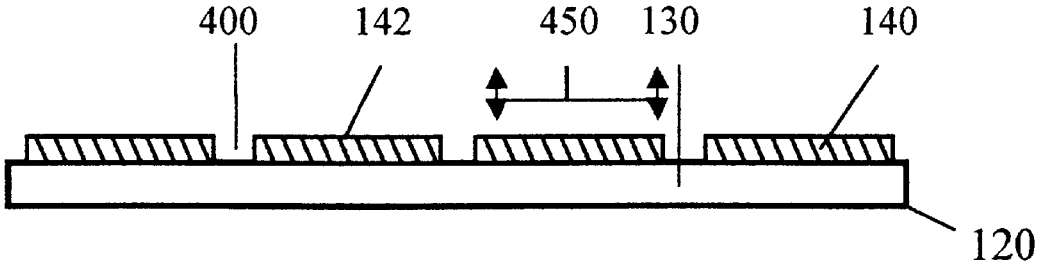
Figure 4B:
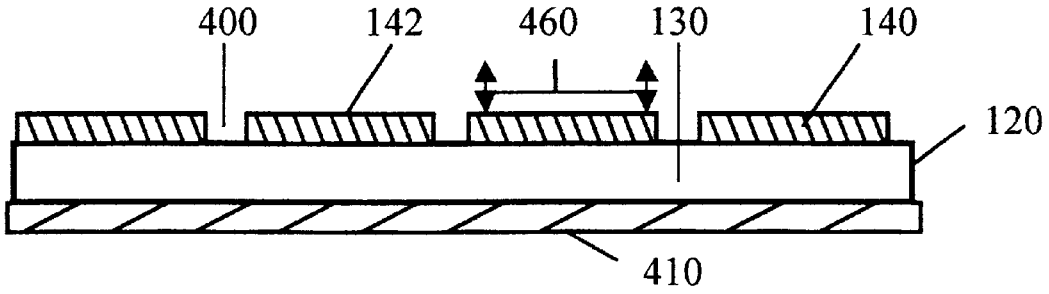
Figure 4C:
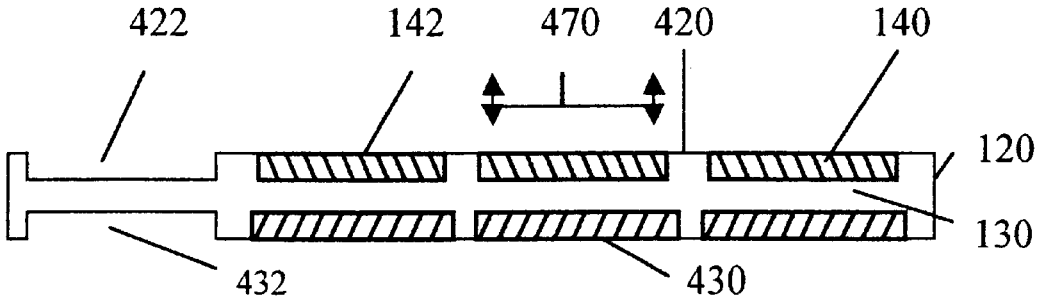

FIGS. 4*a*, 4*b*, and 4*c* are cross-sectional views of an finishing element.

Figure 5A:
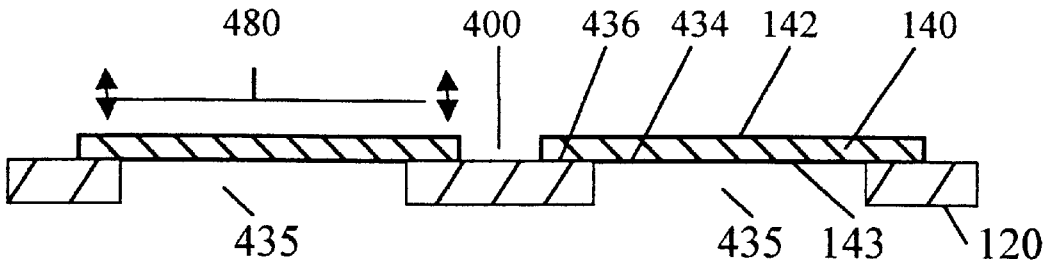
Figure 5B:
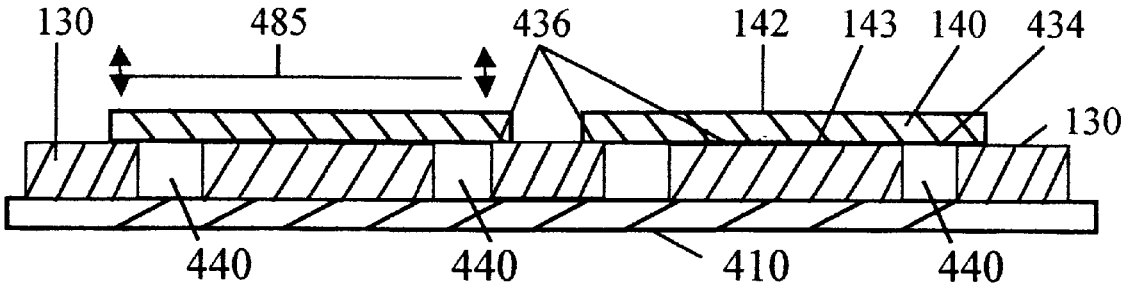

FIGS. 5*a* and 5*b* are cross-sectional views of alternate preferred embodiments of a finishing element.

Figure 6A:
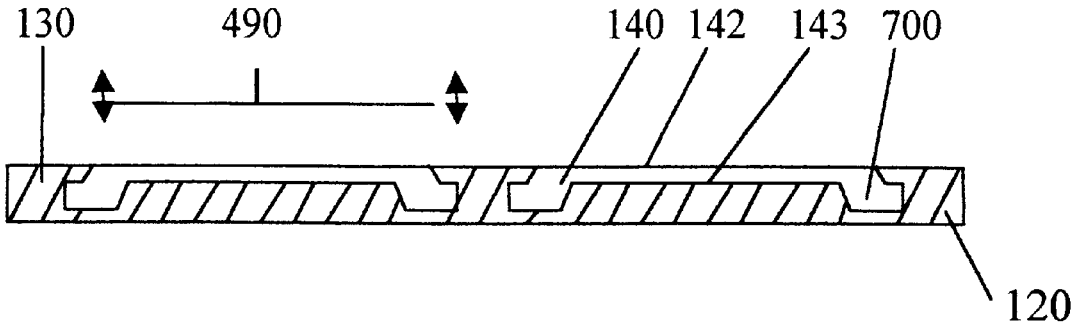
Figure 6B:
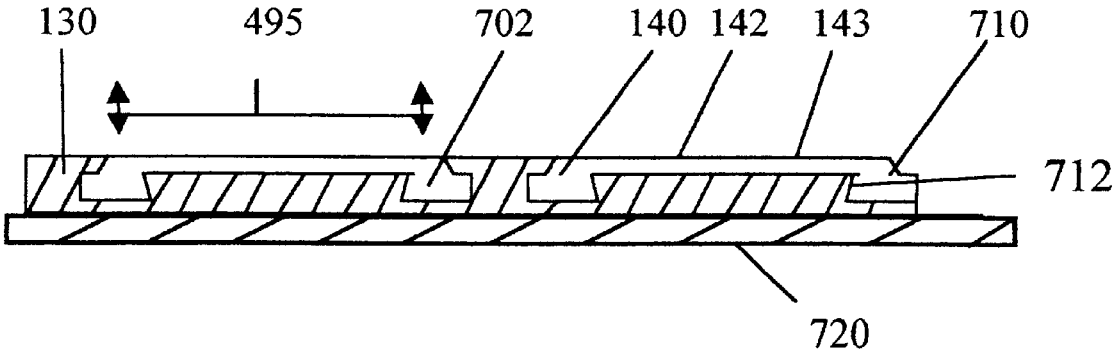

FIGS. 6*a* and 6*b* are cross-sectional views of further alternate preferred embodiments of a fixed abrasive element.

Figure 7A:
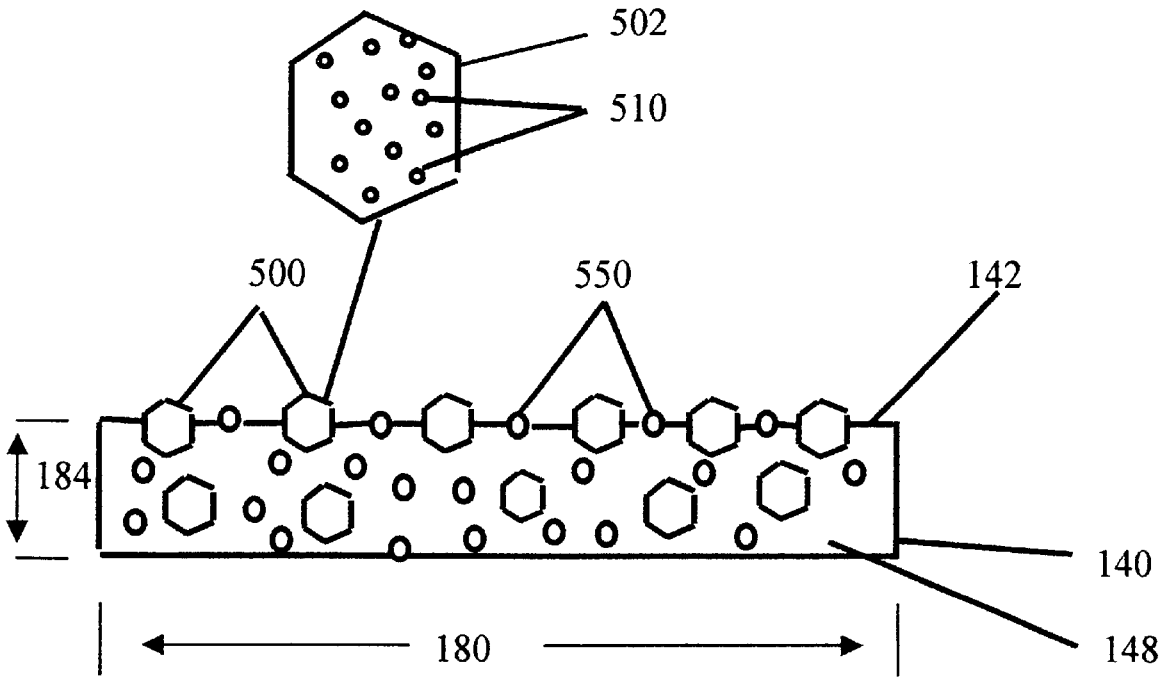
Figure 7B:
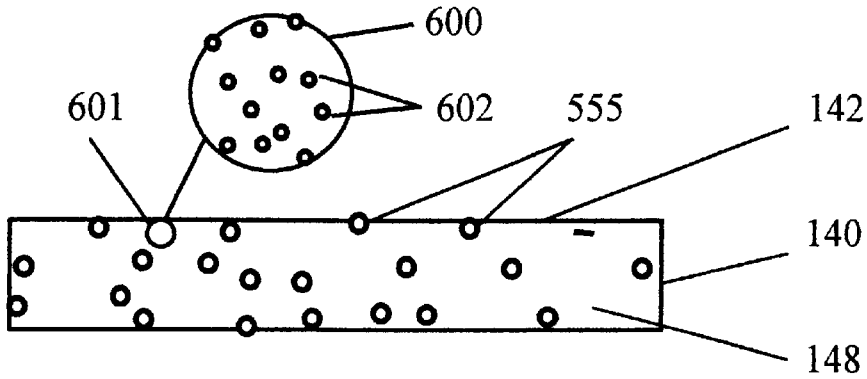

FIGS. 7*a* and 7*b* are cross-sectional views of a discrete finishing member.

Figure 8:
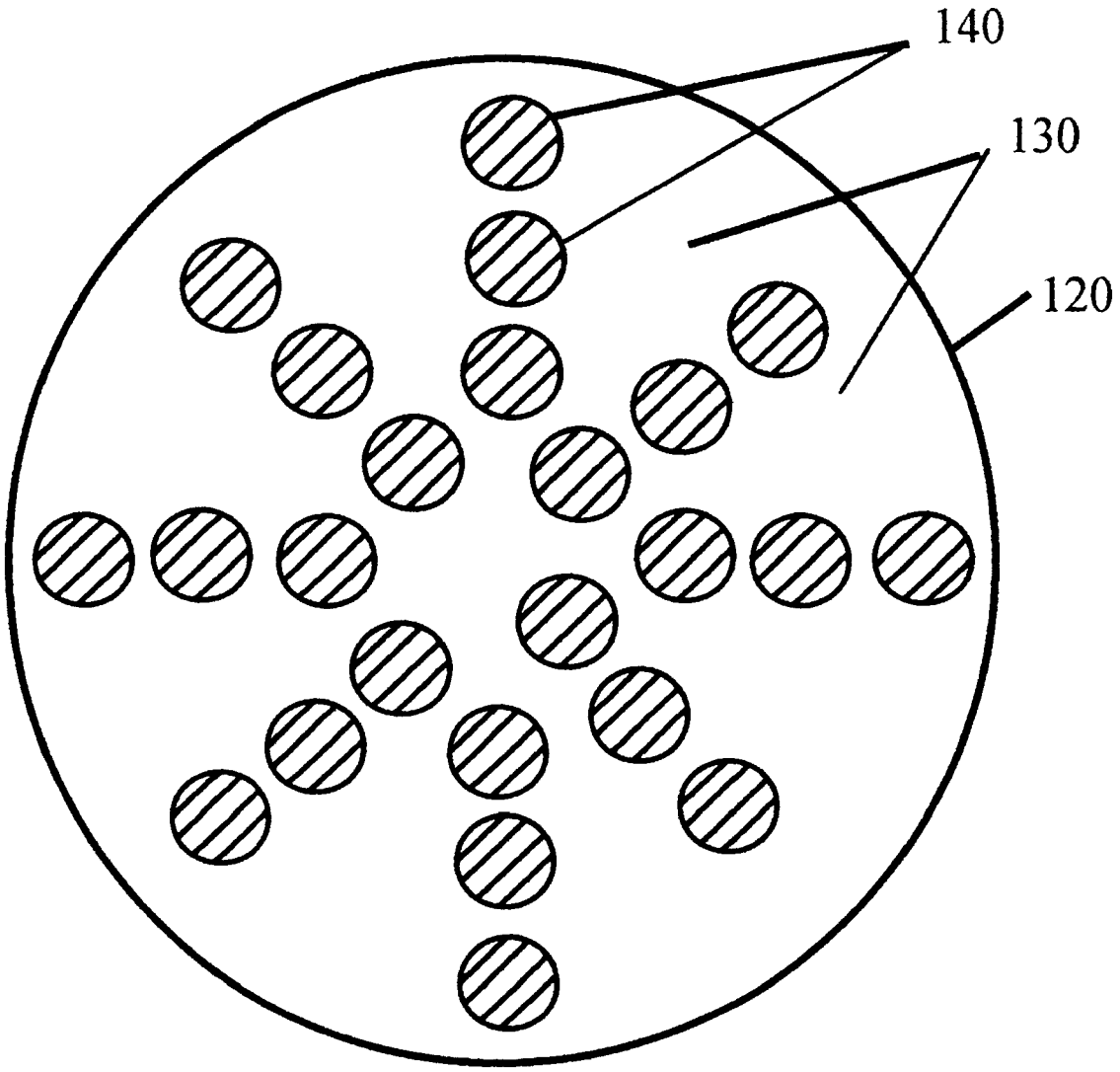

FIG. 8 is an artist's view a preferred arrangement of the discrete finishing members in the finishing element.

FIG. 9 is an artist's representation of local high finishing rate regions and some local low finishing rate regions.

REFERENCE NUMERALS IN DRAWINGS

Reference Numeral 10 direction of rotation of the finishing element finishing surface Reference Numeral 12 direction of rotation of the workpiece being finished Reference Numeral 14 center of the rotation of the workpiece Reference Numeral 20 finishing composition feed line for adding finishing chemicals Reference Numeral 22 reservoir of finishing composition Reference Numeral 24 alternate finishing composition feed line for adding alternate finishing chemicals Reference Numeral 26 a reservoir of alternate finishing composition Reference Numeral 110 workpiece Reference Numeral 112 workpiece surface facing away from the workpiece surface being finished.

Reference Numeral 114 surface of the workpiece being finished
Reference Numeral 120 finishing element
Reference Numeral 130 unitary resilient body of an organic polymer
Reference Numeral 132 surface of unitary resilient body facing away from the workpiece being finished
Reference Numeral 140 discrete finishing member
Reference Numeral 142 discrete finishing member finishing surface
Reference Numeral 143 backside surface of discrete finishing member
Reference Numeral 144 abrasive particles
Reference Numeral 146 optional discrete synthetic resin particles
Reference Numeral 148 continuous phase synthetic resin matrix in discrete finishing member
Reference Numeral 150 finishing element subsurface layer
Reference Numeral 152 optional finishing aids in discrete finishing member
Reference Numeral 200 finishing composition
Reference Numeral 210 operative finishing motion
Reference Numeral 250 rotating carrier for the workpiece
Reference Numeral 252 operative contact element
Reference Numeral 300 platen
Reference Numeral 302 surface of the platen facing the finishing element
Reference Numeral 304 surface of the platen facing away from the finishing element
Reference Numeral 310 base support structure
Reference Numeral 312 surface of the base support structure facing the platen
Reference Numeral 400 open spaces between discrete finishing members
Reference Numeral 410 optional third layer member
Reference Numeral 420 unitary resilient body proximal to the finishing member finishing surface
Reference Numeral 422 recess for discrete finishing member
Reference Numeral 430 discrete third layer members
Reference Numeral 432 recess for discrete third layer member
Reference Numeral 434 optional portion of discrete finishing member spaced apart from unitary resilient body
Reference Numeral 435 optional cavity between discrete finishing member spaced apart from unitary resilient body
Reference Numeral 436 optional portion of discrete finishing member fixedly attached to the unitary resilient body
Reference Numeral 440 optional cavity between discrete finishing member spaced apart from unitary resilient body
Reference Numeral 450 a potential motion of discrete finishing member in FIG. 4*a*
Reference Numeral 460 a potential motion of discrete finishing member in FIG. 4*b*
Reference Numeral 470 a potential motion of discrete finishing member in FIG. 4*c*
Reference Numeral 480 a potential motion of discrete finishing member in FIG. 5*a*
Reference Numeral 485 a potential motion of discrete finishing member in FIG. 5*b*
Reference Numeral 490 a potential motion of discrete finishing member in FIG. 6*a*
Reference Numeral 495 a potential motion of discrete finishing member in FIG. 6*b*
Reference Numeral 500 discrete regions of material having dispersed therein abrasives
Reference Numeral 502 expanded view of discrete regions of material having dispersed therein abrasives
Reference Numeral 510 abrasive particles
Reference Numeral 550 optional discrete finishing aids
Reference Numeral 555 optional soft organic synthetic resin and/or modifier materials
Reference Numeral 600 small region in a discrete finishing member body
Reference Numeral 602 abrasive particles
Reference Numeral 700 optional footer having chamfers and protrusion extending into unitary resilient body
Reference Numeral 702 another optional footer shape having chamfers and protrusion extending into unitary resilient body
Reference Numeral 710 optional chamfer proximate discrete finishing member finishing surface
Reference Numeral 712 optional chamfer on the footer providing an interlocking mechanism with unitary resilient body
Reference Numeral 720 optional third layer
Reference Numeral 800 semiconductor wafer surface being finished
Reference Numeral 802 high region on semiconductor wafer surface
Reference Numeral 804 lower region proximate the high region on the semiconductor wafer surface
Reference Numeral 810 discrete finishing member finishing surface in local contact with the high local regions (Reference Numeral 802)
Reference Numeral 812 discrete finishing member surface displaced from but proximate to the high local regions

SUMMARY OF INVENTION

A preferred embodiment of this invention is directed to a unitary finishing element having a plurality of discrete finishing members for finishing a semiconductor wafer comprising discrete finishing members wherein each discrete finishing member has a surface area of less than the surface area of the semiconductor wafer being finished, each discrete finishing member has a discrete finishing member finishing surface and a finishing member body, each discrete finishing member has an finishing surface, each finishing member body is comprised of a continuous region of stiff organic synthetic resin, and a ratio of the shortest distance across in centimeters of the discrete finishing member body to the thickness in centimeters of the discrete finishing member body is at least 10/1; a unitary resilient body comprised of an organic polymer and the unitary resilient body having a plurality of discrete finishing member fixedly attached to the unitary resilient body in a manner that each discrete finishing member is separate from its nearest discrete finishing member; and the unitary resilient body of organic polymer having a lower flexural modulus than the stiff organic synthetic resin in the finishing member body.

A preferred embodiment of this invention is directed to a process for chemical mechanical finishing with a multiphase polymeric composition, the multiphase polymeric composition comprising a multiphase synthetic polymer composition having a continuous phase of thermoplastic synthetic polymer "A" and a synthetic polymer "B" and wherein the multiphase composition has at least two distinct glass transition temperatures, and a compatibilizing polymer "C"; and the process for chemical mechanical finishing comprising a step 1) of applying the multiphase polymeric composition to a semiconductor wafer surface; and a step 2) of operatively finishing a semiconductor wafer with the multiphase polymeric composition.

A preferred embodiment of this invention is directed to a process for chemical mechanical finishing with an multiphase polymeric composition, the multiphase polymeric composition comprising a multiphase synthetic polymer composition having at least one filtered polymer which removes particles having a maximum dimension of at least 20 microns capable of scratching a semiconductor wafer surface, the filtering done before adding the filtered polymer to the multiphase polymeric composition; and the process for chemical mechanical finishing comprising a step 1) of applying the multiphase polymeric composition to a semiconductor wafer surface; and a step 2) of operatively finishing a semiconductor wafer with the multiphase polymeric composition.

Other preferred embodiments of my invention are described herein.

DETAILED DESCRIPTION OF PREFERRED EMBODIMENTS OF THE INVENTION

The book *Chemical Mechanical Planarization of Microelectric Materials* by Steigerwald, J. M. et al published by John Wiley & Sons, ISBN 0471138274 generally describes chemical mechanical finishing and is included herein by reference in its entirety for general background. In chemical mechanical finishing the workpiece is generally separated from the finishing element by a polishing slurry. The workpiece surface being finished is in parallel motion with finishing element finishing surface disposed towards the workpiece surface being finished. The abrasive particles such as found in a polishing slurry interposed between these surfaces is used to finish the workpiece in the background arts.

Discussion of some of the terms useful to aid in understanding this invention are now presented. Finishing is a term used herein for both planarizing and polishing. Planarizing is the process of making a surface which has raised surface perturbations or cupped lower areas into a planar surface and thus involves reducing or eliminating the raised surface perturbations and cupped lower areas. Planarizing changes the topography of the work piece from non planar to ideally perfectly planar. Polishing is the process of smoothing or polishing the surface of an object and tends to follow the topography of the workpiece surface being polished. A finishing element is a term used herein to describe a pad or element for both polishing and planarizing. A finishing element finishing surface is a term used herein for a finishing element surface used for both polishing and planarizing. A finishing element planarizing surface is a term used herein for a finishing element surface used for planarizing. A finishing element polishing surface is a term used herein for a finishing element surface used for polishing. Workpiece surface being finished is a term used herein for a workpiece surface undergoing either or both polishing and planarizing. A workpiece surface being planarized is a workpiece surface undergoing planarizing. A workpiece surface being polished is a workpiece surface undergoing polishing. The finishing cycle time is the elapsed time in minutes that the workpiece is being finished. The planarizing cycle time is the elapsed time in minutes that the workpiece is being planarized. The polishing cycle time is the elapsed time in minutes that the workpiece is being polishing.

As used herein, die is one unit on a semiconductor wafer generally separated by scribe lines. After the semiconductor wafer fabrication steps are completed, the die are separated into units generally by sawing. The separated units are generally referred to as "chips". Each semiconductor wafer generally has many die which are generally rectangular. The terminology semiconductor wafer and die are generally known to those skilled in the arts. As used herein, within die uniformity refers to the uniformity of within the die. As used herein, local planarity refers to die planarity unless specifically defined otherwise. Within wafer uniformity refers to the uniformity of finishing of the wafer. As used herein, wafer planarity refers to planarity across a wafer. Multiple die planarity is the planarity across a defined number of die. As used herein, global wafer planarity refers to planarity across the entire semiconductor wafer planarity. Planarity is critical for the photolithography step generally common to semiconductor wafer processing, particularly where feature sizes are less than 0.25 microns. As used herein, a device is a discrete circuit such as a transistor, resistor, or capacitor. As used herein, pattern density is ratio of the raised (up) area to the to area of region on a specific region such as a die or semiconductor wafer. As used herein, pattern density is ratio of the raised (up) area to the total area of region on a specific region such as a die or semiconductor wafer. As used herein, line pattern density is the ratio of the line width to the pitch. As used herein, pitch is line width plus the oxide space. As an illustrative example, pitch is the copper line width plus the oxide spacing. Oxide pattern density, as used herein, is the volume fraction of the oxide within an infinitesimally thin surface of the die.

As used herein, the term "polymer" refers to a polymeric compound prepared by polymerizing monomers whether the same or of a different type. The "polymer" includes the term homopolymer, usually used to refer to polymers prepared from the same type of monomer, and the term interpolymer as defined below. Polymers having a number average molecular weight of greater than 5,000 are preferred and polymers having a number average molecular weight of at least 20,000 are more preferred and polymers having a number average molecular weight of at least 50,000 are even more preferred. Polymers generally having a preferred number average molecular weight of at most 1,000,000 are preferred. Those skill in the polymer arts generally are familiar with number average molecular weights. U.S. Pat. No. 5,795,941 issue to DOW Chemical is included by reference in its entirety for general guidance and appropriate modification by those skilled on number average molecular weight determination.

As used herein, the term "interpolymer" refers to polymers prepared by polymerization of at least two different types of monomers.

As used herein, a multiphase polymeric mixture is a mixture of two or more polymers which form two different and distinct polymeric regions in the mixture. Where the two distinct polymers have different glass transition temperatures, the multiphase polymeric mixture will have more than one glass transition temperature. A continuous phase region of polymer "A" in the mixture is a region which remains continuous in polymer "A" from one point to another point (generally from one end of the part to the other end of the part). A discrete phase region of polymer "B" is a region which is distinct and separated from nearest neighbor of polymer "B". As a further example, a multiphase polymeric mixture can have a continuous phase of polymer "A" having a glass transition temperature of 150 degrees centigrade having a plurality of distinct, separated droplets of polymer "B" having a glass transition temperature of 60 degrees centigrade. This multiphase mixture would generally have two distinct and separate glass transition temperatures.

As used herein, vulcanizing is the process of crosslinking a polymer or interpolymer or elastomer.

As used herein, dynamic crosslinking is the process of crosslinking an elastomer (or polymer) during intimate melt mixing with a noncrosslinking thermoplastic polymer. As used herein, a crosslinked polymer is an polymer wherein at least 10% by weight of the polymer will not dissolve in a solvent which will dissolve the uncrosslinked at identical conditions and at atmospheric pressure.

Dynamic vulcanizing is the process of vulcanizing an elastomer or polymer during intimate melt mixing with a thermoplastic polymer (preferably, a noncrosslinking thermoplastic polymer during thermal mixing). As used herein, a fully vulcanized elastomer (or polymer) is an elastomer wherein less than 10% by weight of the total elastomer weight will dissolve in a solvent which will dissolve the unvulcanized elastomer (or polymer) at identical conditions and at atmospheric pressure.

A compatibilizing agent is a polymer which increases the compatibility of two immiscible polymers. A compatibilizing polymer is a preferred compatibilizing agent. The compatibilizing polymer "C" lowers the interfacial tension between the immiscible polymeric phases (of polymers "A" and "B") and generally increases the adhesion between the phases (of polymers "A" and "B"). As used herein, a polymeric compatibilizer is a polymer which increases the compatibility of two immiscible polymers. This multiphase mixture would generally have two distinct and separate glass transition temperatures.

As used herein, planarization length is defined as the width of a transition ramp at particular finishing conditions between a planarized "up" region and "low" region (in a die on a semiconductor wafer). An example is a high density region resulting in an "up" region and a low density region resulting in a "low" region on a die after planarization. The planarization length is similar to the interaction distance when polishing. Further details are given in "A closed-form analytic model for ILD thickness variation in CMP processes" by B. Stine, D. Ouma, R. Divecha, D. Boning, and J. Chung, Proc. CMP-MIC, Santa Clara, Calif., February 1997 and "Wafer-Scale Modeling of pattern effect in oxide chemical mechanical polishing" by D. Ouma, B. Stine, R. Divecha, D. Boning, J. Chung, G. Shinn, I. Ali, and J. Clark in SPIE Microelectronics Manufacturing Conference, Microelectronic Device Session, Austin, Tex., October 1997 and both references are included in its entirety by reference for guidance.

As used herein, an emulsion is a fluid containing a microscopically heterogeneous mixture of two (2) normally immiscible liquid phases, in which one liquid forms minute droplets suspended in the other liquid. As used herein, a surfactant is a surface active substance, i.e., alters (usually reduces) the surface tension of water. Non limiting examples of surfactants include ionic, nonionic, and cationic. As used herein, a lubricant is an agent that reduces friction between moving surfaces. A hydrocarbon oil is a non limiting example of substance not soluble in water. As used herein, soluble means capable of mixing with a liquid (dissolving) to form a homogeneous mixture (solution).

As used herein, a dispersion is a fluid containing a microscopically heterogeneous mixture of solid phase material dispersed in a liquid and in which the solid phase material is in minute particles suspended in the liquid.

Figure 1:
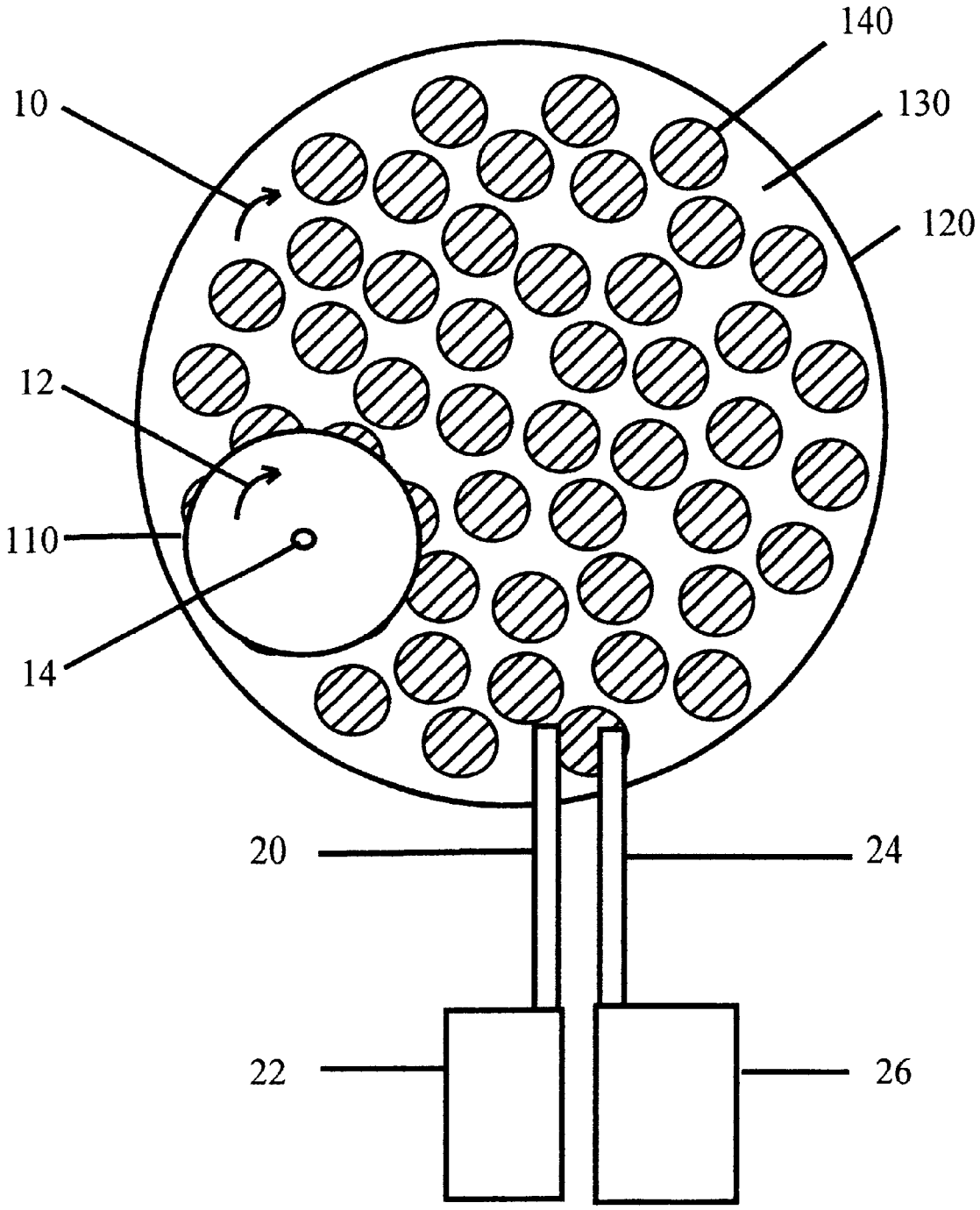
FIG. 1 is an artist's drawing of the interrelationships of the different materials when finishing according to this invention.
Figure 2:
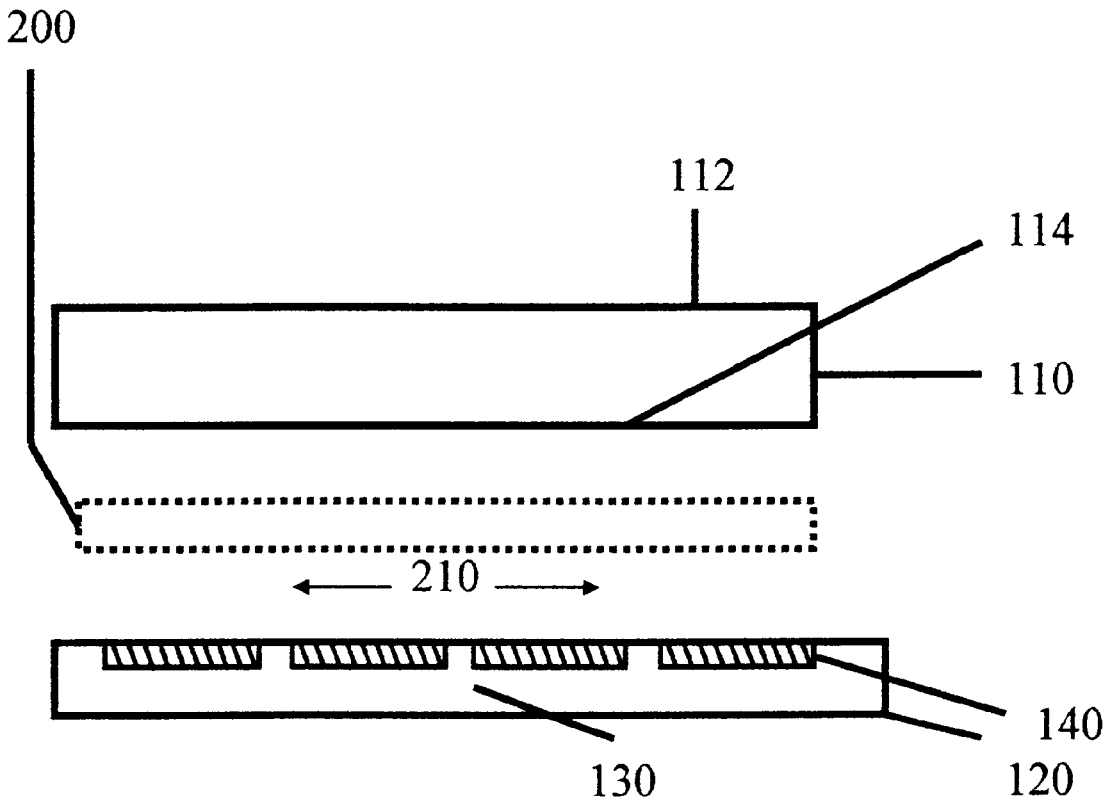
FIG. 2 is an artist's drawing of a particularly preferred embodiment of this invention including the interrelationships of the different objects when finishing according to this invention.
Figure 3:
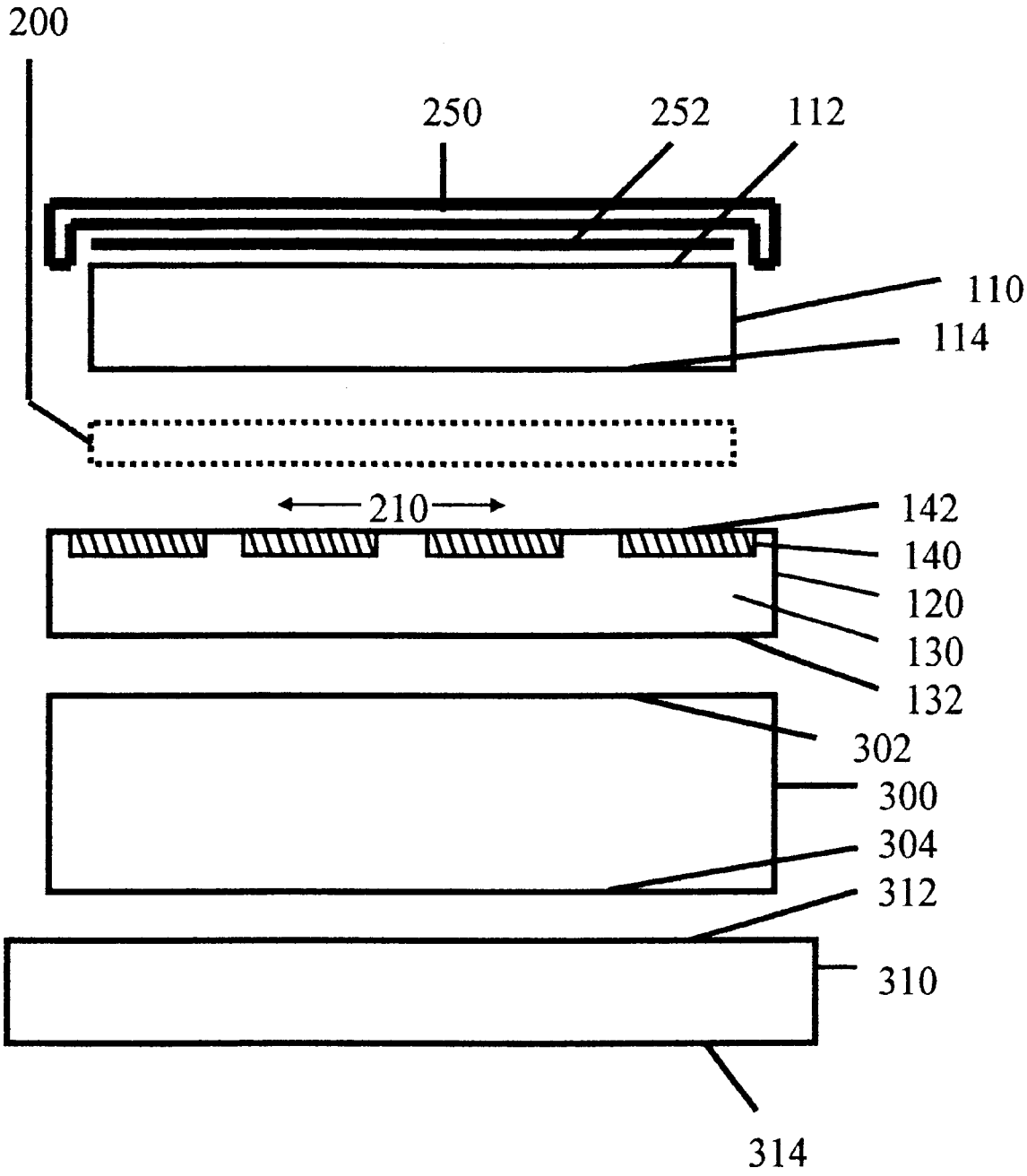
FIG. 3 is an closeup drawing of a preferred embodiment of this invention.

FIG. 1 is an artist's drawing of a particularly preferred embodiment of this invention when looking from a top down perspective including the interrelationships of some important objects when finishing according to the method of this invention. Reference Numeral 120 represents the finishing element. Reference Numeral 130 represents the unitary resilient body of the finishing element. Reference Numeral 140 represents a discrete finishing member. A discrete finishing member may be referred to herein as a discrete finishing element. The discrete finishing members are preferably fixedly attached to the unitary resilient body of the finishing element. The discrete finishing members can have an abrasive surface such as created by metal oxide particles. In another embodiment the discrete finishing members are free of abrasive particles. Reference Numeral 10 represents the direction of rotation of the finishing element finishing surface. Reference Numeral 110 represents the workpiece being finished. The workpiece surface facing the finishing element finishing surface is the workpiece surface being finished. Reference Numeral 12 represents the direction of rotation of the workpiece being finished. Reference Numeral 14 is the center of the rotation of the workpiece. Reference Numeral 20 represents a finishing composition feed line for adding other chemicals to the surface of the workpiece such as acids, bases, buffers, other chemical reagents, and the like. The finishing composition feed line can have a plurality of exit orifices. Reference Numeral 22 represents a reservoir of finishing composition to be fed to finishing element finishing surface. Not shown is the feed mechanism for the finishing composition such as a variable pressure or a pump mechanism. Reference Numeral 24 represents an alternate finishing composition feed line for adding the finishing chemicals composition to the finishing element finishing surface to improve the quality of finishing. Reference Numeral 26 represents an alternate finishing composition reservoir of chemicals to be, optionally, fed to finishing element finishing surface. Not shown is the feed mechanism for the alternate finishing composition such as a variable pressure or a pump mechanism. A preferred embodiment of this invention is to feed liquids from the finishing composition line and the alternate finishing composition feed line which are free of abrasive particles. Another preferred embodiment, not shown, is to have a wiping element, preferably an elastomeric wiping element, to uniformly distribute the finishing composition(s) across the finishing element finishing surface. Nonlimiting examples of some preferred dispensing systems and wiping elements is found in U.S. Pat. No. 5,709,593 to Guthrie et. al., U.S. Pat. No. 5,246,525 to Junichi, and U.S. Pat. No. 5,478,435 to Murphy et. al. and are included herein by reference in their entirety for general guidance and appropriate modifications by those generally skilled in the art for supplying lubricating aids. FIGS. 2 and 3 will now provide an artists' expanded view of some relationships between the workpiece and the finishing element.

FIG. 2 is an artist's closeup drawing of the interrelationships of some of the important aspects when finishing according to a preferred embodiment of this invention. Reference Numeral 110 represents the workpiece. Reference Numeral 112 represents the workpiece surface facing away from the workpiece surface being finished. Reference Numeral 114 represents the surface of the workpiece being finished. A plurality of unwanted high regions can often be present on the workpiece surface being finished. During finishing, the high region(s) is preferably substantially removed and more preferably, the high region is removed and surface polished. Reference Numeral 120 represents the finishing element. Reference Numeral 130 represents a unitary resilient body of organic polymer in the finishing element. A unitary resilient body free of abrasive inorganic material is preferred. Reference Numeral 200 represents a finishing composition and optionally, the alternate finishing composition disposed between the workpiece surface being finished and finishing element finishing surface. The interface between the workpiece surface being finished and the finishing element finishing surface is often referred to herein as the operative finishing interface. A finishing composition comprising a water based composition is preferred. A finishing composition comprising a water based composition which is substantially free of abrasive particles is preferred. The workpiece surface being finished is in operative finishing motion relative to the finishing element finishing surface. The workpiece surface being finished in operative finishing motion relative to the finishing element finishing surface is an example of a preferred operative finishing motion. Reference Numeral 210 represents a preferred operative finishing motion between the surface of the workpiece being finished and finishing element finishing surface.

FIG. 3 is an artist's closeup drawing of a preferred embodiment of this invention showing some further interrelationships of the different objects when finishing according to the method of this invention. Reference Numeral 250 represents a carrier for the workpiece and in this particular embodiment, the carrier is a rotating carrier. The rotating carrier is operable to rotate the workpiece against the finishing element which rests against the platen and optionally has a motor. Optionally, the rotating carrier can also be designed to move the workpiece laterally, in an arch, figure eight, or orbitally to enhance uniformity of polishing. The workpiece is in operative contact with the rotating carrier and optionally, has an operative contact element (Reference Numeral 252) to effect the operative contact. An illustrative example of an operative contact element is a workpiece held to the rotating carrier with a bonding agent (Reference Numeral 252). A hot wax is an illustrative example of a preferred bonding agent. Alternately, a porometric film can be placed in the rotating carrier having a recess for holding the workpiece. A wetted porometric film (Reference Numeral 252) will hold the workpiece in place by surface tension. An adherent thin film is another preferred example of placing the workpiece in operative contact with the rotating carrier. Reference Numeral 110 represents the workpiece. Reference Numeral 112 represents the workpiece surface facing away from the workpiece surface being finished. Reference Numeral 114 represents the surface of the workpiece being finished. Reference Numeral 120 represents the finishing element. Reference Numeral 130 represents the unitary resilient body of finishing element. Reference 132 represents the surface of the unitary resilient body facing away from the workpiece being finished. Reference Numeral 140 represents a discrete finishing member. Reference Numeral 142 represents the discrete finishing member finishing surface. Some preferred motions of the discrete finishing member finishing surface during finishing is further described in FIG. 4 to follow. Optional abrasive materials are preferably dispersed on the surface of the discrete finishing member finishing surface. Reference Numeral 200 represents the finishing composition and optionally, the alternate finishing composition supplied between the workpiece surface being finished and surface of the finishing element facing the workpiece. For some applications the finishing composition and the alternate finishing composition can be combined into one feed stream, preferably free of abrasive particles. Reference Numeral 210 represents a preferred direction of the operative finishing motion between the surface of the workpiece being finished and the finishing element finishing surface. Reference Numeral 300 represents the platen or support for the finishing element. The platen can also have an operative finishing motion relative to the workpiece surface being finished. Reference Numeral 302 represents the surface of the platen facing the finishing element. The surface of the platen facing the finishing element is in support contact with the finishing element surface facing away from the workpiece surface being finished. The finishing element surface facing the platen can, optionally, be connected to the platen by adhesion. Frictional forces between the finishing element and the platen can also retain the finishing element against the platen. Reference Numeral 304 is the surface of the platen facing away from the finishing element. Reference Numeral 310 represents the base support structure. Reference Numeral 312 represents the surface of the base support structure facing the platen. The rotatable carrier (Reference Number 250) can be operatively connected to the base structure to permit improved control of pressure application at the workpiece surface being finished (Reference Numeral 114). Optionally rotatable carrier can have a retainer ring (not shown) to aid in positioning the workpiece and the finishing element during finishing.

FIGS. 4*a*, 4*b*, and 4*c* are an artist's representation of the cross section of some preferred embodiments of the finishing elements of this invention. In FIGS. 4*a*, 4*b*, and 4*c* Reference Numeral 120 represents the finishing element. In FIGS. 4*a*, 4*b*, and 4*c* Reference Numeral 130 represents the unitary resilient body in the finishing element. In FIGS. 4*a*, 4*b*, and 4*c* Reference Numeral 140 represents one of the discrete finishing members and Reference Numeral 142 represents the discrete finishing member finishing surface. Reference Numeral 402 represents a high flexural modulus finishing region. The high flexural modulus finishing region corresponds to the region of the discrete finishing member (which is a higher flexural modulus). Reference Numeral 404 represents a low flexural modulus region between the high flexural modulus finishing regions. A preferred aspect shown in FIG. 4*a* is the discrete finishing members connected to the surface of a unitary resilient body comprising a sheet of resilient organic polymer. In FIG. 4*a*, there are shown open spaces (Reference Numeral 400) between the discrete finishing members. A finishing element of this form can be manufactured by for instance laminating a continuous sheet of the finishing member material and then laser cutting or mechanically milling out the spaces there between using technology known to those skilled in the arts. Reference Numeral 450 represents a preferred motion which the unitary resilient body can impart to the discrete finishing member to improve local planarity while retaining some global flexibility at Reference Numeral 400. This cooperative motion between the unitary resilient body and the discrete finishing member is unique to the finishing element of this invention.

In FIG. 4*b*, there is a shown discrete finishing members fixedly attached to the surface of a unitary resilient body comprising a sheet of resilient organic polymer and further comprising a third layer (Reference Numeral 410) connected to the surface of the unitary resilient body facing away from the finishing element members. A reinforcing film is an optionally preferred third layer. A reinforcing layer having fibers is another optionally preferred third layer. The third layer preferably can be used to reinforce the finishing element. The third layer preferably can be used to stabilize the finishing element and/or the movement of the discrete finishing members. Preferably the third layer is fixedly attached to the unitary resilient body. Reference Numeral 402 represents a high flexural modulus finishing region. The high flexural modulus finishing region corresponds to the region of the discrete finishing member (which is a higher flexural modulus). Reference Numeral 404 represents a low flexural modulus region between the high flexural modulus finishing regions. Reference Numeral 460 represents a preferred motion which the unitary resilient body can impart to the discrete finishing member to improve local planarity while retaining some moderated global flexibility at Reference Numeral 420. The third layer discrete member and the unitary resilient body influence the motion 460. Again the cooperative motion between the unitary resilient body, the discrete finishing member, and the third layer is unique to the finishing element of this invention. In this embodiment the unitary resilient body applies a substantially uniform pressure across the backside surface of the discrete finishing members and more preferably the unitary resilient body applies a uniform pressure across the backside surface of the discrete finishing members.

In FIG. 4*c*, there is shown discrete finishing members connected to the unitary resilient body and which are disposed in recesses (Reference Numeral 422) of the unitary resilient body. It is recognized that the unitary resilient body can be proximal to the finishing member finishing surface (see Reference Numeral 420) and thus can aid in finishing. Alternately the unitary resilient body spaced apart form the discrete finishing member finishing surface and thus not rub against the workpiece during operative finishing motion. The recesses can further aid in connecting the finishing member to the unitary resilient finishing body. The recesses can form a preferred friction mechanism to facilitate fixedly attaching the discrete finishing member to the unitary resilient body. Also in FIG. 4*c*, there is shown a plurality of discrete regions of separated third layer discrete members (Reference Numeral 430) preferably disposed in recesses (Reference Numeral 432) of the unitary resilient body. In one preferred embodiment the third layer discrete members have a surface larger than the discrete finishing members to further direct the motion shown in Reference Numeral 470. The separate third layer discrete members can reinforce the unitary resilient body and/or change the motion the discrete finishing member. Having a plurality of separate third layer members can improve the flexibility of the finishing element to follow some of the global non uniformities in the wafer while the discrete finishing members improve local planarity (preferably within die uniformity). The recesses can further aid in connecting the finishing member to the unitary resilient finishing body. Reference Numeral 470 represents a preferred motion which the unitary resilient body can impart to the discrete finishing member to improve local planarity while retaining some global flexibility at Reference Numeral 420. The third layer continuous member and the unitary resilient body cooperate to influence the motion 470. Again the cooperative motion between the unitary resilient body, the discrete finishing member, and the third layer discrete member is unique to the finishing element of this invention.

Reference Numerals 450, 460, and 470 represent preferred up and down motions of the discrete finishing member finishing surfaces during finishing. Movement of the discrete finishing member finishing surfaces which remain substantially parallel with the workpiece surface being finished during finishing is preferred and applying movements to the discrete finishing member finishing surfaces which are within 3 degrees of parallel with the workpiece surface being finished are more preferred and applying movements to the discrete finishing member finishing surfaces which are within 2 degrees of parallel with the workpiece surface being finished are even more preferred and applying movements to the discrete finishing member finishing surfaces which are within 1 degree of parallel with the workpiece surface being finished are even more preferred. Reference Numeral 114 (workpiece surface being finished) and Reference Numeral 142 (finishing element finishing surface) are depicted in FIG. 3 in a substantially parallel relationship. By keeping the discrete finishing members substantially parallel with the workpiece surface during finishing, unwanted surface damage can generally be reduced or eliminated. Applying a variable pressure to the backside of the discrete finishing members as shown in FIG. 5 can facilitate maintaining this parallel relationship.

A finishing element having discrete finishing members having at least of a portion of its surface facing away from the workpiece being finished spaced apart from the unitary resilient body is preferred for some applications. FIGS. 5*a* and 5*b* are artist's expanded cross-sectional view representing some preferred spaced apart embodiments. FIG. 5*a* represents an artist's cross-section view showing a portion of backside of the discrete finishing member fixedly attached to the unitary resilient body. Reference Numeral 120 represents the finishing element. Reference Numeral 130 represents the unitary resilient body. Reference Numeral 140 represents the discrete finishing member and Reference Numeral 142 represents the finishing surface of the discrete finishing member. Reference Numeral 143 represents the side of the discrete finishing member facing away from the workpiece being finished and is often referred to herein as the backside of the discrete finishing member. Reference Numeral 400 represents an optional open space between the discrete finishing members. Reference Numeral 400 can be a passage way for supplying the finishing composition to the discrete finishing member finishing surface. Reference Numeral 434 represents a portion of the backside of the discrete finishing member spaced apart from the unitary resilient body. In other words, at least a portion of the backside surface of the discrete finishing member is free of contact with the unitary resilient body. Reference Numeral 435 represents a spaced apart region between the unitary resilient body and the discrete finishing member. Numeral 436 represents a portion of the backside of the discrete finishing member which is fixedly attached to unitary resilient body. By having a portion of the backside of the discrete finishing member spaced apart from the unitary resilient body and a different portion of the backside of the discrete finishing member fixedly attached to the unitary resilient body, a nonuniform pressure can be applied to the backside of the discrete finishing member in order to control the pressure applied to workpiece surface being finished. A backside of the discrete finishing member proximate at least a portion of the perimeter of the discrete finishing member fixedly attached to the unitary resilient body is preferred and a backside of the discrete finishing member proximate to the perimeter of the discrete finishing member fixedly attached to the unitary resilient body is more preferred. A nonuniform pressure applied to the backside of the discrete finishing member proximate at least a portion of the perimeter of the discrete finishing member is preferred and a nonuniform pressure applied to the backside of the discrete finishing member proximate at least the perimeter of the discrete finishing member is more preferred. This nonuniform pressure can help compensate for shear stresses during finishing to improve maintaining the discrete finishing member finishing surface parallel to the workpiece surface being finished. Some illustrative motions of the discrete finishing member is represented in Reference Numeral 480 for illustration. Nonuniform pressure applied to the backside of the discrete finishing member can help reduce unwanted surface damage. Applying a nonuniform pressure to the backside of the discrete finishing member for maintaining the discrete finishing member finishing surface substantially parallel to the workpiece surface being finished is preferred.

FIG. 5*b* represents an artist's cross-section view showing a portion of backside of the discrete finishing member fixedly attached to the unitary resilient body. Reference Numeral 120 represents the finishing element. Reference Numeral 130 represents the unitary resilient body. Reference Numeral 140 represents the discrete finishing member and Reference Numeral 142 represents the finishing surface of the discrete finishing member. Reference Numeral 143 represents the side of the discrete finishing member facing away from the workpiece being finished and is often referred to herein as the backside of the discrete finishing member. Reference Numeral 400 represents an optional open space between the discrete finishing members. Reference Numeral 400 can be a passage way for supplying the finishing composition to the discrete finishing member finishing surface. Reference Numeral 410 represents an optional preferred third layer. Optionally, the third layer can reinforce the finishing element and/or change the resilience. The third layer is preferably fixedly attached to the unitary resilient body. Reference Numeral 434 represents a portion of the backside of the discrete finishing member spaced apart from the unitary resilient body. Reference Numeral 440 represents a spaced apart region between the unitary resilient body and the discrete finishing member. Reference Numeral 436 represents a portion of the backside of the discrete finishing member which is fixedly attached to unitary resilient body. By having a portion of the backside of the discrete finishing member spaced apart from the unitary resilient body and a different portion of the backside of the discrete finishing member fixedly attached to the unitary resilient body, a nonuniform pressure can be applied to the backside of the discrete finishing member in order to control the pressure applied to workpiece surface being finished. This nonuniform pressure can help compensate for shear stresses during finishing to improve maintaining the discrete finishing member finishing surface parallel to the workpiece surface being finished. This can help reduce unwanted surface damage. By having a portion of the backside of the discrete finishing member spaced apart from the unitary resilient body and a different portion of the backside of the discrete finishing member fixedly attached to the unitary resilient body, a nonuniform pressure can be applied to the backside of the discrete finishing member in order to control the pressure applied to workpiece surface being finished. This nonuniform pressure can help compensate for shear stresses during finishing to improve maintaining the discrete finishing member finishing surface parallel to the workpiece surface being finished. Some illustrative motions of the discrete finishing member is represented in Reference Numeral 485 for illustration. Nonuniform pressure applied to the backside of the discrete finishing member can help reduce unwanted surface damage. Applying a nonuniform pressure to the backside of the discrete finishing member for maintaining the discrete finishing member finishing surface substantially parallel to the workpiece surface being finished is preferred.

Each of these constructions shown in FIGS. 4*a*, 4*b*, and 4*c* and 5*a* and 5*b* can be preferable for different workpiece topographies needed particular finishing. Various combinations can also be preferred. The shapes of the cooperating pieces, their thickness, and their physical parameters such as flexural modulus can be used to improve local and global planarity. The local and global stiffness of the finishing element can be customized for the individual semiconductor wafer design and finishing needs by adjusting the parameters herein discussed. A third layer member comprising an organic polymer is preferred. A finishing element having the above cooperating elements works in a new and different manner for delivering a new and useful finishing result. Further, since in the preferred mode the discrete finishing member and the unitary resilient body are fixedly attached to each other they work in a new and interdependent manner. A finishing element having a plurality of discrete finishing members fixedly attached to a unitary resilient body for applying an interdependent localized pressure to the operative finishing interface is very preferred. Applying an interdependent localized pressure to the operative finishing interface with a plurality of discrete finishing members fixedly attached to a unitary resilient body is preferred.

A finishing element having discrete finishing members having at least of a portion of its surface facing away from the workpiece being finished spaced apart from the unitary resilient body is preferred for some applications. FIGS. 6*a* and 6*b* are artist's expanded cross-sectional view representing some preferred spaced apart embodiments and the discrete finishing members having an interlocking mechanism with the unitary resilient body. FIG. 6*a* represents an artist's cross-section view showing a portion cross-sectional view of the discrete finishing member fixedly attached to the unitary resilient body. Reference Numeral 120 represents the finishing element. Reference Numeral 130 represents the unitary resilient body. Reference Numeral 140 represents the discrete finishing member and Reference Numeral 142 represents the finishing surface of the discrete finishing member. Reference Numeral 143 represents the side of the discrete finishing member facing away from the workpiece being finished and is often referred to herein as the backside of the discrete finishing member. Reference Numeral 700 represents an interlocking mechanism to help fixedly attach the discrete finishing member to the unitary resilient body. In this particular preferred embodiment, an interlocking protrusion which extends into the unitary resilient body is shown. Also, the protrusion, in this illustrated embodiment, extends from an integral footer on the discrete finishing member. The integral footer, as shown here, applies a variable pressure to the backside of the discrete finishing member to help reduce unwanted motion of the discrete finishing member due to shearing forces during finishing. The motion of the discrete finishing member during finishing is represented by Reference Numeral 490. The chamfers illustrated in this FIG. 6*a* can aid in fixedly attaching the discrete finishing member to unitary resilient body and also ease the discrete finishing member over the "up areas" on the workpiece being finished and thus help reduce unwanted surface damage to the workpiece surface being finished. A physical attaching mechanism at least in part can be preferred fixedly attachment in some finishing elements. Nonlimiting preferred examples of a physical attaching mechanism is a friction mechanism, an interlocking mechanism, and an interpenetrating mechanism.

A finishing element having discrete finishing members having at least of a portion of its surface facing away from the workpiece being finished spaced apart from the unitary resilient body is preferred for some applications. FIG. 6*b* represents an artist's cross-section view showing a portion cross-sectional view of the discrete finishing member fixedly attached to the unitary resilient body. Reference Numeral 120 represents the finishing element. Reference Numeral 130 represents the unitary resilient body. Reference Numeral 140 represents the discrete finishing member and Reference Numeral 142 represents the finishing surface of the discrete finishing member. Reference Numeral 143 represents the side of the discrete finishing member facing away from the workpiece being finished and is often referred to herein as the backside of the discrete finishing member. Reference Numeral 702 represents an interlocking mechanism to help fixedly attach the discrete finishing member to the unitary resilient body. In this particular preferred embodiment, an interlocking protrusion which extends into the unitary resilient body is shown. Also, the protrusion, in this illustrated embodiment, extends from an integral footer on the discrete finishing member. The integral footer, as shown here, applies a variable pressure to the backside of the discrete finishing member to help reduce unwanted motion of the discrete finishing member due to shearing forces during finishing. The motion of the discrete finishing member during finishing is represented by Reference Numeral 495. The chamfers illustrated by Reference Numerals 710 and 712 in this FIG. 6*b* can aid in fixedly attaching the discrete finishing member to unitary resilient body. The chamfer illustrated by Reference Numeral 712 can also ease the discrete finishing member over the "up areas" on the workpiece being finished and thus help reduce unwanted surface damage to the workpiece surface being finished. A rounded edge can be used to ease the workpiece over the "up areas" to reduce unwanted surface damage. A mechanical locking mechanism can be preferred for some finishing elements to aid fixedly attaching the discrete finishing member to the unitary resilient body. An interlocking mechanism can be preferred for some finishing elements to aid fixedly attaching the discrete finishing member to the unitary resilient body. An interpenetrating the unitary resilient body material with the discrete finishing members is preferred to improve the ruggedness of the finishing element.

FIGS. 7*a* and 7*b* are artist's representation cross-sections of several preferred embodiments of the discrete finishing members of this invention. In FIGS. 7*a* and 7*b*, Reference Numeral 140 represents the discrete finishing member, Reference Numeral 142 represents the discrete finishing member finishing surface and Reference Numeral 148 represents the discrete finishing member body. In FIG. 7*a*, Reference Numeral 500 represents discrete regions of material, preferably soft organic synthetic resin, optionally having dispersed therein abrasives, preferably abrasive particles. Reference Numeral 502 represents a magnified view of Reference Numeral 500 showing the abrasive particles. Reference Numeral 510 represents the abrasive particles in the discrete regions of material in FIG. 7*a*. Optional abrasive particles can be dispersed in both the discrete regions of synthetic material and in the continuous phase of synthetic resin to advantage. Different abrasive particles dispersed in the continuous phase of synthetic resin and in the discrete regions of synthetic material are more preferred when abrasive particles are dispersed in both phases. A preferred discrete region of synthetic material is a discrete synthetic resin particle and more preferably a discrete soft synthetic resin particle. By adjusting the type and location of the abrasive particles, the finishing element finishing characteristics can be adjusted to advantage for the workpiece being finished. Reference Numeral 550 represents optional discrete finishing aids. The embodiment shown in FIG. 7*a* is particularly preferred because the discrete abrasive regions can be finely tuned to particular finishing needs of the semiconductor wafer while maintaining control of the flexibility of the discrete finishing member body. Also shown is the thickness of the discrete finishing member body (Reference Numeral 184) and the shortest distance across the discrete finishing member body (Reference Numeral 180). Control of the ratio of the shortest distance across in centimeters of the discrete finishing member body to the thickness in centimeters of the discrete finishing member body can improve finishing. A ratio of the shortest distance across in centimeters of the discrete finishing member body to the thickness in centimeters of the discrete finishing member body of at least 10/1 is preferred and a ratio of at least 20/1 is more preferred and a ratio of at least 30/1 is even more preferred. A ratio of the shortest distance across in centimeters of the discrete finishing member body to the thickness in centimeters of the discrete finishing member body of from 10/1 to 1000/1 is preferred and a ratio of from 20/1 to 1000/1 is more preferred and a ratio of from 30/1 to 500/1 is even more preferred. A finishing element having all of the discrete finishing members separated from their nearest discrete finishing member neighbor by at least ½ the thickness of the finishing member in centimeters is preferred and a finishing element having all of the discrete finishing members separated from their nearest discrete finishing member neighbor by at least 1 times the thickness of the finishing member in centimeters is more preferred and a finishing element having all of the discrete finishing members separated from their nearest discrete finishing member neighbor by at least times the thickness of the finishing member in centimeters is even more preferred. The separating distance reduces unwanted interactions between neighboring discrete finishing members during finishing helping to reduce unwanted surface damage to the workpiece surface being finished and/or the finishing element during manufacturing and shipping. A specific maximum distance of separation of the finishing elements from their nearest neighbor has yet to be determined but as the distance becomes larger, fewer discrete finishing members are contained in the finishing element which can cause unwanted reductions in finishing rate and/or higher than necessary localized pressures. For this reason, a finishing element having all of the discrete finishing members separated from their nearest discrete finishing member neighbor by from ½ to 10 the thickness of the discrete finishing member in centimeters is currently preferred and a finishing element having all of the discrete finishing members separated from their nearest discrete finishing member neighbor by from 1 to 6 times the thickness of the discrete finishing member in centimeters is currently more preferred In FIG. 7*b*, Reference Numeral 601 represents a small region in a different discrete finishing member body which is magnified in Reference Numeral 600 to show the abrasive particles Reference Numeral 602. Reference Numeral 555 represents optional regions of soft organic synthetic resin and/or modifier materials. Preferably, in the embodiment shown FIG. 7*b* the abrasives are dispersed in the discrete finishing member body. This prolongs the useful life of the discrete finishing member body even after conditioning of the finishing element.

Current finishing elements tend to have a higher cost of manufacture than necessary which in turn can lead to a higher cost to manufacture semiconductor wafers. Parts of the finishing element of this invention can be made on high volume plastic processing equipment and at low cost. The new discrete finishing members can be made with current commercial thermoplastic materials having low processing costs and in addition have excellent toughness and reinforcement characteristics which help to increase finishing element life expectancy and thus further reduce costs to finish a semiconductor wafer. The finishing elements of this invention can be made with current commercial synthetic resin materials having broad range Shore A hardness, Shore D hardness, flexural modulus, coefficient of friction, and compressibility to customize the "responsiveness" of the finishing element finishing surface to applied pressure and the way it urges the discrete finishing members against the workpiece surface to effect finishing in both local and global regions. Discrete finishing member finishing surfaces and their interactions with the unitary resilient body can be customized for improve both local planarizing and global planarizing. Discrete finishing member finishing surfaces and their interactions with the unitary resilient body can be designed to enhance selectivity and improve control particularly near the end-point. Still further, the finishing element can be used as a reservoir to efficiently and effectively deliver finishing aids to the operative finishing interface. Finishing aids and/or preferred continuous phase synthetic resin matrices can help lubricate the operative finishing interface. Lubrication reduces breaking away of the optionally preferred abrasive particles from the surface of the fixed abrasive finishing element by reducing friction forces. Lubrication reduces the friction which reduces adverse forces particularly on a high speed belt fixed abrasive finishing element which under high friction can cause belt chatter, localized belt stretching, and/or belt distortions, high tendency to scratch and/or damage workpiece surface being finished. Localized and or micro localized distortions to the surface of a fixed abrasive finishing element and chatter can also occur with other finishing motions and/elements and lubrication can reduce or eliminate these. By having discrete synthetic resin particles having abrasives dispersed in the discrete finishing members, the synthetic resin in the discrete synthetic resin particles can be further customized by adjusting such preferred properties as Shore A hardness (Shore D hardness), flexural modulus, coefficient of friction, and resilience to interact with both the workpiece surface being finished and also the discrete finishing member to make a very versatile, low cost manufacturing platform to produce customized low cost fixed abrasive finishing elements. With the above advantages, the new finishing elements can be customized and made on low cost, highly efficient manufacturing equipment to produce high performance, unique versatile fixed abrasive finishing elements. The finishing elements of this invention can improve the yield and lower the cost of finishing semiconductor wafer surfaces. Still further preferred embodiments are described elsewhere herein. The unitary resilient body and the discrete finishing members interact and cooperate in a new and useful way to improve finishing. This new problem recognition and unique solution are new and considered part of this current invention.

Finishing Element

Preferred cohesive finishing elements of this invention have been described in FIGS. 1 through 5 above. All finishing elements of this invention have regions having at least two different layers, one layer is the discrete finishing member and one layer is the unitary resilient body. A unitary resilient body comprises a continuous layer throughout the finishing element. The discrete finishing members preferably are uniformly shaped. A rectangle is a preferred uniform shape. A circle is a preferred uniform shape. An oval is a preferred uniform shape. A shape combining elements of an oval and a rectanglar shape is a preferred uniform shape. The discrete finishing member can be arranged randomly or in a pattern on the unitary resilient body. Each discrete finishing member is spaced apart from its nearest discrete finishing member neighbor. In other words, a finishing element having each discrete finishing member separated from its nearest discrete finishing member neighbor is preferred. Still in other words, a finishing element having each discrete finishing member is spaced apart from and free of contact with its nearest discrete finishing member neighbor is preferred. In other words, the discrete finishing members are separated in space from their nearest discrete finishing member neighbors. This spacing apart facilitates preferred discrete finishing member motion during finishing.

The discrete finishing member is fixedly attached to the unitary resilient body. Bonding is a preferred means of fixed attachment. Thermal bonding is a preferred form of bonding. Adhesive bonding is a preferred means of bonding. A discrete finishing member which is fixedly attached to the unitary resilient element body and which is physically separated resulting in cohesive failure in the unitary resilient body is very preferred. A discrete finishing member which is fixedly attached to the unitary resilient element body and which is physically separated resulting in a separation which is free of adhesive failure is particularly preferred. Preferred means for fixedly attaching the discrete finishing member to the unitary resilient body include the formation of chemical bonds and more preferably covalent chemical bonds. Another preferred means for fixedly attaching the discrete finishing member to the unitary resilient body include the polymer chain interdiffusion. A combination of polymer chain interdiffusion bonding and covalent chemical bonds are particularly preferred. A PSA is a preferred adhesive. A waterproof PSA is a more preferred adhesive. An acrylic PSA is a preferred PSA. Solvent based adhesives can be effective. Phenolic and polyurethane adhesives can be useful. A preferred group of adhesives having at least a portion of their formulation consisting of organic materials selected from the group consisting of unsaturated polyesters polymers, epoxy polymers, acrylic polymers, and polychloroprene polymers. Reactive polymers are preferred adhesives. Polyurethane and phenolic adhesives are generally known to those skilled in the art. Reactive polymers having a reactive oxygen function group is preferred. Epoxy functional groups, anhydride functional groups, carboxylic acid functional groups, alcoholic functional groups, and phenolic functional groups are preferred examples of reactive oxygen functional groups. Adhesives are generally available commercially and known to those skilled in art. Using an activating surface treatment can aid bonding and attachment. A nonlimiting example of an activating surface treatment is a plasma treatment. Commercial plasma treatment and plasma treatment equipment is available. Another nonlimiting example of an activating surface treatment is reactive chemical treatment such as a wet chemical etch or a flame treatment. Currently a plasma treatment is particularly preferred. A reactive surface treatment can facilitate fixedly attaching the discrete finishing members to the unitary resilient body. A reactive surface treatment can facilitate fixedly attaching the discrete finishing members and unitary resilient body to an optional third layer such as a reinforcing layer. MetroLine/IPC in Marlton, N.J. is a nonlimiting example company. Use of recesses can also improve the strength of the attachment of the discrete finishing members to the unitary resilient body (see for instance, FIG. 4*c*, Reference Numeral 422). Discrete finishing members which are fixedly attached to the unitary resilient body in a manner that resists separation during operative finishing motion is preferred. Discrete finishing members which are fixedly attached to the unitary resilient body in a manner that prevents separation during operative finishing motion is particularly preferred. Discrete finishing members which come lose during operative finishing motion can damage the workpiece surface being finished.

Failure of the fixed attachment of the discrete finishing member to the unitary resilient layer can cause catastrophic damage to the expensive semiconductor wafer(s) being polishing and therefore this fixed attachment is very important. Generally one semiconductor wafer has a dollar value much higher than a finishing element. Thus fixedly attaching the discrete finishing member to the unitary resilient body is most preferred.

Polymers having a modulus of elasticity of at most 4,000,000 psi are preferred for the continuous phase of synthetic resin and for the discrete synthetic resin particles. Polymers having a modulus of elasticity at most 3,000,000 psi are more preferred for the continuous phase of synthetic resin and for the synthetic resin particles. Polymers having a modulus of elasticity at most 2,000,000 psi are even more preferred for the continuous phase of synthetic resin and for the synthetic resin particles. Polymers having too high of modulus of elasticity can cause unwanted surface damage and other undesirable effects on finishing.

A discrete finishing member finishing surface having a surface comprised of a continuous polymer "A" region and a multiplicity of discrete polymer "B" regions wherein the finishing characteristics of polymer "A" region are different than the discrete polymer "B" regions is preferred for some finishing applications. A different hardness (as measured by Shore A, Shore D, or a rockwell hardness) is a preferred different finishing characteristic. A different flexural modulus for polymer "A" and polymer "B" is a preferred different finishing characteristic. A different surface energy for polymer "A" and polymer "B" is a preferred different finishing characteristic. A different surface roughness for polymer "A" region and polymer "B" region is a preferred different finishing characteristic. By applying discrete finishing member finishing surface having different finishing characteristics, the versatility of the finishing element can be enhanced. A finishing element having a porous unitary resilient body and nonporous discrete finishing members fixedly attached thereto is a preferred finishing element. A finishing element having discrete finishing members with a 0.2 gram/cubic centimeter density higher than the unitary resilient body is preferred and one having discrete finishing members with a 0.3 gram/cubic centimeter density higher than the unitary resilient body is more preferred and one having discrete finishing members with a 0.4 gram/cubic centimeter density higher than the unitary resilient body is even more preferred. A foamed unitary resilient body is a preferred example of a porous unitary resilient body. A porous unitary resilient body can retain and deliver the finishing composition to the finishing member finishing surfaces very effectively. Further, a porous unitary resilient body can be made with good resilience to urge the discrete finishing members against the workpiece being finished during finishing.

Unitary Resilient Body

The unitary resilient body forms a continuous layer in the finishing element. The unitary resilient body forms a flexible member allowing limited motion of the discrete finishing members during the finishing operation. Preferred limited motion is represented by Reference Numerals 450, 460, and 470 in FIGS. 4*a*, 4*b*, and 4*c* respectively. The limited motion is influenced by the pressure applied between the unitary resilient body and the discrete finishing members along with any third layer members. Properties of the unitary resilient body which are preferably controlled include the hardness of the unitary resilient body, the flexural modulus of the unitary resilient body, and the compression set of the unitary resilient body. The limited motion urges the discrete finishing members against the workpiece surface in local areas (in operative finishing contact with the discrete finishing members) while facilitating global flexibility in the finishing element (such as at the areas in between the discrete finishing members shown in FIG. 4*a* in Reference Numeral 400 and FIG. 4*c* in Reference Numeral 420). In finishing elements having three layers such as shown in FIGS. 4*b* and 4*c*, the unitary flexible body also forms a cooperative laminate construction which can stiffen the localized regions having the discrete finishing members.

A unitary resilient body comprising synthetic resins having a flexural modulus of at most 15,000 psi are preferred and of at most 10,000 psi are more preferred and of at most 7,000 psi are even more preferred and of at most 4,000 psi are even particularly more preferred. A flexural modulus of at least 500 psi is preferred and one of at least 800 psi is more preferred. Other preferred property ranges of the unitary resilient body synthetic resin include hardness, specific gravity (if a foamed material), and compressibility which are useful guidance to improve performance and preferred ranges discussed herein. A synthetic resin having a hardness of at most a Shore D of 80 is preferred and of at most a Shore D of 60 is more preferred and of at most a Shore A of 90 is even more preferred and of at most a Shore A of 75 is even more particularly preferred. A synthetic resin having a hardness of from Shore D 80 to Shore A 30 is preferred and of from Shore D 70 to Shore A 40 is more preferred and of at most a Shore A 90 to Shore D 40 is even more preferred. A compressibility of at most 40% is preferred and of at most 30% is more preferred. A compressibility of from 40% to 1% is preferred for many applications. Where a foamed unitary resilient body is used, a specific gravity of from 0.2 to 0.8 is preferred and from 0.25 to 0.5 is more preferred. Shore hardness in A and D units are measured by ASTM D2240. Compressibility is measured by TM-100-390-405.

Specific gravity is calculated using formulas generally known to those skilled in the art. Flexural modulus is preferably measured with ASTM 790 B at 73 degrees Fahrenheit.

A unitary resilient body comprising an elastomer is preferred. A preferred elastomer is a thermoset elastomer. Another preferred elastomer is a thermoplastic elastomer. A preferred synthetic resin is a polyolefin elastomer. Some particularly preferred elastomers include synthetic resins selected from the group consisting of polyurethanes, acrylics, acrylates, polyamides, polyesters, chloroprene rubbers, ethylene propylene polymers, butyl polymers, polybutadienes, polyisoprenes, EPDM elastomers, and styrene butadiene elastomers. Thermoplastic elastomers can have preferred processing characteristics. Polyolefin elastomers can be preferred for their generally low cost. A cross-linked elastomer can have improved thermoset properties and also chemical resistant and thus can be preferred. A thermoplastic vulcanizate comprises a preferred composition. A multiphase thermoplastic elastomer comprises a preferred composition and a multiphase thermoplastic elastomer having a compatibilizing agent is even more preferred. A thermoplastic elastomer composition which has been crosslinked after shaping can also be preferred. A foamed elastomer can improve resilience and reduce material costs and thus can be a preferred for certain applications. Elastomers are generally available commercially from a number of major chemical companies. Polyurethanes are preferred for the inherent flexibility in formulations. A continuous phase synthetic resin matrix comprising a foamed synthetic resin matrix is particularly preferred because of its flexibility and ability to transport the finishing composition. A finishing element comprising a foamed polyurethane polymer is particularly preferred. Foamed polyurethane has desirable abrasion resistance combined with good costs. Foaming agents and processes to foam organic synthetic polymers are generally known in the art. A cross-linked continuous phase synthetic resin matrix is preferred for its generally enhanced thermal resistance. A finishing element comprising a compressible porous material is preferred and comprising organic synthetic polymer of a compressible porous material is more preferred.

A unitary resilient body having a higher transport of finishing composition than the discrete finishing members is preferred. A unitary resilient body having passages communicating from their back surface to their front to supply finishing composition to the discrete finishing members during finishing is preferred. This can improve finishing composition supply during finishing of the workpiece surface and thereby help reduce unwanted surface defects.

Foamed sheets of elastomers suitable for some preferred embodiments of the invention are available from commercially Rodel in Newark, Del. and Freundenberg in Lowell, Mass.

Discrete Finishing Member

A fixed abrasive finishing member having a continuous phase synthetic resin matrix is preferred. A fixed abrasive discrete finishing member having a single continuous phase of synthetic resin matrix extending across the length of the discrete finishing member is more preferred. A fixed abrasive discrete finishing member having a single continuous phase of synthetic resin matrix extending across the length and width of the discrete finishing member is even more preferred. This continuous phase synthetic resin matrix can form a binding resin which optionally (and preferably) fixes the discrete synthetic resin particles which in turn optionally (and preferably) have the abrasive particles therein. A continuous phase synthetic resin matrix comprising at least one material selected from the group consisting of an organic synthetic polymer, an inorganic polymer, and combinations thereof is preferred. A preferred example of organic synthetic polymer is a thermoplastic polymer. Another preferred example of an organic synthetic polymer is a thermoset polymer. A solid continuous phase of synthetic resin matrix is a preferred construction. A foamed continuous phase of synthetic resin can also be a preferred construction. A discrete finishing member can have a plurality of layers. For instance, a discrete finishing member can have an abrasive finishing surface fixedly attached to a discrete stiffening layer to give the discrete finishing member a high flexural modulus. The discrete stiffening layer preferably is substantially the same shape and size as the discrete finishing member finishing surface. When discrete stiffening layer has a stiffening additive such as inorganic fibers (for instance, glass fibers) capable of causing unwanted surface damage to the workpiece, then the discrete stiffening layer is preferably remote from the workpiece surface being finished during finishing.

The ratio of the area of the surface of the discrete finishing member to the area of the surface of the semiconductor die being finished can give useful guidance for finishing improvements. Each discrete finishing member having a surface area of less than the surface area of the semiconductor wafer being finished is preferred. Each discrete finishing member having a surface area of less than the surface area of the semiconductor wafer being finished and at least the surface area of the die being finished is more preferred. A ratio of the area of the surface of the discrete finishing members to area of the die of at least 1/1 is preferred and of at least 2/1 is more preferred and of at least 3/1 is even more preferred and of at least 4/1 is even more particularly preferred. A ratio of the area of the surface of the discrete finishing members to area of the die of from 1/1 to 20/1 is preferred and of from 2/1 to 15/1 is more preferred and of from 3/1 to 10/1 is even more preferred and of from 4/1 to 10/1 is even more preferred. These ratios tend to optimize the cooperative motions discussed in relation to FIGS. 4*a*, 4*b*, and 4*c*. A discrete finishing member having a surface area sufficient to simultaneously cover at least two regions of high device integration during finishing of the semiconductor wafer is preferred and a surface area sufficient to simultaneously cover at least five regions of high device integration during finishing of the semiconductor wafer is more preferred and a surface area sufficient to simultaneously cover at least ten regions of high device integration during finishing of the semiconductor wafer is even more preferred. A discrete finishing member having a surface area sufficient to simultaneously cover from 2 to 100 regions of high device integration during finishing of the semiconductor wafer is preferred and a surface area sufficient to simultaneously cover 2 to 50 regions of high device integration during finishing of the semiconductor wafer is more preferred and a surface area sufficient to simultaneously cover from 5 to 50 regions of high device integration during finishing of the semiconductor wafer is even more preferred. A discrete finishing member having a surface area sufficient to simultaneously cover from 2 to 100 regions of high pattern density during finishing of the semiconductor wafer is preferred and a surface area sufficient to simultaneously cover 2 to 50 regions of high pattern density during finishing of the semiconductor wafer is more preferred and a surface area sufficient to simultaneously cover from 5 to 50 regions of high pattern density during finishing of the semiconductor wafer is even more preferred. A line pattern density and a oxide pattern density are preferred types of pattern density. The size of the preferred discrete finishing member is also dependent on the specific design and layout of the die and the wafer but applicant believes that the above ratios will serve as helpful general guidance.

The discrete finishing member of this invention has optionally has an abrasive surface and more preferably a fixed abrasive surface. The discrete finishing member has a flexural modulus greater than the flexural modulus of the unitary resilient body. The discrete finishing member, because of its higher flexural modulus improves local planarity of the workpiece. The higher flexural modulus resists bending during finishing and thus better resists following the local surface changes and instead tends to apply high pressures to raised unwanted surface regions and reduced or no pressure to the lower regions. Since finishing rate is generally related to the applied pressure, this improves the local planarizing process. A typical example of a raised unwanted surface region is the areas on a semiconductor die having high density due to a previous processing step which should be reduced to improve planarity across the semiconductor die. As also discussed herein, the discrete finishing member is fixedly attached to the unitary resilient body and cooperates with the unitary resilient body in applying pressure and operative finishing motion against the workpiece surface being finished.

An abrasive discrete finishing member surface having a three dimensional dispersion of discrete synthetic resin particles as used herein is a fixed abrasive finishing member surface layer having discrete synthetic resin particles dispersed throughout at least a portion of its thickness, such that if some of the surface is removed additional discrete synthetic resin particles are exposed on the newly exposed surface. A finishing member surface having a three dimensional dispersion of discrete synthetic resin particles is particularly preferred. A fixed abrasive discrete finishing member surface having a plurality of discrete synthetic resin particles substantially uniformly dispersed throughout at least a portion of its thickness is more preferred. A fixed abrasive discrete finishing member surface having a plurality of discrete synthetic resin particles uniformly dispersed throughout at least a portion of the members thickness and wherein the discrete synthetic resin particles have abrasive particles dispersed therein is even more preferred. Having a discrete finishing member surface having a three dimensional dispersion of discrete synthetic resin particles can facilitate renewal of the finishing surface during finishing element conditioning. During finishing of a workpiece, it is preferred that a discrete finishing member surface having a three dimensional discrete synthetic resin particles is substantially uniform over the depth the finishing surface used. Any nonuniform surface formed during manufacture due to the processing and/or forming conditions when manufacturing the discrete finishing members is preferably removed prior to finishing of the workpiece surface. A thin nonuniform layer can be removed by cutting the unwanted nonuniform layer off. A thin nonuniform layer can be removed by abrasive means. A nonuniform skin can be formed by settling due to density differences of the components and/or due to specific shear conditions or surface interactions with a molding or forming surface.

A discrete finishing member having a continuous phase of material imparting resistance to local flexing is preferred. A preferred continuous phase of material is a synthetic resin, more preferably an organic synthetic resin. An organic synthetic resin having a flexural modulus of at least 20,000 psi is preferred and one having a flexural modulus of at least 50,000 psi is more preferred and one having a flexural modulus of at least 100,000 psi is even more preferred and one having a flexural modulus of at least 200,000 psi is even more particularly preferred for the continuous phase of synthetic resin in the discrete finishing member. An organic synthetic resin having a flexural modulus of at most 5,000,000 psi is preferred and having a flexural modulus of at most 3,000,000 psi is more preferred and having a flexural modulus of at most 2,000,000 psi is even more preferred for the continuous phase of synthetic resin in the discrete finishing member. An organic synthetic resin having a flexural modulus of from 5,000,000 to 20,000 psi is preferred and having a flexural modulus of from 5,000,000 to 50,000 psi is more preferred and having a flexural modulus of from 3,000,000 to 100,000 psi is even more preferred and having a flexural modulus of at from 2,000,000 to 200,000 psi is even more particularly preferred for the continuous phase of synthetic resin in the discrete finishing member. A preferred organic synthetic resin is an organic polymer. These ranges of flexural modulus for the synthetic resins provide useful performance for finishing a semiconductor wafer and can improve local planarity in the semiconductor. Flexural modulus is preferably measured with ASTM 790 B at 73 degrees Fahrenheit. Pounds per square inch is psi.

Organic synthetic resins having a high flexural modulus are known. A thermoplastic resins is a preferred organic synthetic resin. A thermoplastic polymer is a preferred organic synthetic resin. Thermoplastic synthetic resins and polymers can be formed by many preferred methods such as injection molding and extrusion. Thermoplastic synthetic resins can be formed by many preferred methods such as injection molding and extrusion. Thermoset synthetic resins are also a organic synthetic resin. Thermoset synthetic resins can be molded at lower viscosity which can have advantages and are can be formed into shapes by reaction injection molding and casting. Nylons are a preferred organic synthetic resin. Nylons are tough, relatively stiff, abrasion resistant and cost effective. Polyesters are a preferred organic synthetic resin. Polyesters are tough, relatively stiff and cost effective. Liquid crystal polymers are a preferred organic synthetic resin. Liquid crystal polymers can be particularly stiff and can be abrasion resistant. Polyolefins are a preferred organic synthetic resin. An organic synthetic resin selected from the group consisting of polyamides, polyesters, polystyrenes, polycarbonates, polyimides are examples of preferred organic synthetic resins. Polymer blends of organic synthetic resins are also preferred because they can be particularly tough and abrasion resistant. Polyolefin polymers are particularly preferred for their generally low cost. A preferred polyolefin polymer is polyethylene. Another preferred polyolefin polymer is a propylene polymer. High density polyethylene and ultra high molecular weight polyethylene are preferred ingredients in the continuous phase synthetic resin matrix because they are low cost, thermoplastically processable and have a low coefficient of friction. A cross-linked polyolefin, even more preferably cross-linked polyethylene, can be a especially preferred continuous phase synthetic resin matrix. Another preferred polyolefin polymer is a ethylene propylene copolymer. Preferred synthetic resins include epoxy organic synthetic resins, polyurethane synthetic resins, and phenolic synthetic resins. Organic synthetic resins selected from the group consisting of polysulfone, polyphenylene sulfide, and polyphenylene oxide are also a preferred. A syndiotactic polystyrene is a preferred continuous phase synthetic resin. They have a good balance of stiffness and resistance to acids, bases, and/or both acids and bases. Organic synthetic resins which can be reaction injection molded are preferred resins. An example of a reaction injection moldable organic synthetic resin is polyurethane. Copolymer organic synthetic polymers are also preferred. Organic synthetic resins having reactive function group(s) can be preferred for some composite structures because it these can improve bonding between different materials and or members. Some preferred reactive functional groups include reactive functional groups containing oxygen and reactive functional groups containing nitrogen. Organic synthetic resins having polar functional groups can also be preferred.

A stiff organic synthetic resin is a preferred type of high flexural modulus organic synthetic resin. As used herein, a stiff organic synthetic resin is an organic synthetic resin having a flexural modulus of greater than 300,000 psi when measured by ASTM 790 B at 73 degrees Fahrenheit. A class of organic synthetic resins known as engineering polymers are generally a preferred class of stiff organic synthetic resins. Illustrative preferred stiff organic synthetic resins include resins selected from the group consisting of polyesters, polyimides, liquid crystal polymers, and polyamides. Another illustrative preferred stiff organic synthetic resins include resins selected from the group consisting of polyetheretherketone, polyaryletherketone, polyetherimide, polyimide, polyethersulfone, polyamide-imide, polyethylene terephthalate, polybutylene terephthalate, acetal homopolymer, acetal copolymer, and liquid crystal polymer. A nylon is a particularly preferred stiff organic synthetic resin because it is has a high flexural modulus, is abrasion resistant, and relatively low cost. Injection molding of the discrete finishing members is preferred because high production rates, low cost, and highly precise tolerances can be generally be attained by those skilled in the art. Calendaring can also give good tolerances. Stiff organic synthetic resins and methods to process them are generally known in the art as illustrated in U.S. Pat. No. 5,882,245 to Popovich.

The discrete finishing member can be a composite structure. The preferred abrasive material can be dispersed within a preferred organic synthetic resin. The discrete finishing member is preferably free of relatively large abrasive material to prevent unwanted scratching on the surface of the semiconductor wafer. As an example, the discrete finishing member is preferably free of large reinforcing glass fibers or glass flakes as these can cause unwanted scratching. The discrete finishing member can have adhesion promoting agents to improve fixedly attaching the discrete finishing member to the unitary resilient body. An illustrative example of an adhesion promoting agent is an secondary reactive synthetic resin combined with the continuous phase matrix which will react with the bonding agent and/or the unitary resilient body. A polymer having a reactive oxygen functional group is an example secondary reactive synthetic rein. The discrete finishing member can be a composite having synthetic resin fibers. Polyimide fibers, polyamide fibers, acrylic fibers, and polyester fibers are preferred examples of useful reinforcing and/or stiffening fibers. Non scratching fibers are particularly preferred. Reinforceing and/or stiffening fibers which can scratch the workpiece surface are preferably remote from the discrete finishing member finishing surface.

A continuous phase synthetic resin matrix comprised of a mixture of a plurality of organic synthetic resins can be particularly tough, wear resistant, and useful. A preferred composite structure is a blend of different polymers. A continuous phase organic synthetic resin matrix comprising a plurality of organic synthetic polymers and wherein the major component is selected from materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, phenolics, butyl polymers, polybutadienes, polyisoprenes, EPDM elastomers, and styrene butadiene elastomers is preferred. The continuous of high flexural modulus organic synthetic resin preferably extends from at least a portion of one end of the discrete finishing member to the other end of the discrete finishing member. In other words, the continuous high flexural modulus organic synthetic resin extends from at least one end of the discrete finishing member to the opposite end of the discrete finishing member. This preferred embodiment is shown in FIG. 7 described further elsewhere herein. The minor component is preferably also an organic synthetic resin and is preferably a modifying and/or toughening agent. The minor component is preferably dispersed in discrete regions. A preferred minor component is a soft synthetic resin and more preferably a soft organic synthetic resin (or discrete synthetic resin particles). The minor component is dispersed in discrete regions having a maximum dimension of at most 5 microns and more preferably a maximum dimension of at most 1 micron and more preferably a maximum dimension of at most 0.5 micron. The minor component is dispersed in discrete regions having a maximum dimension of at least 0.005 microns and more preferably a maximum dimension of at most 0.01 micron and more preferably a maximum dimension of at most 0.015 micron. The minor component is dispersed in discrete regions, preferably soft organic synthetic resin particles, having a maximum dimension of from 5 to 0.01 microns is preferred and more preferably a maximum dimension of from 1 to 0.015 microns. Soft synthetic resin particles (or discrete synthetic resin particles) which are free of voids are preferred. Soft discrete organic synthetic resin particles having an aspect ratio of from 1/4 to 1/1 are preferred and from 2/1 to 1/1 are more preferred. Addition of a minor component comprising a soft synthetic resin which reduces to the flexural modulus of the high flexural modulus organic synthetic resin by 10% is preferred and addition of a minor component comprising a soft synthetic resin which reduces to the flexural modulus of the high flexural modulus organic synthetic resin by 20% is more preferred and addition of a minor component comprising a soft synthetic resin which reduces to the flexural modulus of the high flexural modulus organic synthetic resin by 25% is even more preferred. Addition of a minor component comprising a soft synthetic resin which reduces to the flexural modulus of the high flexural modulus organic synthetic resin by 10% is preferred and Addition of a minor component comprising a soft synthetic resin which reduces to the flexural modulus of the high flexural modulus organic synthetic resin by 20% is more preferred and Addition of a minor component comprising a soft synthetic resin which reduces to the flexural modulus of the high flexural modulus organic synthetic resin by 25% is even more preferred. Addition of a minor component comprising a soft synthetic resin which reduces to the flexural modulus of the high flexural modulus organic synthetic resin from 10% to 60% is preferred and addition of a minor component comprising a soft synthetic resin which reduces to the flexural modulus of the high flexural modulus organic synthetic resin from 15% to 50% is more preferred. Addition of an organic synthetic polymer modifier, preferably a soft organic synthetic resin, to a high flexural modulus organic synthetic resin in an amount that the high flexural modulus material comprises from 30% to 97% by weight of the total organic synthetic resin is preferred and addition of an organic synthetic polymer modifier to a high flexural modulus organic synthetic resin in an amount that the high flexural modulus material comprises from 40% to 90% by weight of the total organic synthetic resin is more preferred. By mixing a minor component, more preferably an organic synthetic polymer modifier, even more preferably an a soft synthetic resin, with a high flexural modulus organic synthetic resin, preferably a stiff organic synthetic resin the mixture can be made tougher, less prone to cracking, and less prone to cause unwanted surface damage to the workpiece surface being finished. Further, one can mix the abrasive particles in with the soft synthetic resin and then mix the soft synthetic resin having abrasive particles dispersed therein into the high flexural modulus organic synthetic resin, preferably a stiff organic synthetic resin. A high flexural modulus organic synthetic resin, preferably a stiff organic synthetic resin, is substantially free of abrasive particles is preferred and a high flexural modulus organic synthetic resin, preferably a stiff organic synthetic resin, is free of abrasive particles is more preferred. Thus in this preferred embodiment, one proceeds opposite what one of ordinary skill in the art might do to manufacture a stiff discrete finishing member. One does not select solely a stiff organic synthetic resin, one selects an organic synthetic resin with flexural modulus higher than desired and then modifies it with soft synthetic resin particles to produce a tougher discrete finishing member less prone to failure during manufacture, shipping, handling, and finishing. This multiphase composition increases the versatility of the discrete finishing member finishing surface. Flexural modulus is measured with ASTM 790 B at 73 degrees Fahrenheit to determine the percentage change in flexural modulus. Use of ASTM 790B is generally known to those skilled in the polymer arts. All referenced ASTM test methods such as ASTM 790B are included herein in their entirety by reference for general guidance.

A preferred example of an organic synthetic polymer modifier is a material which reduces the hardness or flexural modulus of the finishing element body such an polymeric elastomer. A compatibilizing agent can also be used to improve the physical properties of the polymeric mixture. Compatibilizing agents are often also synthetic polymers and have polar and/or reactive functional groups such as hydroxyl groups, carboxylic acid, maleic anhydride, and epoxy groups. Compatibilizing agents having a chemically reactive functional group are preferred. Compatibilizing agents having a chemically reactive functional group containing oxygen are preferred for many polymer compositions. Compatibilizing agents having a chemically reactive functional group containing nitrogen are preferred for many polymer compositions. An amine functional group is an example of a preferred reactive functional group containing nitrogen. The commercial suppliers of compatibilizing agents can generally recommend preferred compatibilizing agents for particular polymeric compositions. A compatibilizing agent which increases the dispersion of the soft synthetic resin in the stiff organic synthetic resin is preferred. A compatibilizing agent can improve the toughness of the resin. One measure of toughness is by the Notched Izod Impact test 23 degrees centigrade (ASTM D256). Another indicator of toughness is the Fatigue Endurance as measured by ASTM D671.

A discrete finishing member can have a composite structure which helps to impart the resistance to flexing. An illustrative preferred composite structure is a synthetic resin having reinforcing agents dispersed therein. Another preferred composite structure is a multilayered discrete finishing member. The multilayers are fixedly attached to each other. A composite structure having a flexural modulus of at least 20,000 psi is preferred and having a flexural modulus of at least 50,000 psi is more preferred and having a flexural modulus of at least 100,000 psi is even more preferred and having a flexural modulus of at least 200,000 psi is even more particularly preferred for the composite structure in the discrete finishing member. A composite structure having a flexural modulus of at most 5,000,000 psi is preferred and having a flexural modulus of at most 3,000,000 psi is more preferred and having a flexural modulus of at most 2,000,000 psi is even more preferred for the composite structure in the discrete finishing member. A composite structure having a flexural modulus of from 5,000,000 to 20,000 psi is preferred and having a flexural modulus of from 5,000,000 to 50,000 psi is more preferred and having a flexural modulus of from 3,000,000 to 100,000 psi is even more preferred and having a flexural modulus of at from 2,000,000 to 200,000 psi is even particularly more preferred for the composite structure in the discrete finishing member for the composite structure in the discrete finishing member. These ranges of flexural modulus for the composite structures provide useful performance for finishing a semiconductor wafer and can improve local planarity in the semiconductor. Flexural modulus is preferably measured with ASTM 790 B at 73 degrees Fahrenheit.

The ratio of the flexural modulus of the discrete finishing member to the flexural modulus of the unitary resilient body affects the cooperative motion of the discrete finishing member and the unitary resilient body and also the applied pressure to the operative finishing interface. This ratio can serve as guidance for changing and improving finishing for semiconductor wafers. A ratio of the flexural modulus of the discrete finishing member to the flexural modulus of the unitary resilient body of at least 10/1 is preferred and of at least 20/1 is more preferred and of at least 30/1 is even more preferred. A ratio of the flexural modulus of the discrete finishing member to the flexural modulus of the unitary resilient body of from 10/1 to 1,500/1 is preferred and of from 10/1 to 1,000 is more preferred and of from 20/1 to 800/1 is even more preferred.

Mixing technology to disperse the various preferred materials in the continuous phase synthetic resin matrix is generally well known to those skilled in the mixing arts. Thermoset discrete synthetic resin particles is one example of preferred material additive. Cross-linked discrete synthetic resin particles is an example of a preferred material. Synthetic resin fibers can be a preferred material for incorporation. Preferred abrasive particles discussed herein below is an example a preferred material. Mixing the an organic synthetic polymer modifier, preferably a soft organic synthetic resin, into the high flexural modulus organic synthetic resin is preferred and melt mixing the an organic synthetic polymer modifier, preferably a soft organic synthetic resin, into the high flexural modulus organic synthetic resin is more preferred and melt mixing with shear mixing conditions the an organic synthetic polymer modifier, preferably a soft organic synthetic resin, into the high flexural modulus organic synthetic resin is even more preferred. Mixing an organic synthetic polymer modifier, preferably a soft organic synthetic resin, into the high flexural modulus organic synthetic resin along with a compatibilizing agent is preferred and along with reactive compatibilizing agent is more preferred and along with a chemically reactive compatibilizing agent is even more preferred. Example compatibilizing agents and commercial sources are discussed herein. Single and twin screw extruders are commonly used for many thermoplastic mixing operations. High shear mixing such as often found in twin screw is generally desirable. Hoppers and ports to feed multiple ingredients are generally well known in the art. The ingredients can be added in a feed hopper or optionally mixed in the melt using generally well known feed ports. Commercial suppliers of mixing equipment for plastic materials are well known to those skilled in the art. Illustrative nonlimiting examples of mixing equipment suppliers include Buss (America), Inc., Berstorff Corporation, Krupp Wemer & Pfleiderer, and Farrel Corporation.

Mixing technology to disperse the various preferred materials in the continuous phase synthetic resin matrix is generally well known to those skilled in the mixing arts. Thermoset discrete synthetic resin particles is one example of preferred material additive. Cross-linked discrete synthetic resin particles is an example of a preferred material. Synthetic resin fibers can be a preferred material for incorporation. Preferred abrasive particles discussed herein below is an example a preferred material. Abrasive particles can be included in a first synthetic resin and then the first synthetic resin having abrasive particles can then be dispersed in a continuous matrix of synthetic resin with secondary mixing. A high flexural modulus organic synthetic resin, preferably a stiff organic synthetic resin, substantially free of abrasive particles is preferred and a high flexural modulus organic synthetic resin, preferably a stiff organic synthetic resin, free of abrasive particles is more preferred. A high flexural modulus organic synthetic resin, preferably a stiff organic synthetic resin, one type of abrasive particles and the soft synthetic resin particles having another type of abrasive particles can be preferred for some workpiece finishing.

Reactive polymer systems mixing can be mixed, particularly preferable is high shear mixing equipment. Functionalized elastomers and functionalized rubbers can be dispersed in organic synthetic resin matrices. Single and twin screw extruders are commonly used for many thermoplastic mixing operations. High shear mixing such as often found in twin screw is generally desirable. Hoppers and ports to feed multiple ingredients are generally well known in the art. The ingredients can be added in a feed hopper or optionally mixed in the melt using generally well known feed ports. Commercial suppliers of mixing equipment for plastic materials are well known to those skilled in the art. Illustrative nonlimiting examples of mixing equipment suppliers include Buss (America), Inc., Berstorff Corporation, Krupp Werner & Pfleiderer, and Farrel Corporation. Illustrative nonlimiting examples of mixing technology, blended organic synthetic resin matrices, and functionalized modifiers are found in EP 0 759 949 B1 to Luise, U.S. Pat. No. 5,332,782 to Liu et al., U.S. Pat. No. 4,404,317 to Epstein, U.S. Pat. No. 5,112,908 to Epstein, U.S. Pat. No. 5,376,712 to Nakajima, U.S. Pat. No. 5,403,887 to Kihira et al., U.S. Pat. No. 5,508,338 to Cottis et al., U.S. Pat. No. 5,610,223 to Mason, and U.S. Pat. No. 5,814,384 to Akkapeddi et. al. and are included herein in their entirety for general guidance and modification by those skilled in the art.

Synthetic resin polymers of the above descriptions are generally available commercially. Illustrative nonlimiting examples of commercial suppliers of useful organic synthetic polymers include Exxon Co., Dow Chemical, Sumitomo Chemical Company, Inc., DuPont Dow Elastomers, Bayer, and BASF.

A discrete finishing member can also preferably have layers, preferably fixedly connected to each other. For instance, a discrete finishing member can be advantageously comprised of a sublayer of a stiff organic synthetic resin and a 3 dimensional abrasive finishing surface layer fixedly connected to the sublayer. High purity, very fine abrasive can be quite costly and by using abrasive 3 dimensional surface layer, costs can be reduced for some finishing elements. An example of an abrasive 3 dimensional surface layer can is a inorganic abrasive dispersed in an organic synthetic resin matrix. A fixed abrasive discrete finishing member having a single continuous phase of synthetic resin matrix extending across the length and width of the discrete finishing member sublayer is a preferred method to stiffen the discrete finishing member. A finishing element finishing surface having a substantially flat finishing surface is preferred and a finishing element finishing surface having a flat finishing surface is more preferred particularly when discrete stiffening members are used with feed channels between them as shown in FIG. 5 below. A surface topography having at most a 3 micron difference in planarity of the active finishing surface is preferred and having at most 1 micron difference in planarity of the active finishing surface is more preferred and having at most 0.5 micron difference in planarity of the active finishing surface is even more preferred. A peak to valley of at least 0.010 microns is preferred and a in planarity of at least 0.50 micron is more preferred and a in planarity of at least 0.1 micron is even more preferred. Reference Numeral 26 in FIG. 5 is an example of an active finishing surface. These discrete finishing regions, the finishing composition feed channels, and/or the addition of an effective amount of boundary lubricant can reduce or eliminate the "stiction" problem warned against in U.S. Pat. No. 5,958,794 to Bruxvoort et al. issued Sep. 28, 1999. The finishing element finishing surface having a three dimensional topography to enhance finishing composition supply to the workpiece surface is preferred for some applications. Some applicable three dimensional topographies are described in patents included herein by reference.

Discrete Finishing Member—Optionally Preferred Abrasive Surface

An abrasive three dimensional abrasive discrete finishing member is preferred. The abrasive particles are preferably attached to a synthetic resin. Abrasive particles which are bonded to adjacent synthetic organic synthetic resin is more preferred. One or more bonding agents can be used. Illustrative nonlimiting examples of abrasive particles in the discrete synthetic resin particles comprise silica, silicon nitride, alumina, and ceria. Fumed silica is particularly preferred. A metal oxide is a type of preferred abrasive particle. A particularly preferred particulate abrasive is an abrasive selected from the group consisting of iron (III) oxide, iron (II) oxide, magnesium oxide, barium carbonate, calcium carbonate, manganese dioxide, silicon dioxide, cerium dioxide, cerium oxide, chromium (III) trioxide, and aluminum trioxide. Abrasive particles having an average diameter of less than 0.5 micrometers are preferred and less than 0.3 micrometer are more preferred and less than 0.1 micrometer are even more preferred and less than 0.05 micrometers are even more particularly preferred. Abrasive particles having an average diameter of from 0.5 to 0.01 micrometer are preferred and between 0.3 to 0.01 micrometer are more preferred and between 0.1 to 0.01 micrometer are even more preferred. These abrasive particles are currently believed particularly effective in finishing semiconductor wafer surfaces. Smaller abrasive particles can be preferred in the future as feature sizes decrease.

Abrasive particles having a different composition from the finishing element body are preferred. An abrasive particle having a Knoop hardness of less than diamond is particularly preferred to reduce microscratches on workpiece surface being finished and a Knoop hardness of less than 50 GPa is more particularly preferred and a Knoop hardness of less than 40 GPa is even more particularly preferred and a Knoop hardness of less than 35 GPa is especially particularly preferred. An abrasive particle having a Knoop hardness of at least 1.5 GPa is preferred and having a Knoop hardness of at least 2 is preferred. An abrasive particle having a Knoop hardness of from 1.5 to 50 GPa is preferred and having a Knoop hardness of from 2 to 40 GPa is preferred and having a Knoop hardness of from 2 to 30 GPa is even more preferred. A fixed abrasive finishing element having a plurality of abrasive particles having at least two different Knoop hardnesses can be preferred. An abrasive finishing element having abrasive asperities on the finishing element finishing surface is preferred. An abrasive finishing element having abrasive asperities having a height from 0.5 to 0.005 micrometers is preferred and an abrasive finishing element having abrasive asperities having a height from 0.3 to 0.005 micrometers is more preferred and an abrasive finishing element having abrasive asperities having a height from 0.1 to 0.01 micrometers is even more preferred and an abrasive finishing element having abrasive asperities having a height from 0.05 to 0.005 micrometers is more particularly preferred. The asperities are preferably firmly attached to the finishing element finishing surface and asperities which are an integral part of the finishing element finishing surface are more preferred. An abrasive finishing element having small asperities can finish a workpiece surface to fine tolerances.

For finishing of semiconductor wafers having low-k dielectric layers, finishing aids, more preferably lubricating aids, are preferred. Illustrative nonlimiting examples of low-k dielectrics are low-k polymeric materials, low-k porous materials, and low-k foam materials. As used herein, a low-k dielectric has at most a k range of less than 3.5 and more preferably less than 3.0. Illustrative examples include doped oxides, organic polymers, highly fluorinated organic polymers, and porous materials. A high flexural modulus organic synthetic resin comprising an engineering polymer is also preferred. A high flexural modulus organic synthetic resin containing even higher modulus organic synthetic resin particles can also be preferred. An illustrative example of the manufacture of a tough high flexural modulus synthetic resin containing an even higher modulus organic synthetic resin particles is found in U.S. Pat. No. 5,508,338 to Cottis et al. As used herein, even higher flexural modulus organic synthetic resin particles than the continuous region of high flexural modulus organic synthetic resin are referred in this specification as abrasive organic synthetic resin particles. A discrete finishing member having discrete abrasive organic synthetic resin particles is preferred for some low-k dielectric layer finishing. Abrasive organic synthetic resin particles having a flexural modulus of at most 100 times higher than the low-k dielectric layer flexural modulus is preferred and having a flexural modulus of at most 50 times higher than the low-k dielectric layer flexural modulus is more preferred and having a flexural modulus of at most 25 times higher than the low-k dielectric layer flexural modulus is even more preferred. Abrasive organic synthetic resin particles having a flexural modulus of at least equal to the low-k dielectric layer flexural modulus is preferred and having a flexural modulus of at least 2 times higher than the low-k dielectric layer flexural modulus is more preferred. Flexural modulus is believed to be useful for guidance to aid initial screenings. Abrasive synthetic resin particles can help to reduce unwanted surface damage of the low-dielectric layer.

An abrasive discrete finishing member surface having a three dimensional abrasive surface as used herein is a abrasive finishing member surface layer having abrasive particles dispersed throughout at least a portion of its thickness, such that if some of the surface is removed additional abrasive particles are exposed on the newly exposed surface. A finishing member surface having a three dimensional dispersion of abrasive particles is particularly preferred. An abrasive discrete finishing member surface having a plurality of abrasive particles substantially uniformly dispersed throughout at least a portion of its thickness is more preferred. A fixed abrasive discrete finishing member surface having a plurality of bonded abrasive particles uniformly dispersed throughout at least a portion of its thickness is even more preferred. Having a discrete finishing member surface having a three dimensional dispersion of abrasive particles can facilitate renewal of the finishing surface during finishing element conditioning. During finishing workpiece, it is preferred that a discrete finishing member surface having a three dimensional abrasive surface is substantially uniform over the depth the finishing surface is used. Any nonuniform surface formed during manufacture due to the processing and/or forming conditions when manufacturing the discrete finishing members is preferably removed prior to finishing of the workpiece surface. A thin nonuniform layer can be removed by cutting the unwanted nonuniform layer off. A thin nonuniform layer can be removed by abrasive means. A nonuniform skin can be formed by settling due to density differences of the components and/or due to specific shear conditions or surface interactions with a molding or forming surface.

Preferred Option of Having Discrete Finishing Member Surface Having Discrete Synthetic Resin Particles Having Abrasive Particles A discrete finishing member (or other finishing element component) having a multiphase organic polymer composition (such as discrete synthetic resin particles) can be preferred. A multiphase polymeric composition having two distinct and separate glass transition temperatures is preferred. A multiphase polymeric composition having two or more clear polymers, each with different refractive indices which, when blended, turns opaque can be a preferred multiphase polymeric composition. Multiphase polymeric compositions can be very versatile compositions for use in a finishing element having discrete finishing members and a unitary resilient body.

A discrete synthetic resin particle having a three dimensional dispersion of abrasive particles as used herein is a discrete synthetic resin particle having abrasive particles dispersed in the discrete synthetic resin particle, such that if some of the surface is removed additional abrasive particles are exposed on the newly exposed surface. A three dimensional abrasive discrete synthetic resin particle is a preferred means for incorporating abrasive particles in the discrete finishing member. A three dimensional abrasive discrete synthetic resin particle having a plurality of abrasive particles substantially dispersed throughout at least a portion of its volume is more preferred. A three dimensional abrasive discrete synthetic resin particle having a plurality of abrasive particles substantially uniformly dispersed throughout at least a portion of its volume is more preferred. A three dimensional abrasive discrete synthetic resin particle having a plurality of abrasive particles uniformly dispersed throughout at least a portion of its volume is even more preferred. Having a three dimensional abrasive discrete synthetic resin particle can facilitate renewal of the finishing surface during finishing element conditioning.

A discrete finishing member comprising a continuous phase of synthetic resin matrix having discrete synthetic resin particles is a preferred aspect of this invention. Preferably the discrete synthetic resin particles are dispersed in the continuous phase synthetic resin matrix. More preferably the discrete synthetic resin particles are uniformly dispersed in the continuous phase synthetic resin matrix of the discrete finishing member. Discrete synthetic resin particles which are connected to the continuous phase of synthetic resin matrix are preferred and discrete synthetic resin particles which are bound to the continuous phase of synthetic resin matrix are more preferred. The synthetic resin in the discrete synthetic resin particles is preferably different than the synthetic resin in the continuous phase synthetic resin matrix. By having the discrete synthetic resin particles dispersed in the continuous phase synthetic resin matrix, the finishing element has a three dimensional aspect so that new abrasive surfaces can formed using finishing element conditioning discussed herein below. This extends finishing element life and reduces costs. By having the discrete synthetic resin particles connected to the continuous phase of synthetic resin matrix, the chance of these particles breaking away during finishing is reduced or eliminated. Discrete synthetic resin particles which are bonded to the continuous phase synthetic resin matrix through covalent bonding are particularly preferred. Reactive functional groups on the synthetic resin particle surface and reactive functional groups on the synthetic resins of the continuous phase synthetic resin matrix are preferred. Oxygen functional groups are illustrative nonlimiting preferred example of functional groups. Some preferred nonlimiting oxygen functional groups are carboxylic acid, anhydride groups, epoxy groups, and alcohol groups. Free (broken away) discrete synthetic resin particles during finishing have the potential to damage the semiconductor wafer surface during finishing.

The synthetic resin in the discrete synthetic resin particles is preferably different than the synthetic resin in the continuous phase synthetic resin. By having a different synthetic resin in the discrete synthetic resin particles as compared to the continuous phase synthetic resin, finishing aspects such as localized finishing and global finishing can be fine tuned. By having a different synthetic resin in the discrete synthetic resin particles as compared to the continuous phase synthetic resin, finishing aspects such as polishing and planarizing can also be fine tuned. For instance a relatively stiff (higher flexural modulus) continuous phase synthetic resin can be used with a more flexible synthetic resin for the discrete synthetic resin particles. This first customized finishing element would tend to have a more globalized finishing. In contrast, a relatively soft (lower flexural modulus) continuous phase can be used with a harder synthetic resin in the discrete synthetic resin particles. This second customized finishing element would tend to have a higher localized finishing. In customizing the finishing element for specific applications, we currently believe that synthetic resin hardness (as measured in Shore D), flexural modulus, and resilience are preferred properties to adjust. A finishing member finishing surface layer having a synthetic resin with a Shore D hardness in the continuous phase which is different than the shore D hardness of the synthetic resin in the discrete synthetic resin particles is preferred. A discrete finishing member finishing surface layer having a synthetic resin with a flexural modulus in the continuous phase which is different than the flexural modulus of the synthetic resin in the discrete synthetic resin particles is preferred. A finishing member finishing surface layer having a synthetic resin with a resilience in the continuous phase which is different than the resilience of the synthetic resin in the discrete synthetic resin particles is preferred. A discrete finishing member having a continuous phase of polymer "A" and discrete synthetic resin particles comprised of polymer "B" and wherein polymer "B" has a hardness different by at least 3 units when measured in at least one hardness measurement selected from the group consisting of Shore A, Shore D, Rockwell M, and Rockwell R is preferred. A discrete finishing member having a continuous phase of polymer "A" and discrete synthetic resin particles comprised of polymer "B" and wherein polymer "B" has a hardness different by at least 10 units when measured in at least one hardness measurement selected from the group consisting of Shore A, Shore D, Rockwell M, and Rockwell R is preferred. These properties, their relationships, and adjustments thereto can aid those skilled in the art to develop custom finishing element surface layers.

A synthetic resin particle having abrasive particles therein is particularly preferred in this invention. This synthetic resin in the discrete synthetic resin particles forms a binding resin which fixes the abrasive particles therein. An organic synthetic resin is preferred. A preferred example of organic synthetic resin is an thermoplastic resin. Another preferred example of an organic synthetic polymer is a thermoset resin. A thermoset synthetic resin is less prone to elastic flow and thus is more stable in this application. A thermoset polyurethane resin is currently particularly preferred for the discrete synthetic resin particles. The hardness, softness, resilience, and abrasion resistance can be adjusted by chemistry generally known to those skilled in the art. Further, different methods to bind the abrasive particles to the synthetic resin matrix to the abrasive particles are generally known to those skilled in the art. Abrasive particles that are covalently bonded to synthetic resin in the discrete synthetic resin particles are particularly preferred. As used herein, covalently bonded to the synthetic resin means that the abrasive particles are either bonded covalently directly to the synthetic resin or bonded covalently through at least one additional molecule to the synthetic resin. A synthetic resin of the discrete synthetic resin particles selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers is preferred. Polyolefin polymers are particularly preferred for their generally low cost. A preferred polyolefin polymer is polyethylene. Another preferred polyolefin polymer is a propylene polymer. Elastomers are particularly preferred. High density polyethylene and ultra high molecular weight polyethylene are preferred ingredients in the continuous phase synthetic resin matrix because they are low cost, thermoplastically processible and have a low coefficient of friction. Another preferred polyolefin polymer is a ethylene propylene copolymer. Copolymer organic synthetic polymers are also preferred. Polyurethanes are preferred for the inherent flexibility in formulations. A synthetic resin in the synthetic resin particle comprising a foamed synthetic resin matrix is can be preferred for some final finishing because of its flexibility and general resilience. A foamed polyurethane polymer is particularly preferred. A foamed polyurethane has desirable abrasion resistance combined with good costs. Foaming agents and processes to foam organic synthetic polymers are generally known in the art. A finishing element comprising a compressible porous material is preferred and comprising a organic synthetic resin of a compressible porous material is more preferred. A cross-linked synthetic resin particle is preferred.

A synthetic resin in the synthetic resin particle having a Shore A hardness of at least 30 A is preferred. A soft synthetic resin is particularly useful for localized finishing. A porous finishing element is preferred to more effectively transfer the polishing slurry to the surface of the workpiece being finished.

Discrete synthetic resin particles having abrasive particles dispersed therein can be made by generally known procedures to those skilled in the abrasive arts. For example, an abrasive slurry can be formed by mixing thoroughly 10 parts of trimethanolpropane triacrylate, 30 parts of hexanediol diacrylate, 60 of parts alkl benzyl phthalate plasticizer, 6.6 parts of isopropyl triisostearoly titanate, 93.2 parts of 2,4, 6-trimethylbenzoyl-diphenyl-phosphine oxide photoiniatator and then mixing in 170 parts of cerium oxide followed by mixing in a further 90 parts of calcium carbonate and then curing in a thin sheets. The cured sheets are then ground into discrete synthetic resin particles having abrasive particles therein. As a second and currently preferred example, to a monomer phase of a synthetic resin having a reactive functional group(s)is added a second linking monomer which in turn has a both a linking functional group and a particulate bonding group. The linking functional group is selected to covalently bond to the synthetic resin reactive functional group. The abrasive particle bonding group is selected to covalently bond with the abrasive particles such as silica. An example of a linking monomer is alkyl group with from 8–20 carbon atoms and having a carboxylic linking functional group and a trichlorosilane abrasive particle bonding group. Additional preferred, non limiting examples of useful bonding groups include carboxylic acid groups, epoxy groups, and anhydride groups. Additional nonlimiting information on the formation of synthetic resin matrices having abrasive particles dispersed and/or bound therein include U.S. Pat. No. 5,624,303 to Robinson, U.S. Pat. No. 5,692,950 to Rutherford et. al., and U.S. Pat. No. 5,823,855 to Robinson et. al. and are included herein by reference in their entirety for guidance and modification as appropriate by those skilled in the art. Synthetic matrices having dispersed abrasive particles can be formed into discrete synthetic resin particles having dispersed abrasive particles by using grinding technology generally known to those skilled in the art. Cold grinding is sometimes helpful. Cryogenic grinding can also be useful. Methods to sort by size are generally known and preferable. Further, the discrete synthetic resin particles are preferably cleaned before use. Washing using generally known solvents and/or reagents can also be useful.

The abrasive particles can be melt mixed with thermoplastic organic synthetic resins. Preferably mixing with melt shearing conditions. The abrasive particles can be mixed in the high flexural modulus organic synthetic resin. The abrasive particles can be mixed in the soft synthetic resin then the soft synthetic resin having abrasive particles mixed therein can then be mixed with the high flexural modulus organic synthetic resin matrix. The mixed organic synthetic resin composition having abrasive particles can then be formed into discrete finishing members. Molding a preferred method of forming the discrete finishing members. Injection molding is a more preferred method of forming the discrete finishing members. General mixing and molding guidance is given elsewhere herein.

A preferred example of an organic synthetic polymer modifier is a material which reduces the hardness or flexural modulus of the finishing element body such an polymeric elastomer. A compatibilizing agent can be used to improve the physical properties of the polymeric mixture. Compatibilizing agents are often also synthetic polymers and can have polar and/or reactive functional groups such as hydroxyl groups, carboxylic acid, maleic anhydride, and epoxy groups. Compatibilizing agents having a chemically reactive functional group are preferred. Compatibilizing agents having a chemically reactive functional group containing oxygen are preferred for many polymer compositions. Compatibilizing agents having a chemically reactive functional group containing nitrogen are preferred for many polymer compositions. An amine functional group is an example of a preferred reactive functional group containing nitrogen. The commercial suppliers of compatibilizing agents can generally recommend preferred compatibilizing agents for particular polymeric compositions. A compatibilizing agent which increases the dispersion of the soft synthetic resin in the stiff organic synthetic resin is preferred. A compatibilizing agent can improve the toughness of the resin.

Interface Between the Discrete Synthetic Resin Particles and Continuous Phase of Synthetic Resin Fixedly attaching the discrete synthetic resin particles to the continuous phase of synthetic resin is a preferred method of connecting the two phases. Bonding is a preferred means of fixed attachment. A discrete synthetic resin particle which is fixedly attached to the continuous phase of synthetic resin and which, when it is physically separated from the continuous phase results in cohesive failure, is preferred. A discrete synthetic resin particle which is fixedly attached to the continuous phase of synthetic resin and which, when physically separated, results in a separation which is free of adhesive failure, is particularly preferred. Preferred means for fixedly attaching the discrete synthetic resin particle to the continuous phase of synthetic resin include the formation of chemical bonds and more preferably covalent chemical bonds. Another preferred means for fixedly attaching the discrete synthetic resin particle to the continuous phase of synthetic resin includes the polymer chain interdiffusion. A combination of polymer chain interdiffusion bonding and covalent chemical bonds is particularly preferred.

A compatibilizing agent can be used to bond the discrete synthetic resin particles to the continuous phase of synthetic resin. A compatibilizing polymer is a preferred compatibilizing agent. A compatibilizing polymer having a number average molecular weight of at least 5,000 is preferred and of at least 10,000 is more preferred and of at least 20,000 is even more preferred. A compatibilizing polymer wherein the polymer which includes chemically distinct sections, some of which are miscible with one component and some of which are miscible with a second component in a multiphase polymer mixture, is preferred. A compatibilizing polymer "C" which includes chemically distinct sections some of which are miscible with one polymer "A" and some of which are reactive with a second polymer "B" in a multiphase polymer mixture is more preferred. A compatibilizing polymer which chemically reacts with at least one of the immiscible polymers "A" or "B" can be preferred. Diblock copolymers and graft copolymers are examples of preferred types of polymeric compatibilizers. Compatibilizing polymers comprising synthetic polymers and having polar and/or reactive functional groups such as hydroxyl groups, carboxylic acid, maleic anhydride, and epoxy groups are preferred. A compatibilizing polymer having a section which has a higher molecular weight than the molecular weight of the immiscible polymers can be preferred. A graft copolymer is a particularly preferred compatibilizing polymer because it can be made by techniques generally known in the polymer arts at high volume, and low cost having electronic purity and many different reactive and/or miscible ends. A polymeric compatibilizing agent having a chemically reactive oxygen functional group is preferred for many polymeric systems. Hydroxyl groups, epoxy groups, carboxylic acid groups and anhydride groups are examples of preferred chemically reactive oxygen functional groups. A polymeric compatibilizing agent having a chemically reactive nitrogen functional group is preferred for many polymeric systems.

A compatibilizing agent which increases the dispersion of a synthetic resin "B" in a synthetic resin "A" is preferred. A compatibilizing agent which increases the dispersion of synthetic resin "B" particles in a continuous phase of synthetic resin "A" is more preferred. A compatibilizing agent can improve the toughness of this synthetic resin mixture. One measure of toughness is by the Notched Izod Impact test 23 degrees centigrade (ASTM D256). Another indicator of toughness is the Fatigue Endurance as measured by ASTM D671. A compatibilizing agent which forms a polymeric mixture with higher Tensile Strength as measured by ASTM D 638 than that of the same polymeric mixture in the absence of the compatibilizing agent is preferred. A compatibilizing agent which forms a polymeric mixture with higher Ultimate Tensile Strength as measured by ASTM D 638 than that of the same polymeric mixture in the absence of the compatibilizing agent is preferred. A compatibilizing agent which forms a polymeric mixture with higher Ultimate Elongation as measured by ASTM D 638 than that of the same polymeric mixture in the absence of the compatibilizing agent is preferred. A compatibilizing agent which forms a polymeric mixture with higher toughness to that of the same polymeric mixture in the absence of the compatibilizing agent is preferred. A compatibilizing agent which forms a polymeric mixture with higher Fatigue Endurance as measured by ASTM D 671 than that of the same polymeric mixture in the absence of the compatibilizing agent is preferred. A compatibilizing agent improving a plurality of these properties is especially preferred. Finishing elements having these improved physical properties can improve finishing.

A finishing element surface having discrete synthetic resin particles fixedly attached to the continuous phase of synthetic resin for finishing at least 50 workpiece surfaces is preferred and one for finishing at least 100 workpiece surfaces is more preferred and one for finishing at least 300 workpiece surfaces is even more preferred. The maximum number of workpiece surfaces which can be finished using this technology is expected to be very large. By finishing more workpieces with the same finishing element surface having discrete synthetic resin particles fixedly attached to the continuous phase of synthetic resin for finishing the cost to manufacture semiconductor wafers is reduced and the unwanted surface damage can be reduced.

Stabilizing Fillers

A fibrous filler is a preferred stabilizing filler for the synthetic resins of this invention. A fibrous filler is particularly preferred additive to the synthetic resin of the continuous phase synthetic resin matrix in the finishing element surface and also in the synthetic resin of the subsurface layer. A plurality of synthetic fibers are particularly preferred fibrous filler. Fibrous fillers tend to help generate a lower abrasion coefficient and/or stabilize the finishing member finishing surface from excessive wear. By reducing wear the finishing element has improved stability during finishing.

A preferred stabilizing filler is a dispersion of fibrous filler material dispersed in the finishing element body. An organic synthetic resin fibers are a preferred fibrous filler. Preferred fibrous fillers include fibers selected from the group consisting of aramid fibers, polyester fibers, and polyamide fibers. Preferably the fibers have a fiber diameter of from 1 to 15 microns and more preferably, from 1 to 8 microns. Preferably the fibers have a length of less than 1 cm and more preferably a length from 0.1 to 0.6 cm and even more preferably a length from 0.1 to 0.3 cm. Particularly preferred are short organic synthetic resin fibers that can be dispersed in the discrete finishing member and more preferably mechanically dispersed in at least a portion of the discrete finishing member and more preferably, substantially uniformly dispersed in at least a portion of the discrete finishing member proximate the finishing member finishing surface and even more preferably uniformly dispersed in at least a portion of the discrete finishing member proximate the discrete finishing member finishing surface. The short organic synthetic fibers are added in the form of short fibers substantially free of entanglement and dispersed in the discrete finishing member matrix. Preferably, the short organic synthetic fibers comprise fibers of at most 0.6 cm long and more preferably 0.3 cm long. An aromatic polyamide fiber is particularly preferred. Aromatic polyamide fibers are available under the tradenames of "Kevlar" from DuPont in Wilmington, Del. and "Teijin Cornex" from Teijin Co. Ltd. The organic synthetic resin fibers can be dispersed in the synthetic by methods generally known to those skilled in the art. As a nonlimiting example, the cut fibers can be dispersed in a thermoplastic discrete synthetic resin particles of under 20 mesh, dried, and then compounded in a twin screw, counter rotating extruder to form extruded pellets having a size of from 0.2–0.3 cm. Optionally, the pellets can be water cooled, as appropriate. These newly formed thermoplastic pellets having substantially uniform discrete, dispersed, and unconnected fibers can be used to extruded or injection mold a fixed abrasive discrete finishing member of this invention. Aramid powder can also be used to stabilize the finishing member to wear. Organic synthetic resin fibers are preferred because they tend to reduce unwanted scratching to the workpiece surface.

U.S. Pat. No. 4,877,813 to Jimmo, U.S. Pat. No. 5,079,289 to Takeshi et al., and U.S. Pat. No. 5,523,352 to Janssen are included herein by reference in its entirety for general guidance and appropriate modification by those skilled in the art.

Optional Third Layer Member of the Finishing Element

The optional third layer member is often preferred to increase strength. A third layer member comprising a reinforcing film is preferred. A third layer member comprising a reinforcing woven matrix is preferred. A third layer member comprising a reinforcing fiberous matrix can also be preferred. A third layer member comprising a synthetic organic resin is preferred. Where increased resilience is preferred an elastomer is often preferred. Some particularly preferred elastomers include synthetic resins selected from the group consisting of polyurethanes, acrylics, acrylates, polyamides, polyesters, chloroprene rubbers, ethylene propylene polymers, butyl polymers, polybutadienes, polyisoprenes, EPDM elastomers, and styrene butadiene elastomers. Where increased strength is preferred, synthetic resin selected specifically for strength can be preferred. Thermoplastic resins are a preferred strength component in a third layer and comprise a preferred type of synthetic resin. Nylons are a preferred organic synthetic resin. Nylons are tough, relatively stiff, abrasion resistant and cost effective. Polyesters are a preferred organic synthetic resin. Polyesters are tough, relatively stiff and cost effective. Liquid crystal polymers are a preferred organic synthetic resin. Liquid crystal polymers can be particularly stiff and can be abrasion resistant. Liquid crystal polymers also have generally low stretch. Polyolefins are a preferred organic synthetic resin. An organic synthetic resin selected from the group consisting of polyamides, polyesters, polystyrenes, polycarbonates, polyimides are examples of preferred organic synthetic resins. Polymer blends of organic synthetic resins are also preferred because they can be particularly tough and abrasion resistant. Polyolefin polymers are particularly preferred for their generally low cost. A preferred polyolefin polymer is polyethylene. These types of third layer members can improve the performance of the finishing element.

The optional third layer member can also modify and/refine the movement of the discrete finishing member. When increased flexibility is in the motions represented by Reference Numeral 460 and 470 of FIGS. 4*b* and 4*c*, a third layer member having a shore hardness of less than the Shore hardness of the unitary resilient body is preferred and a third layer member having a Flexural modulus of less than the flexural modulus of the unitary resilient body is also preferred. When decreased flexibility is desired in the motions represented by Reference Numeral 460 and 470 of FIGS. 4*b* and 4*c*, a third layer member having a Shore hardness of greater than the Shore hardness of the unitary resilient body is preferred and a third layer member having a Flexural modulus of greater than the flexural modulus of the unitary resilient body is also preferred. Illustrative preferred organic polymers and polymer systems are described herein above such as under the unitary resilient body and in the discrete finishing member sections.

Further Comments On Finishing Elements of This Invention

Manufacture of resilient foamed composite articles are known. Foamed laminates and their production are generally known to those in the foam arts. Multicomponent shaped foamed articles are generally known in the foam arts. Generally blowing agents are used to produce foams. Melting the foamed material which is later removed after solidification can also produce foamed products. Foams often have at least some cross-linking. Foams can be open celled or closed celled foams. Chemical bonding with composite shapes such as laminates is generally known in the foamed arts. Molding composite foamed shapes are also known in the foamed arts. Illustrative nonlimiting examples of some general foam technology in the art include U.S. Pat. No. 3,924,362 to McAleer, U.S. Pat. No. 3,989,869 to Neumaier et al., U.S. Pat. No. 4,674,204 to Sullivan et. al., U.S. Pat. No. 4,810,570 to Rutten et. al., U.S. Pat. No. 4,997,707 to Otawa et al., U.S. Pat. No. 5,053,438 to Kozma, U.S. Pat. No. 5,254,641 to Alex et al., U.S. Pat. No. 5,397,611 to Wong, U.S. Pat. No. 5,581,187 to Sullivan et al., U.S. Pat. No. 5,786,406 to Uejyukkoku et al., and U.S. Pat. No. 5,847,012 to Shalaby et. al. and are included herein in their entirety for general foam and foam composite guidance and for modification by those skilled in the art. As only one nonlimiting example, the discrete finishing members can be positioned on a release film on the inside and then a foam laminate can be formed using known foam laminate technology. When the laminate is formed and the release sheet is removed, the discrete finishing members will be foamed in place in recess. Bonding agents can enhance the fixed attachment of the discrete finishing members to the foam.

Alternately, a suitable unitary resilient body can be purchased as a fiber reinforced foam sheet from Fruendenberg and suitable abrasive finishing members can be bonded thereto. Also alternately, a first resilient sheet can have a plurality of recesses cut therein and then the first resilient sheet is bonded to a second resilient sheet free of recesses and following abrasive discrete finishing members can then be bonded into the plurality of recesses cut therein. A water proof PSA or other suitable adhesive can be used. A suitable fiber reinforced foam sheet having about a Shore A hardness of 60 is available from Fruendenberg.

Shown in FIG. 1 is one embodiment of discrete finishing members fixedly attached to a unitary resilient body. The discrete finishing members can be arranged in a random fashion, a semi-random fashion, or a repeating fashion. For instance, the discrete finishing members can be arranged on radial lines emanating from the center of the finishing element shown. The discrete finishing members can be arranged on different radius circles from the center of the finishing element shown. A finishing element having a plurality of different discrete finishing members can be preferred for some applications. For instance, different sizes or shapes of discrete finishing members can be used on the same finishing element. Alternately, discrete finishing members having different flexural modulus can be used on the same finishing element. Each of these changes will affect the cooperative motion between the elements and can be used to improve finishing performance on different semiconductor wafers. This versatility in the unitary finishing elements of this invention are unique and are part of the problem recognition and solution of this invention.

Another preferred arrangement is shown in FIG. 8 wherein the discrete finishing members (Reference Numeral 140 are fixedly attached to a unitary resilient body (Reference Numeral 130) in the finishing element (Reference Numeral 120). Preferably the discrete finishing members are arranged in a manner to finish the workpiece surface being finished at a uniform rate across the macro workpiece surface. In other words, a discrete finishing members arranged in pattern and size in the finishing element in a manner to cause a substantially a uniform finishing rate across the macro operative finishing interface is preferred and a discrete finishing members arranged in pattern and size in the finishing element in a manner to cause a uniform finishing rate across the macro operative finishing interface is more preferred. Macro uniform finishing rates can help improve quality and reduce costs. The versatility of the unitary finishing elements of this invention are unique and are part of the problem recognition and solution of this invention.

A preferred method of forming the unitary resilient body is molding. A preferred method of forming the discrete finishing member is molding. Molding can be done cost effectively and to high tolerances. Injection molding is a preferred form of molding. Reaction injection molding (RIM) is a preferred form of molding. Thermoset resins can be rapidly made to high tolerances parts with RIM. Co-molding is a preferred form of molding. Co-injection molding is a preferred form of molding and co-molding. With co-injection molding, multiple organic synthetic resins can be molded into composite structures and thus the discrete finishing member and the unitary resilient body can be formed in one cycle. Close tolerances, rapid composite part formation, and low costs can be realized with co-injection molding. RIM is generally well known to those skilled in plastics processing. Co-injection molding is also generally known. Co-injection molding can be effected from a plurality of resins by blocking of injection channels with pairs of abutting plates and separating the plates to unblock a channel or channels to permit sequentially injecting different resins. General guidance for co-injection molding can be found in U.S. Pat. No. 4,275,030 to Mares, U.S. Pat. No. 5,651,998 to Bertschi et al., and U.S. Pat. No. 5,814,252 to Gouldson et al. and these patents are included in their entirety for general guidance and modification by those skilled in the molding arts. Both RIM and co-injection molding can facilitate fixedly connecting the unitary resilient body to discrete finishing member by using either chemical and/or thermal energy during the forming process. Fixedly connecting the unitary resilient body to discrete finishing member with energy selected from the group consisting of thermal and chemical energy is preferred. Supplying a first organic synthetic resin composition to a mold and then supplying a second organic synthetic resin composition to the mold in the same molding cycle is preferred in a co-injection molding process. Supplying a first organic synthetic resin composition to a mold and then supplying a second organic synthetic resin composition to the mold in the same molding cycle forming an attachment between the first and second organic resin composition is more preferred in a co-injection molding process. Supplying a first organic synthetic resin composition to a mold and then supplying a second organic synthetic resin composition to the mold in the same molding cycle forming a bond between the first and second organic resin composition is even more preferred in a co-injection molding process. Supplying a first organic synthetic resin composition to a mold and then supplying a second organic synthetic resin composition to the mold in the same molding cycle forming a physical bond between the first and second organic resin composition is even more preferred in a co-injection molding process. Supplying a first organic synthetic resin composition to a mold and then supplying a second organic synthetic resin composition to the mold in the same molding cycle forming a chemical bond between the first and second organic resin composition is even more preferred in a co-injection molding process. Co-injection molding can make high precision finishing elements of this invention rapidly and at reduced cost.

Finishing Aid

Supplying an effective amount of finishing aid, more preferably a lubricating aid, which reduces the coefficient of friction between the finishing element finishing surface and the workpiece surface being finished is preferred. Supplying an effective amount of finishing aid, more preferably a lubricating aid, which reduces the unwanted surface damage to the surface of the workpiece being finished during finishing is preferred. Supplying an effective amount of finishing aid, more preferably a lubricating aid, which differentially lubricates different regions of the workpiece and reduces the unwanted surface damage to at least a portion of the surface of the workpiece being finished during finishing is preferred.

The finishing aid, more preferably a lubricating aid, can help reduce the formation of surface defects for high precision part finishing. Fluid based finishing aid, more preferably a lubricating aid, can be incorporated in the finishing element finishing surface. A method of finishing which adds an effective amount of fluid based finishing aid, more preferably a lubricating aid, to the interface between the finishing element finishing surface and workpiece surface being finished is preferred. A preferred effective amount of fluid based finishing aid, more preferably a lubricating aid, reduces the occurrence of unwanted surface defects. A preferred effective amount of fluid based finishing aid, more preferably a lubricating aid, reduces the coefficient of friction between the work piece surface being finished and the finishing element finishing surface.

A lubricating aid which is water soluble is preferred for many applications. An organic boundary layer lubricant which comprises a water soluble organic boundary layer lubricant is preferred and which consists essentially of a water soluble organic boundary layer lubricant is more preferred and which consists of a water soluble organic boundary layer lubricant is even more preferred. A lubricating aid which has a different solubility in water at different temperatures is more preferred. A degradable finishing aid, more preferably a lubricating aid, is also preferred and a biodegradable finishing aid, more preferably a lubricating aid, is even more preferred. An environmentally friendly finishing aid, more preferably a lubricating aid, is particularly preferred.

Certain particularly important workpieces in the semiconductor industry have regions of high conductivity and regions of low conductivity. The higher conductivity regions are often comprised of metallic materials such as tungsten, copper, aluminum, and the like. An illustrative example of a common lower conductivity region is silicon or silicon oxide. A lubricant which differentially lubricates the two regions is preferred and a lubricant which substantially lubricates two regions is more preferred. An example of a differential lubricant is if the coefficient of friction is changed by different amounts in one region versus the other region during finishing. For instance one region can have the coefficient of friction reduced by 20% and the other region reduced by 40%. This differential change in lubrication can be used to help in differential finishing of the two regions. An example of differential finishing is a differential finishing rate between the two regions. For example, a first region can have a finishing rate of "X" angstroms/minute and a second region can have a finishing rate of "Y" angstroms per minute before lubrication and after differential lubrication, the first region can have a finishing rate of 80% of "X" and the second region can have a finishing rate of 60% of "Y". An example of where this will occur is when the lubricant tends to adhere to one region because of physical or chemical surface interactions (such as a metallic conductive region) and adhere or not adhere as tightly to the an other region (such as a non metallic, non conductive region). Changing the finishing control parameters to change the differential lubrication during finishing of the workpiece is a preferred method of finishing. Changing the finishing control parameters to change the differential lubrication during finishing of the workpiece which in turn changes the regional finishing rates in the workpiece is a more preferred method of finishing. Changing the finishing control parameters with in situ process control to change the differential lubrication during finishing of the workpiece which in turn changes the region finishing rates in the workpiece is an even more preferred method of finishing. The friction sensor probes play an important role in detecting and controlling differential lubrication in the workpieces having heterogeneous surface compositions needing finishing.

A lubricant comprising a reactive lubricant is preferred. A lubricant comprising a boundary lubricant is also preferred. A reactive lubricant is a lubricant which chemically reacts with the workpiece surface being finished. A lubricant free of sodium is a preferred lubricant. As used herein a lubricant free of sodium means that the sodium content is below the threshold value of sodium which will adversely impact the performance of a semiconductor wafer or semiconductor parts made therefrom. A boundary layer lubricant is a preferred example of a lubricant which can form a lubricating film on the surface of the workpiece surface. As used herein a boundary lubricant is a thin layer on one or more surfaces which prevents or at least limits, the formation of strong adhesive forces between the workpiece being finished and the finishing element finishing surface and therefore limiting potentially damaging friction junctions between the workpiece surface being finished and the finishing element finishing surface. A boundary layer film has a comparatively low shear strength in tangential loading which reduces the tangential force of friction between the workpiece being finished and the finishing element finishing surface which can reduce surface damage to the workpiece being finished. In other words, boundary lubrication is a lubrication in which friction between two surfaces in relative motion, such as the workpiece surface being finished and the finishing element finishing surface, is determined by the properties of the surfaces, and by the properties of the lubricant other than the viscosity. A boundary film generally forms a thin film, perhaps even several molecules thick, and the boundary film formation depends on the physical and chemical interactions with the surface. A boundary lubricant which forms of thin film is preferred. A boundary lubricant forming a film having a thickness from 1 to 10 molecules thick is preferred and a boundary lubricant forming a film having a thickness from 1 to 6 molecules thick is more preferred and a boundary lubricant forming a film having a thickness from 1 to 4 molecules thick is even more preferred. A boundary lubricant forming a film having a thickness from 1 to 10 molecules thick on at least a portion of the workpiece surface being finished is particularly preferred and a boundary lubricant forming a film having a thickness from 1 to 6 molecules thick on at least a portion of the workpiece surface being finished is more particularly preferred and a boundary lubricant forming a film having a thickness from 1 to 4 molecules thick on at least a portion of the workpiece surface being finished is even more particularly preferred. A boundary lubricant forming a film having a thickness of at most 10 molecules thick on at least a portion of the workpiece surface being finished is preferred and a boundary lubricant forming a film having a thickness of at most 6 molecules thick on at least a portion of the workpiece surface being finished is more preferred and a boundary lubricant forming a film having a thickness of at most 4 molecules thick on at least a portion of the workpiece surface being finished is even more preferred and a boundary lubricant forming a film having a thickness of at most 2 molecules thick on at least a portion of the workpiece surface being finished is even more preferred. An operative motion which continues in a substantially uniform direction can improve boundary layer formation and lubrication. Friction sensor subsystems and finishing sensor subsystems having the ability to control the friction probe motions and workpiece motions are preferred and uniquely able to improve finishing in many real time lubrication changes to the operative finishing interface. Boundary layer lubricants, because of the small amount of required lubricant, can be effective lubricants for use in the operative finishing interface.

An organic boundary layer lubricant is a preferred lubricant. A boundary layer lubricant which forms a thin lubricant film on the metal conductor portion of a workpiece surface being finished is particularly preferred. A nonlimiting preferred group of example organic boundary layer lubricants include at least one lubricant selected from the group consisting of fats, fatty acids, esters, and soaps. A phosphorous containing compound can be an effective preferred boundary lubricant. A phosphate ester is an example of a preferred phosphorous containing compound which can be an effective boundary lubricant. A chlorine containing compound can be an effective preferred boundary lubricant. A sulfur containing compound can be an effective preferred boundary lubricant. A nitrogen containing compound can be an effective preferred boundary lubricant. An amine derivative of a polyglycol can be a preferred boundary lubricant. A diglycol amine is a preferred amine derivative of a polyglycol. A compound containing atoms selected from the group consisting of at least one of the following elements oxygen, fluorine, nitrogen, or chlorine can be a preferred lubricant. A compound containing atoms selected from the group consisting of at least two of the following elements oxygen, fluorine, nitrogen, or chlorine can be a more preferred lubricant. A synthetic organic polymer containing atoms selected from the group consisting of at least one of the following elements oxygen, fluorine, nitrogen, or chlorine can be a preferred an organic boundary layer lubricant. A synthetic organic polymer containing atoms selected from the group consisting of at least two of the following elements oxygen, fluorine, nitrogen, or chlorine can be a more preferred an effective organic boundary layer lubricant. A synthetic organic polymer containing atoms selected from the group consisting of at least two of the following elements oxygen, fluorine, nitrogen, or chlorine can be a preferred organic boundary layer lubricant. A sulfated vegetable oil and sulfurized fatty acid soaps are preferred examples of a sulfur containing compound can be preferred organic boundary layer lubricants. Organic boundary layer lubricant and lubricant chemistries are discussed further herein below. A lubricant which reacts physically with at least a portion of the workpiece surface being finished is a preferred lubricant. A lubricant which reacts chemically with at least a portion of the workpiece surface being finished is often a more preferred lubricant because it is often a more effective lubricant and can also aid at times directly in the finishing. A lubricant which reacts chemically with at least a portion of the workpiece surface being finished and which is non-staining is a particularly preferred lubricant because it is often a more effective lubricant, is generally easily cleaned from the workpiece, and can also aid directly in the finishing as discussed herein.

Limited zone lubrication between the workpiece being finished and the finishing element finishing surface is preferred. As used herein, limited zone lubricating is lubricating to reduce friction between two surfaces while simultaneously having wear occur. Limited zone lubricating which simultaneously reduces friction between the operative finishing interface while maintaining a cut rate on the workpiece surface being finished is preferred. Limited zone lubricating which simultaneously reduces friction between the operative finishing interface while maintaining an acceptable cut rate on the workpiece surface being finished is more preferred. Limited zone lubricating which simultaneously reduces friction between the operative finishing interface while maintaining a finishing rate on the workpiece surface being finished is preferred. Limited zone lubricating which simultaneously reduces friction between the operative finishing interface while maintaining an acceptable finishing rate on the workpiece surface being finished is more preferred. Limited zone lubricating which simultaneously reduces friction between the operative finishing interface while maintaining a planarizing rate on the workpiece surface being finished is preferred. Limited zone lubricating which simultaneously reduces friction between the operative finishing interface while maintaining an acceptable planarizing rate on the workpiece surface being finished is more preferred. Limited zone lubricating which simultaneously reduces friction between the operative finishing interface while maintaining a polishing rate on the workpiece surface being finished is preferred. Limited zone lubricating which simultaneously reduces friction between the operative finishing interface while maintaining an acceptable polishing rate on the workpiece surface being finished is preferred. Lubricant types and concentrations are preferably controlled during limited zone lubricating. Limited zone lubricating offers the advantages of controlled wear along with reduced unwanted surface damage. In addition, since limited zone lubrication often involves thin layers of lubricant, often less lubricant can be used to finish a workpiece.

Lubricants which are polymeric can be very effective lubricants. Supplying a lubricant to the interface of the workpiece surface being finished and the finishing element finishing surface wherein the lubricant is from 0.1 to 15% by weight of the total fluid between the interface is preferred and from 0.2 to 12% by weight of the total fluid between the interface is more preferred and from 0.3 to 12% by weight of the total fluid between the interface is even more preferred and from 0.3 to 9% by weight of the total fluid between the interface is even more particularly preferred. These preferred ranges are given for general guidance and help to those skilled in the art. Lubricants outside this range are currently believed to be useful but not as economical to use.

A lubricant having functional groups containing elements selected from the group consisting of chlorine, sulfur, and phosphorous is preferred and a boundary lubricant having functional groups containing elements selected from the group consisting of chlorine, sulfur, and phosphorous is more preferred. A lubricant comprising a fatty acid substance is a preferred lubricant. A preferred example of a fatty substance is a fatty acid ester or salt. Fatty acid salts of plant origin can be particularly preferred. A lubricant comprising a synthetic polymer is preferred and a lubricant comprising a boundary lubricant synthetic polymer is more preferred and a lubricant comprising a boundary lubricant synthetic polymer and wherein the synthetic polymer is water soluble is even more preferred. A lubricating polymer having a number average molecular weight from 400 to 150,000 is preferred and one having a number average molecular weight from 1,000 to 100,000 is more preferred and one having a number average molecular weight from 1,000 to 50,000 is even more preferred.

A lubricant comprising a polyalkylene glycol polymer is a preferred composition. A polymer of polyoxyalkylene glycol monoacrylate or polyoxyalkylene glycol monomethacrylate is very useful as a base of lubricant. A polyethylene glycol having a molecular weight of 400 to 1000 is preferred. Polyglycols selected from the group polymers consisting of ethylene oxide, propylene oxide, and butylene oxide and mixtures thereof are particularly preferred. A fatty acid ester can be an effective lubricant.

A finishing aid, preferably a lubricating aid, can be contained in the finishing element finishing surface and then supplied to the interface between the workpiece being finished and the finishing element finishing surface by the operative finishing motion. The interface between the workpiece being finished and the finishing element finishing surface is often referred to herein as the operative finishing interface. Alternately, the finishing aid can be delivered in the finishing composition, preferably in a fluid, and more preferably in an aqueous finishing composition. Both techniques have advantages in different finishing situations. When the finishing aid is contained in the finishing element surface the need for finishing aids in the finishing composition is reduced or eliminated. Supplying finishing aids in a fluid finishing composition generally offers improved control of lubrication at the operative finishing interface. Both the concentration and the feed rate of the finishing aid can be controlled. If the finishing aids are supplied in a first finishing composition free of abrasives and abrasives are supplied in a second finishing composition, then the finishing aids, preferably lubricating aids, can be controlled separately and independently from any supplied abrasive. If the finishing aids are supplied in a first finishing composition free of abrasives and abrasives are supplied in the finishing element finishing surface, then the finishing aids, preferably lubricating aids, can be again controlled separately and independently from any supplied abrasive. Supplying lubricating aid separately and independently of the abrasive to the operative finishing interface is preferred because this improves finishing control.

A lubricating aid which can be included in the finishing element can be preferred and an organic boundary layer lubricant which can be included in the finishing element is more preferred. A lubricating aid distributed in at least a portion of the finishing element proximate to the finishing element finishing surface is preferred and a lubricating aid distributed substantially uniformly in at least a portion of the finishing element proximate to the finishing element finishing surface is more preferred and a lubricating aid distributed uniformly in at least a portion of the finishing element proximate to the finishing element finishing surface is even more preferred. A lubricating aid selected from the group consisting of liquid and solid lubricants and mixtures thereof is a preferred finishing aid.

A combination of a liquid lubricant and ethylene vinyl acetate, particularly ethylene vinyl acetate with 15 to 50% vinyl acetate by weight, can be a preferred effective lubricating aid additive. Preferred liquid lubricants include paraffin of the type which are solid at normal room temperature and which become liquid during the production of the finishing element. Typical examples of desirable liquid lubricants include paraffin, naphthene, and aromatic type oils, e.g. mono- and polyalcohol esters of organic and inorganic acids such as monobasic fatty acids, dibasic fatty acids, phthalic acid and phosphoric acid.

The lubricating aid can be contained in finishing element body in different preferred forms. A lubricating aid dispersed in an organic synthetic polymer is preferred. A lubricating aid dispersed in a minor amount of an organic synthetic polymer which is itself dispersed in the primary organic synthetic polymeric resin in discrete, unconnected regions is more preferred. As an illustrative example, a lubricant dispersed in a minor amount of an ethylene vinyl acetate and wherein the ethylene vinyl acetate is dispersed in discrete, unconnected regions in a polyacetal resin. A lubricating aid dispersed in discrete, unconnected regions in an organic synthetic polymer is preferred.

A polyglycol is an example of a preferred finishing aid. Preferred polyglycols include glycols selected from the group consisting of polyethylene glycol, an ethylene oxide-propylene butyl ethers, a diethylene glycol butyl ethers, ethylene oxide-propylene oxide polyglycol, a propylene glycol butyl ether, and polyol esters. A mixture of polyglycols is a preferred finishing aid. Alkoxy ethers of polyalkyl glycols are preferred finishing aids. An ultra high molecular weight polyethylene, particularly in particulate form, is an example of preferred finishing aid. A fluorocarbon resin is an example of a preferred lubricating agent. Fluorocarbons selected from the group consisting of polytetrafluoroethylene (PTFE), ethylene tetrafluoride/propylene hexafluoride copolymer resin (FEP), an ethylene tetrafluoride/perfluoroalkoxyethylene copolymer resin (PFA), an ethylene tetra fluoride/ethylene copolymer resin, a trifluorochloroethylene copolymer resin (PCTFE), and a vinylidene fluoride resin are examples of preferred fluorocarbon resin finishing aids. A polyphenylene sulfide polymer is a preferred polymeric lubricating aid. Polytetrafluoroethylene is a preferred finishing aid. Polytetrafluoroethylene in particulate form is a more preferred finishing aid and polytetrafluoroethylene in particulate form which resists reaggolmeration is a even more preferred finishing aid. A silicone oil is a preferred finishing aid. A polypropylene is a preferred finishing aid, particularly when blended with polyamide and more preferably a nylon 66. A lubricating oil is a preferred finishing aid. A polyolefin polymer can be a preferred effective lubricating aid, particularly when incorporated into polyamide resins and elastomers. A high density polyethylene polymer is a preferred polyolefin resin. A polyolefin/polytetrafluoroethylene blend is also a preferred lubricating aid. Low density polyethylene can be a preferred lubricating aid. A fatty acid substance can be a preferred lubricating aid. An examples of a preferred fatty acid substance is a fatty ester derived from a fatty acid and a polyhydric alcohol. Examples fatty acids used to make the fatty ester are lauric acid, tridecylic acid, myristic acid, pentadecylic acid, palmitic acid, margaric acid, stearic acid, nonadecylic acid, arachidic acid, oleic acid, elaidic acid and other related naturally occurring fatty acids and mixtures thereof. Examples of preferred polyhydric alcohols include ethylene glycol, propylene glycol, homopolymers of ethylene glycol and propylene glycol or polymers and copolymers thereof and mixtures thereof.

Illustrative, nonlimiting examples of useful lubricants and systems for use in lubricated finishing element finishing surface systems and general useful related technology are given in the U.S. Pat. No. 3,287,288 to Reilling, U.S. Pat. No. 3,458,596 to Eaigle, U.S. Pat. No. 4,877,813 to Jimo et. al., U.S. Pat. No. 5,079,287 to Takeshi et al., U.S. Pat. No. 5,110,685 to Cross et. al., U.S. Pat. No. 5,216,079 to Crosby et. al., U.S. Pat. No. 5,523,352 to Janssen, U.S. Pat. No. 5,591,808 to Jamison, U.S. Pat. No. 5,990,225 to Sagisaka et al. and are included herein by reference in their entirety for guidance and modification as appropriate by those skilled in the art. Further illustrative, non limiting examples of useful lubricants and fluid delivery systems and general useful related technology are given in U.S. Pat. No. 4,332,689 to Tanizaki, U.S. Pat. No. 4,522,733 to Jonnes, U.S. Pat. No. 4,544,377 to Schwen, U.S. Pat. No. 4,636,321 to Kipp et. al., U.S. Pat. No. 4,767,554 to Malito et. al., U.S. Pat. No. 4,950,415 to Malito, U.S. Pat. No. 5,225,249 to Biresaw, U.S. Pat. No. 5,368,757 to King, U.S. Pat. No. 5,401,428 to Kalota, U.S. Pat. No. 5,433,873 to Camenzind, U.S. Pat. No. 5,496,479 to Videau et. al., and U.S. Pat. No. 5,614,482 to Baker et. al. are included for guidance and modification by those skilled in the art and are included by reference in their entirety herein. It is also understood that the lubricants and lubricant systems can be combined in many different ways in this invention to produce useful finishing results given the new guidance herein.

Supplying an effective organic boundary layer lubricating composition to the interface between the workpiece surface being finished and the finishing element finishing surface is preferred and supplying an organic lubrication having an effective amount organic boundary layer lubrication to the operative finishing interface to change finishing rates is more preferred. Boundary layer lubrication which is less than complete lubrication and facilitates controlling frictional wear and tribochemical reactions is preferred. Independent control of the aqueous lubricating composition control parameters aids in controlling an effective amount of marginal lubrication and in situ control of the lubricant control parameters is more preferred. Changing the pressure applied to the operative finishing interface is a preferred control parameter which can change organic boundary layer lubrication. Changing the pressure applied to the operative finishing interface can be done particularly rapidly and controllably with a subsystem control in real time during finishing. Control of at least one of aqueous lubricating composition control parameters independent from changes in abrasives is preferred to enhance control of finishing. Control of at least one of aqueous lubricating composition control parameters in situ independent from changes in abrasives is preferred to enhance control of finishing. Non limiting examples of preferred independent aqueous lubricating composition control parameters is to feed aqueous lubricating composition separate and independently from any abrasive feed and then to adjust either the feed rate of the aqueous lubricating composition or the concentration(s) in the aqueous lubricating composition.

For general guidance for lubricants, some general test methods are discussed. Generally those skilled in the art know how to measure the kinetic coefficient of friction. A preferred method is ASTM D 3028-95 and ASTM D 3028-95 B is particularly preferred. Those skilled in the art can modify ASTM D 3028-95 B to adjust to appropriate finishing velocities and to properly take into consideration appropriate fluid effects due to the lubricant and finishing composition. Preferred lubricants and finishing compositions do not corrode the workpiece or localized regions of the workpiece. Corrosion can lead to workpiece failure even before the part is in service. ASTM D 130 is a is a useful test for screening lubricants for particular workpieces and workpiece compositions. As an example a metal strip such as a copper strip is cleaned and polished so that no discoloration or blemishes detectable. The finishing composition to be tested is then added to a test tube, the copper strip is immersed in the finishing composition and the test tube is then closed with a vented stopper. The test tube is then heated under controlled conditions for a set period of time, the metal strip is removed, the finishing composition removed, and the metal strip is compared to standards processed under identical conditions to judge the corrosive nature and acceptableness of the finishing composition. ASTM D 1748 can also be used to screen for corrosion. These test methods are included herein by reference in their entirety.

Some preferred suppliers of lubricants include Dow Chemical, Huntsman Corporation, and Chevron Corporation. An organic boundary layer lubricant consisting essentially of carbon, hydrogen, and oxygen is a particularly preferred lubricant. Organic boundary layer lubricants which are water soluble are also preferred and organic boundary layer lubricants free of mineral oils and vegetable oils can be preferred for applications where long term stability is especially preferred such as in slurry recycle applications.

Some Preferred Processes to Manufacture Multiphase Synthetic Resin Polymeric Components for Finishing Elements Finishing element for finishing semiconductor wafers must have a very high degree of cleanliness and/or purity to finish semiconductor wafers at high yields. Corrosive contaminates and/or contaminate particles unintentionally in the finishing element can cause yield losses costing thousands of dollars. Purifying the ingredients in the finishing element prior to manufacture of the finishing element is preferred. A preferred example of purifying ingredients and/or polymers is cleaning the ingredients and/or polymers to remove unwanted reactive functional groups that can lead to formation of unwanted particles which can cause unwanted damage to the workpiece surface during finishing. Cleaning at least one polymer wherein both particles and particle forming materials are removed (or rendered inactive, thus removing them) in order to provide a cleaned polymer free of unwanted particles capable of scratching the workpiece surface is preferred and cleaning a plurality of polymers wherein both particles and particle forming materials are removed (or rendered inactive, thus removing them) in order to provide a plurality of cleaned polymers free of unwanted particles capable of scratching the workpiece surface is more preferred. Melt purifying the synthetic resin before melt mixing multiple synthetic resins is a preferred example of a purifying step. Vacuum melt purifying is a preferred example of a melt purifying step. Melt vacuum screw extrusion is a preferred form of melt purifying the synthetic resin. Melt vacuum screw extrusion can remove or reduce unwanted low molecular weight substances such as unreacted oligomers and unreacted monomers. Unwanted low molecular weight side reaction products developed during polymeric graft reactions can also be removed with vacuum screw extrusion. Melt filter purifying is a preferred form of melt purifying the synthetic resin. Filtering the polymer to remove unwanted contaminants is a preferred method of cleaning or purifying the polymer. Solvent assisted filtering can be an effective method to remove unwanted contaminants. Melt filtering can also be an effective method to remove unwanted contaminants. Thermal assisted filtering can be an effective method to remove unwanted contaminants. Melt filtering can remove unwanted hard particulate contaminants which can cause scratching during subsequent finishing. A screen pack can be used for filtering the melt. A screen pack designed for melt extrusion is a preferred example of melt filtering. Melt filter purifying to remove all visible unmelted hard particle contaminants is preferred. Filter purifying to remove unmelted hard particle contaminants of less than 20 microns in diameter is preferred and of at most 10 microns is more preferred and of at most 1 micron is even more preferred and of at most 0.5 micron is even more particularly preferred. The smallest size particle which can be removed by filtration depends on the filtration system used, viscosities, available pressure drops, and, in some cases, the thermal stability of the polymer being filtered. Filtration systems are continuously being improved. For example, pressure drops can be minimized by some advanced systems and new solvent assisted systems have been developed and are reported in the recent United States patent literature. Evaluations for improved cleaning and filtering are continuing. Particles of at least 0.1 micron, perhaps smaller, are currently believed to be removable. Melt purifying the synthetic resins with melt purifying equipment is preferred before dynamic formation of the two phase because it is more difficult to filter the two phase system. Polymers can also be purified by extraction techniques (such as liquid extraction and selective precipitation) to remove unwanted contaminants. A vacuum extruder and polymer melt filters are preferred examples of melt purifying equipment. The cleaning and filtering of the polymers is preferably done before adding abrasives to the polymeric composition because this makes filtering and cleaning easier and more cost effective. The cleaning and filtering of the polymers for a multiphase polymeric composition is preferably done before making to the multiphase polymeric composition because this makes filtering and cleaning easier and more cost effective. In other words, precleaned and/or prefiltered polymers are preferred starting components to make an abrasive composition and/or a multiphase polymeric composition. U.S. Pat. No. 4,737,577 to Brown, U.S. Pat. No. 5,198,471 to Nauman et al., U.S. Pat. No. 5,266,680 to Al-Jimal et al., U.S. Pat. No. 5,756,659 to Hughes, U.S. Pat. No. 5,928,255 to Hobrecht, U.S. Pat. No. 5,869,591 to McKay et al., U.S. Pat. No. 5,977,271 to McKay et al. and U.S. Pat. No. 5,977,294 to Hoehn give further non-limiting guidance for some preferred purifying methods and equipment and are included herein in the entirety by reference.

Multiphase synthetic resin polymer mixtures can be manufactured by preferred polymeric processing methods. Preformed synthetic resin particles can be mixed with the continuous phase synthetic resin in melt processing equipment such as extruders and melt blending apparatus. Preformed synthetic resin particles can be added under mixing conditions to a thermoset resin and mixed therein prior to curing. The preformed particles can contain preferred additives such as abrasive particles. Under high shear and temperature mixing conditions, a two phase synthetic resin mixture having discrete synthetic resin particles comprised of polymer "B" dispersed in a continuous phase of a separate synthetic resin polymer "A". Further, polymer "B" can contain preferred additives such as abrasives or fibers prior to the high shear melt mixing process. Alternately one or both of the synthetic resin polymers can be functionalized to graft with one of the polymers. The functional group can be capable of reacting during mixing with other functional groups. A block copolymer can be used to compatibilize the multiphase polymeric mixture. The mixing can be with self-cured elastomers. The melt mixing for dynamically vulcanizing at least one polymer in the multiphase synthetic resin mixture is preferred. Optionally, crosslinking agents can be used to enhance crosslinking. Crosslinking agents are generally specific to the polymer or polymeric system to be crosslinked and are generally well known by those skilled in the crosslinking arts. Illustrative examples of chemical crosslinking agents include peroxides, phenols, azides, and active compositions including sulfur, silicon, and/or nitrogen. Optionally, initiators can also be used to enhance crosslinking. Optionally, radiation can be used to enhance crosslinking. Generally, the radiation type and dosage is specific to the polymer system undergoing crosslinking. Crosslinking systems are effective crosslinking for the polymer or polymeric system being crosslinked and generally well known for different polymeric and elastomeric systems. Crosslinking systems can also employ moisture, heat, radiation, and crosslinking agents or combinations thereof the effect crosslinking. An agent for crosslinking can be preferred for specific finishing element components. The multiphase synthetic resin mixtures can have preferred morphologies and compositions to change wear, friction, flexural modulus, hardness, temperature sensitivity, toughness, and resistance to fatigue failure during finishing to improve finishing.

Illustrative examples of multiphase polymeric constructions, their manufacture, compatibilization, and dynamic crosslinking can be found in various United States Patents. Included are various crosslinking systems, compatibibilizers, and specific guidance on mixing conditions for multiphase polymeric systems. U.S. Pat. No. 3,882,194 to Krebaum, U.S. Pat. No. 4,419,408 to Schmukler et al., U.S. Pat. No. 4,440,911 to Inoue et al., U.S. Pat. No. 4,632,959 to Nagano, U.S. Pat. No. 4,472,555 to Schmukler et al., U.S. Pat. No. 4,762,890 to Strait et al., U.S. Pat. No. 4,477,532 to Schmukler et al, U.S. Pat. No. 5,100,947 to Puydak et al., U.S. Pat. No. 5,128,410 to Illendra et al., U.S. Pat. No. 5,244,971 to Jean-Marc, U.S. Pat. No. 5,266,673to Tsukahara et al., U.S. Pat. No. 5,286,793to Cottis et al., U.S. Pat. No. 5,321,081 to Chundry et al., U.S. Pat. No. 5,376,712 to Nakajima, U.S. Pat. No. 5,416,171 to Chung et al., U.S. Pat. No. 5,460,818 to Park et al., U.S. Pat. No. 5,504,139 to Davies et al., U.S. Pat. No. 5,523,351 to Colvin et al., U.S. Pat. No. 5,548,023 to Powers et al., U.S. Pat. No. 5,585,152 to Tamura et al., U.S. Pat. No. 5,605,961 to Lee et al., U.S. Pat. No. 5,610,223 to Mason, U.S. Pat. No. 5,623,019 to Wiggins et al., U.S. Pat. No. 5,625,002 to Kadoi et. al., U.S. Pat. No. 5,683,818 to Bolvari, U.S. Pat. No. 5,723,539 to Gallucci et al, U.S. Pat. No. 5,783,631 to Venkataswamy, U.S. Pat. No. 5,852,118 to Horrion et al., U.S. Pat. No. 5,777,029 to Horrion et al., U.S. Pat. No. 5,777,039 to Venkataswamy et al., U.S. Pat. No. 5,837,179 to Pihl et al., U.S. Pat. No. 5,856,406 to Silvis et al., U.S. Pat. No. 5,869,591 to McKay et al., U.S. Pat. No. 5,929,168 to Ikkala et al., U.S. Pat. No. 5,936,038 to Coran et al., U.S. Pat. No. 5,936,039 to Wang et al., U.S. Pat. No. 5,936,058 to Schauder, and U.S. Pat. No. 5,977,271 to McKay et al. comprise illustrative nonlimiting examples of compatible two phase polymer systems, some illustrative examples of manufacture for two phase polymer systems, some illustrative examples of manufacture of polymeric compatibilizers, and manufacture of a two phase polymer system having discrete synthetic particles having silica particles dispersed therein, and these references are contained herein by reference in their entirety for further general guidance and modification by those skilled in the arts.

Mixing technology to disperse the synthetic resin particles in a continuous phase synthetic resin matrix is generally well known to those skilled in the polymer mixing arts. Thermoset synthetic resin particles are currently preferred. Crosslinked synthetic resin particles are also currently preferred. Single and twin screw extruders are commonly used for many thermoplastic mixing operations. High shear mixing such as often found in twin screw extruders is generally desirable. Hoppers and ports to feed multiple ingredients are generally well known in the art. The ingredients can be added in a feed hopper or optionally mixed in the melt using feed ports in the extruder. Some speeds in revolution per minute ranges for a melt mixing(s) (such as mixing screws on an extruder) are preferred. A mixing element having from 40–500 rpm is preferred and one having from 50 to 450 rpm is more preferred and one having from 60 to 400 rpm is even more preferred. These mixing element ranges generally promote good mixing and are particularly preferred for dynamically melt mixing (forming) a multiphase synthetic resin polymer system. Commercial suppliers of mixing equipment for plastic materials are well known to those skilled in the art. Illustrative nonlimiting examples of mixing equipment suppliers include Buss (America), Inc., Berstorff Corporation, Krupp Werner & Pfleiderer, Kady International, and Farrel Corporation. Synthetic resin polymers of the above descriptions are generally available commercially. Illustrative nonlimiting examples of commercial suppliers of organic synthetic polymers include Exxon Co., Dow Chemical, Sumitomo Chemical Company, Inc., DuPont Dow Elastomers, and BASF.

Because of the lower cost of manufacture and improved contamination control, applicant currently prefers new dynamic formation of multiphase polymeric mixtures during melt mixing. Dynamically forming synthetic resin polymer "A" particles in a continuous phase of synthetic resin polymer "B" in the presence of a compatibilizer polymer "C" is a preferred method of forming a multiphase polymeric matrix for a finishing element component such as a subsurface layer or a finishing surface layer. Dynamically vulcanizing synthetic resin polymer "A" particles in a continuous phase of synthetic resin polymer "B" is a preferred method of forming a multiphase polymeric matrix for a finishing element such as a lower layer or a finishing layer. Dynamically vulcanizing synthetic resin polymer "A" particles in a continuous phase of synthetic resin polymer "B" in the presence of a compatibilizer polymer "C" is also preferred method of forming a multiphase polymeric matrix for a finishing element such as a lower layer or a finishing layer. Compatibilizers can improve the physical properties of the composite by improving toughness of the finishing element during finishing which in turn can lower the costs to make planarized and polished semiconductor wafers. Dynamic vulcanization can also improve toughness of the composite structure.

Supplying a synthetic resin "A", a synthetic resin "B", abrasive particles, and a polymeric compatibilizer "C" to a melt mixer is a preferred step in forming a finishing element component. Dynamically melt mixing and dispersing the synthetic resin "B" into the synthetic resin "A" having a plurality of synthetic resin phases is a preferred step in forming a finishing element component. Dynamically melt mixing the abrasive particles into a synthetic resin is preferred. The abrasive particles can be dynamically mixed into one synthetic resin and then this mixture is dynamically melt mixed into a second synthetic resin. Alternately, the abrasive particles and two different synthetic resins can be supplied to a melt mixer then this mixture can be dynamically melt mixed. The abrasive particles can be dispersed into synthetic resin in which the abrasive particles are most compatible. Dynamically bonding a portion of the synthetic resin "A" to synthetic resin "B" is another preferred step in forming a finishing element component. Dynamically covalently bonding a portion of the synthetic resin "A" to synthetic resin "B" is another preferred step in forming a finishing element component. Dynamically melt mixing and dispersing the synthetic resin "B" into the synthetic resin "A" forming a mixture having a plurality of synthetic resin phases is another preferred step in forming a finishing element component. Dynamically forming, more preferably melt forming, a multiphase synthetic resin composition for use as a synthetic resin mixture in a finishing element finishing component is preferred because low cost, high purity, good physical properties, and high quality can be achieved.

Supplying a non-crosslinkable synthetic resin "A" and a crosslinkable synthetic resin "B" to a melt mixer is another preferred step in forming some finishing element components. Dynamically crosslinking synthetic resin "B" while melt mixing forming a mixture of dispersed crosslinked synthetic resin "B" particles dispersed in a continuous phase of synthetic resin "A" and the mixture having a plurality of synthetic resin phases is another preferred step in forming a finishing element component. A crosslinking agent to improve crosslinking can be preferred dynamic crosslinking of some synthetic resins. A crosslinking agent to improve crosslinking can be preferred dynamic crosslinking of some synthetic resins. Melt forming a finishing element component using the multiphase polymeric mixtures is preferred. Melt compounding a synthetic resin "B" in synthetic resin "A" during melt compounding forming discrete synthetic resin "B" particles in a continuous phase of synthetic resin "A" is preferred to improve dispersion and reduce costs. Melt mixing of abrasive particles in a synthetic resin "B" forming an abrasive molten polymeric matrix, and then melt mixing the abrasive molten polymeric matrix synthetic resin "A" forming discrete synthetic resin "B" particles having abrasive particles dispersed therein is preferred. By compounding without cooling, lower costs can be achieved.

Dynamically crosslinking during melt mixing can improve the physical properties of finishing element components used to finish semiconductor wafer surfaces. Dynamically crosslinking a synthetic resin forming a multiphase polymeric mixture with higher Tensile Strength as measured by ASTM D 638 than that of the same multiphase polymeric mixture in the absence of the dynamic crosslinking is preferred. Dynamically crosslinking a synthetic resin forming a multiphase polymeric mixture with higher Ultimate Tensile Strength as measured by ASTM D 638 than that of the same multiphase polymeric mixture in the absence of the dynamic crosslinking is preferred. Dynamically crosslinking a synthetic resin forming a multiphase polymeric mixture with higher Ultimate Elongation as measured by ASTM D 638 than that of the same multiphase polymeric mixture in the absence of the dynamic crosslinking is preferred. Dynamically crosslinking a synthetic resin forming a multiphase polymeric mixture with higher toughness than that of the same multiphase polymeric mixture in the absence of the dynamic crosslinking is preferred. Dynamically crosslinking a synthetic resin forming a multiphase polymeric mixture with higher Fatigue Endurance as measured by ASTM D 671 than that of the same multiphase polymeric mixture in the absence of the dynamic crosslinking is preferred. Dynamic crosslinking improving a plurality of these properties is especially preferred. Finishing elements having these improved physical properties can improve finishing.

Crosslinking can be tested by showing that the crosslinked synthetic resin becomes either more difficult (higher viscosity) to thermally process and form or cannot be thermally processed into new shapes. Alternately, crosslinking can be demonstrating that polymer which was soluble in a solvent becomes partially or completely insoluble in the same solvent at the same conditions. ASTM D 2765A-84 is a generally accepted test to shown insoluble gel formation due to crosslinking of some common types of polymers and is included herein in its entirety for guidance and illustration, and when appropriate, as the preferred test for gel formation. Preferred crosslinking also generally increases elastic deformation during finishing. Preferred crosslinking can also reduce plastic deformation during finishing.

Dynamically reacting a first synthetic resin with a second synthetic resin during melt mixing can improve the physical properties of finishing element components used to finish semiconductor wafer surfaces. Dynamically reacting a first synthetic resin with a second synthetic resin forming a multiphase polymeric mixture with higher Tensile Strength as measured by ASTM D 638 than that of the same multiphase polymeric mixture in the absence of a dynamic reaction between the two synthetic resins is preferred. Dynamically reacting a first synthetic resin with a second synthetic resin forming a multiphase polymeric mixture with higher Ultimate Tensile Strength as measured by ASTM D 638 than that of the same multiphase polymeric mixture in the absence of a dynamic reaction between the two synthetic resins is preferred. Dynamically reacting a first synthetic resin with a second synthetic resin forming a multiphase polymeric mixture with higher Ultimate Elongation as measured by ASTM D 638 than that of the same multiphase polymeric mixture in the absence of a dynamic reaction between the two synthetic resins is preferred. Dynamically reacting a first synthetic resin with a second synthetic resin forming a multiphase polymeric mixture with higher toughness than that of the same multiphase polymeric mixture in the absence of a dynamic reaction between the two synthetic resins is preferred. Dynamically reacting a first synthetic resin with a second synthetic resin forming a multiphase polymeric mixture with higher the Fatigue Endurance as measured by ASTM D 671 than that of the same multiphase polymeric mixture in the absence of the a dynamically reaction between the two synthetic resins is preferred. A dynamic reaction between the two different synthetic resins improving a plurality of these properties is especially preferred. Finishing elements having these improved physical properties can improve finishing.

Dynamically vulcanizing the polymer in synthetic resin particles is preferred and dynamically fully vulcanizing the polymer in the synthetic resin particles is more preferred. U.S. Pat. No. 3,758,643 to Fischer, U.S. Pat. No. 4,130,534to Coran, et al. and U.S. Pat. No. 4,355,139 to Coran, et al. are included herein by reference in their entirety for guidance and modification by those skilled in the arts. Dynamically vulcanizing the polymeric synthetic resin particles dispersed in a continuous phase of synthetic resin can improve finishing characteristics of the finishing element.

Melt forming the finishing element components is preferred. Molding is a preferred type of melt forming. Injection molding is a preferred type of molding. Compression molding is a preferred type of molding. Coinjection molding is a preferred type of melt forming. Melt injection molding is a preferred method of molding. Melt coinjection molding is a preferred form of coinjection molding. U.S. Pat. No. 4,385,025 to Salerno et al. provides nonlimiting illustrative guidance for injection molding and coinjection molding and is included herein by reference in its entirety. Melt molding can form components with very tight tolerances. Injection molding and coinjection molding offer low cost, good resistance to contamination, and very tight tolerances. Extrusion is a preferred form of melt forming. Extrusion can be low cost and have good tolerances. Preferred finishing element components include finishing element finishing layers, finishing element sublayers, and discrete stiffening members. Melt forming finishing elements and/or components thereof with a thermoplastic multiphase polymeric composition which can be recycled is especially preferred to help reduce costs and improve performance.

Supplying a synthetic polymer "A" and a crosslinkable synthetic polymer "B" to a melt mixer and forming a dynamically crosslinked polymer "B" in a thermoplastic polymer "A" has been discussed above. After forming the multiphase polymeric system and forming the finishing element (or component thereof), polymer "A" can be crosslinked (post crosslinked) to further improve resistance to wear, toughness, chemical resistance, and/or thermal resistance. This can also, preferably, improve the resilience and/or yield. Crosslinking has been discussed herein above. As used herein, crosslinking a polymeric composition of a shaped article after shaping is post crosslinking. A polymeric composition which changes from a thermal formable polymeric composition to a non-thermal formable polymeric composition is a preferred form of post crosslinking. Radiation crosslinking comprises a preferred form of post crosslinking. High energy radiation crosslinking is preferred. Devices that radiate crosslinking energy are generally well known such as UV lamps (illustratively Philips HTQ 4 or 7), electron beam sources (illustratively electron accelerators are commercially available from Radiative Dynamics of Edgewood, N.Y.) and gamma ray sources. Radiation doses are preferably chosen so as not to cause undue dimensional distortions and other undesirable mechanical property changes. Generally the multiphase system is not heated above the melting point, more preferably the softening point of the continuous phase polymer. Chemical crosslinking also comprises a preferred form of post crosslinking. A nonlimiting illustrative example is a polymer having a reactive silicon containing function group (illustratively, a grafted polymer) capable of moisture curing post crosslinking after the finishing element (or component) is formed. A reactive silane group is a preferred reactive silicon containing function group. A vinyl trimethoxysilane which grafts onto a polyolefin chain under catalysis by a peroxide is a preferred reactive silane group. Crosslinking agents and crosslinking catalysts can be preferred. U.S. Pat. No. 4,444,816 to Richards et al., U.S. Pat. No. 4,873,042 to Topeik, U.S. Pat. No. 5,594,041 to Dearnaley et al., U.S. Pat. No. 5,855,985 to O'Donnell, 5,900,444 to Zamore, U.S. Pat. No. 5,985,962 to Knors et al., and U.S. Pat. No. 5,993,415 to O'Neil et al. comprise some nonlimiting illustrative crosslinking systems and examples for post crosslinking a thermoplastic polymer after dynamically forming a multiphase polymeric system and are included in their entirety for general guidance and/or modification by those skilled in the polymer arts. A thermoplastic polymer capable of radiative post crosslinking is preferred. A thermoplastic polymer capable of chemical post crosslinking is also preferred. A thermoplastic polymer capable of post crosslinking by moisture curing is also preferred. A thermoplastic polymer selected from the group consisting of polyolefins, polyesters, and polyamides is a preferred thermoplastic polymer for post crosslinking. Post crosslinking multiphase polymeric finishing element (or component thereof) can improve finishing longevity and improve stability during finishing and thus reduce finishing costs.

Post crosslinking after mixing and finishing element formation (or component thereof) can improve the physical properties of finishing element components used to finish semiconductor wafer surfaces. Post crosslinking a synthetic resin forming a multiphase polymeric mixture with higher Tensile Strength as measured by ASTM D 638 than that of the same multiphase polymeric mixture formed in the absence of the post crosslinking is preferred. Post crosslinking a synthetic resin forming a multiphase polymeric mixture with higher Ultimate Tensile Strength as measured by ASTM D 638 than that of the same multiphase polymeric mixture formed in the absence of the post crosslinking is preferred. Post crosslinking a synthetic resin forming a multiphase polymeric mixture with higher Ultimate Elongation as measured by ASTM D 638 than that of the same multiphase polymeric mixture formed in the absence of the post crosslinking is preferred. Post crosslinking a synthetic resin forming a multiphase polymeric mixture with lower compression set as measured by ASTM D 395 than that of the same multiphase polymeric mixture formed in the absence of the post crosslinking is preferred. Post crosslinking a synthetic resin forming a multiphase polymeric mixture with higher toughness to that of the same multiphase polymeric mixture formed in the absence of the post crosslinking is preferred. Post crosslinking a synthetic resin forming a multiphase polymeric mixture with higher Fatigue Endurance as measured by ASTM D 671 to that of the same multiphase polymeric mixture formed in the absence of the post crosslinking is preferred. Post crosslinking a synthetic resin forming a multiphase polymeric mixture with higher chemical resistance to that of the same multiphase polymeric mixture formed in the absence of the post crosslinking is preferred. Post crosslinking a synthetic polymer to increase the amount of elastic deformation of a polymeric composition during during finishing motion and decrease the plastic deformation polymeric composition during operative finishing motion is preferred. Post crosslinking a synthetic polymer to increase the amount of elastic deformation and decrease the plastic deformation of at least one polymer in a multiphase polymeric composition during operative finishing motion is more preferred. Post crosslinking improving a plurality of these properties is especially preferred. Post crosslinking for improving at least one of these properties by at least 10% is preferred and for improving at least one of these properties by at least 30% is more preferred and for improving at least one of these properties by at least 70% is even more preferred. Post crosslinking for improving a plurality of these properties by at least 10% is preferred and for improving a plurality of these properties by at least 30% is more preferred and for improving a plurality of these properties by at least 70% is even more preferred. Finishing elements having these improved physical and/or chemical properties can improve finishing and finishing elements having at least two of these improved physical and/or chemical properties are especially preferred.

Each of these forming processes can be low cost and produce finishing elements with tight tolerances.

With dynamic melt forming of the synthetic resin particles, the cost to manufacture separate synthetic resin particles can be eliminated. Further, by reducing the number of times the synthetic resin particles are exposed to handling, unwanted foreign contamination is reduced or eliminated, further increasing the quality of the resultant finishing elements.

Optionally Preferred Polymeric Components

When finishing workpieces, even a low number of small scratches can lead to lower yields and higher manufacturing costs. For this reason it is preferred that the polymers on the finishing element finishing surface be as free as possible from unwanted particles capable of scratching the workpiece surface being finished. It is particularly preferred that unwanted particles capable of scratching the workpiece surface be also as small as possible. Methods to purify the polymers prior to forming the finishing element finishing surface are preferred. Purifying polymer "A" by filtering, extracting, or neutralizing an unwanted reactive group before adding it to a second polymer is preferred because this can reduce the cost and can even improve the purification process, such as a cleaning or filtering process. For abrasive finishing element finishing surfaces having abrasive particles, purifying a polymer "A" before adding the abrasive is preferred because this can also reduce the cost of purification and even improve the purification process. Cleaning or filtering a plurality of polymers before mixing them or adding abrasive is also preferred for the similar reasons. By example, a multiphase synthetic polymer composition having at least one cleaned polymer "A" wherein both particles and particle forming materials are removed before being added to the polymeric multiphase system or the abrasive composition to provide a polymer "A" free of unwanted particles having a maximum dimension of at least 20 microns capable of scratching a workpiece surface is preferred. In other words, polymer "A" is precleaned of both particles (and particle forming materials) to render it free of unwanted particles having a maximum dimension of at least 20 microns capable of scratching a workpiece surface and is preferred. As a further example, a finishing surface having at least one polymer filtered before adding abrasive to the filtered polymer to remove particles having a maximum dimension of at least 10 microns capable of scratching a workpiece surface, the filtering done is preferred. In a similar fashion, precleaned polymer to remove particles having a maximum dimension of 1 micron is even more preferred. By pretreating polymers to clean them before making the finishing element, generally a higher performance finishing element finishing surface can be made.

An abrasive finishing element finishing surface comprising a multiphase synthetic polymer composition having a continuous phase of thermoplastic polymer "A" and a second synthetic polymer "B" in a different phase having abrasive particles dispersed therein is preferred. This multiphase abrasive composition can be used to operatively finish a workpiece. A dynamically formed second synthetic polymer "B" phase is especially preferred. A dynamically formed composition can reduce costs and also help to reduce contamination from additional handling. A crosslinked polymer "B" is preferred because this can improve temperature resistance and also increase elastic deformation during operative finishing.

Workpiece

A workpiece needing finishing is preferred. A homogeneous surface composition is a workpiece surface having one composition throughout and is preferred for some applications. A workpiece needing polishing is preferred. A workpiece needing planarizing is especially preferred. A workpiece having a microelectronic surface is preferred. A workpiece surface having a heterogeneous surface composition is preferred. A heterogeneous surface composition has different regions with different compositions on the surface, further the heterogeneous composition can change with the distance from the surface. Thus finishing can be used for a single workpiece whose surface composition changes as the finishing process progresses. A workpiece having a microelectronic surface having both conductive regions and non-conductive regions is more preferred and is an example of a preferred heterogeneous workpiece surface. Illustrative examples of conductive regions can be regions having copper or tungsten and other known conductors, especially metallic conductors. Metallic conductive regions in the workpiece surface consisting of metals selected from the group consisting of copper, aluminum, and tungsten or combinations thereof are particularly preferred. A semiconductor device is a preferred workpiece. A substrate wafer is a preferred workpiece. A semiconductor wafer having a polymeric layer requiring finishing is preferred because a lubricating aid can be particularly helpful in reducing unwanted surface damage to the softer polymeric surfaces. An example of a preferred polymer is a polyimide. Polyimide polymers are commercially available from E. I. DuPont Co. in Wilmington, Del. A semiconductor having a interlayer dielectric needing finishing is preferred. A semiconductor having a low-k dielectric layer is a preferred workpiece.

This invention is particularly preferred for workpieces requiring a highly flat surface. Finishing a workpiece surface to a surface to meet the specified semiconductor industry circuit design rule is preferred and finishing a workpiece surface to a surface to meet the 0.35 micrometers feature size semiconductor design rule is more preferred and finishing a workpiece surface to a surface to meet the 0.25 micrometers feature size semiconductor design rule is even more preferred and finishing a workpiece surface to a to meet the 0.18 micrometers semiconductor design rule is even more particularly preferred. An electronic wafer finished to meet a required surface flatness of the wafer device rule in to be used in the manufacture of ULSIs (Ultra Large Scale Integrated Circuits) is a particularly preferred workpiece made with a method according to preferred embodiments of this invention. The design rules for semiconductors are generally known to those skilled in the art. Guidance can also be found in the "The National Technology Roadmap for Semiconductors" published by SEMATECH in Austin, Tex.

A semiconductor wafers having low-k dielectric layers(s) are preferred workpiece. Illustrative nonlimiting examples of low-k dielectrics are low-k polymeric materials, low-k porous materials, and low-k foam materials. As used herein, a low-k dielectric has at most a k range of less than 3.5 and more preferably less than 3.0. Illustrative examples include doped oxides, organic polymers, highly fluorinated organic polymers, and porous materials. Low-k dielectric materials are generally known to those skilled in the semiconductor wafer arts.

A semiconductor wafer having a diameter of at least 200 mm is preferred and a semiconductor wafer having a diameter of at least 300 mm is more preferred. As the semiconductor wafer become larger, it becomes more valuable which makes higher yields very desirable.

Finishing Composition

Finishing compositions are generally known skilled in the art for chemical mechanical finishing. A chemical mechanical polishing slurry can generally be used as finishing composition. Alternately, a finishing composition can be modified by those skilled in the art by removing the abrasive particles to form a finishing composition free of abrasive particles. A finishing composition substantially free of abrasive particles is preferred and a finishing composition free of abrasive particles is more preferred. Finishing compositions have their pH adjusted carefully, and generally comprise other chemical additives are used to effect chemical reactions and/other surface changes to the workpiece. A finishing composition having dissolved chemical additives is particularly preferred. Illustrative examples preferred dissolved chemical additives include dissolved acids, bases, buffers, oxidizing agents, reducing agents, stabilizers, and chemical reagents. A finishing composition having a chemical which substantially reacts with material from the workpiece surface being finished is particularly preferred. A finishing composition having a chemical which selectively chemically reacts with only a portion of the workpiece surface is particularly preferred. A finishing composition having a chemical which preferentially chemically reacts with only a portion of the workpiece surface is particularly preferred.

Some illustrative nonlimiting examples of polishing slurries which can be modified and/or modified by those skilled in the art are now discussed. An example slurry comprises water, a solid abrasive material and a third component selected from the group consisting of $HNO_3$, $H_2SO_4$, and $AgNO_3$ or mixtures thereof. Another polishing slurry comprises water, aluminum oxide, and hydrogen peroxide mixed into a slurry. Other chemicals such as KOH (potassium hydroxide) can also be added to the above polishing slurry. Still another illustrative polishing slurry comprises $H_3PO_4$ at from about 0.1% to about 20% by volume, $H_2O_2$ at from 1% to about 30% by volume, water, and solid abrasive material. Still another polishing slurry comprises an oxidizing agent such as potassium ferricyanide, an abrasive such as silica, and has a pH of between 2 and 4. Still another polishing slurry comprises high purity fine metal oxides particles uniformly dispersed in a stable aqueous medium. Still another polishing slurry comprises a colloidal suspension of $SiO_2$ particles having an average particle size of between 20 and 50 nanometers in alkali solution, demineralized water, and a chemical activator. U.S. Pat. No. 5,209,816 to Yu et. al. issued in 1993, U.S. Pat. No. 5,354,490 to Yu et. al. issued in 1994, U.S. Pat. No. 5,540,810 to Sandhu et. al. issued in 1996, U.S. Pat. No. 5,516,346 to Cadien et. al. issued in 1996, U.S. Pat. No. 5,527,423 to Neville et. al. issued in 1996, 5,622,525 to Haisma et. al. issued in 1997, and U.S. Pat. No. 5,645,736 to Allman issued in 1997 comprise illustrative nonlimiting examples of slurries contained herein by reference in their entirety for further general guidance and modification by those skilled in the arts. Commercial CMP polishing slurries are also available from Rodel Manufacturing Company in Newark, Del. Application WO 98/18159 to Hudson gives general guidance for those skilled in the art for modifying current slurries to produce an abrasive free finishing composition.

In a preferred mode, the finishing composition is free of abrasive particles. However as the fixed abrasive finishing element wears down during finishing, some naturally worn fixed abrasive particles can be liberated from the fixed abrasive finishing element can thus temporarily be present in the finishing composition until drainage or removal.

A lubricating aid which is water soluble can be added to the finishing composition and is preferred for some applications. A lubricating aid which has a different solubility in water at different temperatures is more preferred. A degradable finishing aid, more preferably a lubricating aid, is also preferred and a biodegradable finishing aid, more preferably a lubricating aid, is even more preferred. An environmentally friendly finishing aid, more preferably a lubricating aid, is particularly preferred. A water based lubricant formed with water which has low sodium content is also preferred because sodium can have a adverse performance effect on the preferred semiconductor parts being made. A lubricant free of sodium is a preferred lubricant. As used herein a lubricant fluid free of sodium means that the sodium content is below the threshold value of sodium which will adversely impact the performance of a semiconductor wafer or semiconductor parts made therefrom. A finishing aid, more preferably a lubricating aid, free of sodium is preferred. As used herein a finishing aid free of sodium means that the sodium content is below the threshold value of sodium which will adversely impact the performance of a semiconductor wafer or semiconductor parts made therewith.

Operative Finishing Motion

Chemical mechanical finishing during operation has the finishing element in operative finishing motion with the surface of the workpiece being finished. A relative lateral parallel motion of the finishing element to the surface of the workpiece being finished is an operative finishing motion. Lateral parallel motion can be over very short distances or macro-distances. A parallel circular motion of the finishing element finishing surface relative to the workpiece surface being finished can be effective. A tangential finishing motion can also be preferred.

Some illustrative nonlimiting examples of preferred operative finishing motions for use in the invention are also discussed. This invention has some particularly preferred operative finishing motions of the workpiece surface being finished and the finishing element finishing surface. Moving the finishing element finishing surface in an operative finishing motion to the workpiece surface being finished is a preferred example of an operative finishing motion. Moving the workpiece surface being finished in an operative finishing motion to the finishing element finishing surface is a preferred example of an operative finishing motion. Moving the finishing element finishing surface in a parallel circular motion to the workpiece surface being finished is a preferred example of an operative finishing motion. Moving the workpiece surface being finished in a parallel circular motion to the finishing element finishing surface is a preferred example of an operative parallel. Moving the finishing element finishing surface in a parallel linear motion to the workpiece surface being finished is a preferred example of an operative finishing motion. Moving the workpiece surface being finished in a parallel linear motion to the finishing element finishing surface is a preferred example of an operative parallel. The operative finishing motion performs a significant amount of the polishing and planarizing in this invention. An operative finishing motion which causes tribochemical finishing reactions is preferred. Operative finishing uses operative finishing motion to effect polishing and planarizing.

High speed finishing of the workpiece surface with finishing elements can cause surface defects in the workpiece surface being finished at higher than desirable rates because of the higher forces generated. As used herein, high speed finishing involves relative operative motion having an equivalent linear velocity of greater than 300 feet per minute and low speed finishing involves relative operative motion having an equivalent linear velocity of at most 300 feet per minute. The relative operative speed is measured between the finishing element finishing surface and the workpiece surface being finished. Supplying a lubricating aid between the interface of the finishing element finishing surface and the workpiece surface being finished when high speed finishing is preferred to reduce the level of surface defects. Supplying a lubricating aid between the interface of a fixed abrasive cylindrical finishing element and a workpiece surface being finished is a preferred example of high speed finishing. Supplying a lubricating aid between the interface of a fixed abrasive belt finishing element and a workpiece surface being finished is a preferred example of high speed finishing. An operative finishing motion which maintains substantially constant instantaneous relative velocity between the finishing element and all points on the semiconductor wafer is preferred for some finishing equipment. An operative finishing motion which maintains substantially different instantaneous relative velocity between the finishing element and some points on the semiconductor wafer is preferred for some finishing equipment.

U.S. Pat. No. 5,177,908 to Tuttle, U.S. Pat. No. 5,234,867 to Schultz et al, U.S. Pat. No. 5,522,965 to Chisholm et al., U.S. Pat. No. 5,759,918 to Hoshizaki et al., U.S. Pat. No. 5,762,536 to Pant, U.S. Pat. No. 5,735,731 to Lee, and U.S. Pat. No. 5,962,947 to Talieh comprise illustrative nonlimiting examples of operative finishing motion contained herein by reference in their entirety herein for further general guidance of those skilled in the arts.

An operative finishing motion applied with a chemical mechanical finishing system (such as a chemical mechanical polishing apparatus described herein and chemical mechanical polishing patents contained herein by reference) is preferred. A chemical mechanical finishing system capable of holding the finishing element and capable of applying an operative finishing motion to an operative finishing interface can be effective. A mechanical finishing system having a workpiece holder, finishing element holder, and capable of applying an operative finishing motion to an operative finishing interface is more preferred. A tribochemical finishing system having a workpiece holder, finishing element holder, and capable of applying an operative finishing motion to an operative finishing interface (causing tribochemical reactions and finishing) is preferred. A chemical mechanical finishing system having a workpiece holder, finishing element holder, and capable of applying an operative finishing motion to an operative finishing interface is more preferred.

Platen

The platen is generally a stiff support structure for the finishing element. The platen surface facing the workpiece surface being finished is parallel to the workpiece surface being planarized and is flat and generally made of metal. The platen reduces flexing of the finishing element by supporting the finishing element; optionally a pressure distributive element can also be used. The platen surface during polishing is in operative finishing motion to the workpiece surface being finished. The platen surface can be static while the workpiece surface being finished is moved in an operative finishing motion. The platen surface can be moved in a parallel motion fashion while the workpiece surface being finished is static. Optionally, both the platen surface and the workpiece being finished can be in motion in a way that creates operative finishing motion between the workpiece and the finishing element.

Particularly preferred method of finishing applying a variable pressure with the unitary resilient body to the backside surface of the discrete finishing member and wherein the unitary resilient body held in place with a substantially flat and inflexible finishing element support surface and more particularly preferred is wherein this variable pressure is applied with the unitary resilient body and wherein the unitary resilient body is against a flat and inflexible finishing element support surface. As used herein, applying a variable pressure to the backside surface of the discrete finishing member means applying a different pressure as measured in pounds per square inch in different local regions of the backside surface of the discrete finishing member. Applying a variable pressure to the backside surface of the discrete finishing member means applying a different pressure as measured in pounds per square inch in different local regions of the backside surface of the discrete finishing member is a preferred embodiment. FIGS. 3, 5, and 6 serve as further guidance. Non limiting illustrative examples of substantially flat and inflexible finishing support surfaces are the platens used in many commercial chemical mechanical polishing tools. Substantially flat and inflexible platens are generally known to those skilled in the art and are commercially available from IPEC Planar and Strasbaugh. A finishing element and finishing method of this invention can improve the finishing utility of this broadly installed base of chemical mechanical polishing equipment having a substantially flat and inflexible platen or support base for the finishing element.

Base Support Structure

The base support structure forms structure which can indirectly aid in applying pressure to the workpiece surface being finished. It generally forms a support surface for those members attached to it directly or operatively connected to the base support structure. Other types of base support structure are generally known in the industry and are functional.

Workpiece Finishing Sensor

A workpiece finishing sensor is a sensor which senses the finishing progress to the workpiece in real time so that an in situ signal can be generated. A workpiece finishing sensor is preferred. A workpiece finishing sensor which facilitates measurement and control of finishing in this invention is preferred. A workpiece finishing sensor probe which generates a signal which can be used cooperatively with the secondary friction sensor signal to improve finishing is more preferred.

The change in friction during finishing can be accomplished using technology generally familiar to those skilled in the art. The current changes related to friction changes can then be used to produce a signal to operate the finishing control subsystem. A change in friction can be detected by rotating the workpiece finishing surface with the finishing element finishing surface with electric motors and measuring power changes on one or both motors. Changes in friction can also be measured with thermal sensors. A thermistor is a non-limiting example of preferred non-optical thermal sensor. A thermal couple is another preferred non-optical thermal sensor. An optical thermal sensor is a preferred thermal sensor. An infrared thermal sensor is a preferred thermal sensor. Sensors to measure friction in workpieces being finished are generally known to those skilled in the art. Non limiting examples of methods to measure friction in friction sensor probes are described in the following U.S. Pat. No. 5,069,002 to Sandhu et al., U.S. Pat. No. 5,196,353 to Sandhu, U.S. Pat. No. 5,308,438 to Cote et. al., 5,595,562 to Yau et al., U.S. Pat. No. 5,597,442 to Chen, U.S. Pat. No. 564,050 to Chen, and U.S. Pat. No. 5,738,562 to Doan et al. and are included by reference herein in their entirety for guidance and can be advantageously modified by those skilled in the art for use in this invention. Thermal sensors are available commercially from Terra Universal, Inc. in Anaheim, Calif. and Hart Scientific in American Fork, Utah. Measuring the changes in friction at the interface between the workpiece being finished and the finishing element finishing surface to generate an in situ signal for control is particularly preferred because it can be effectively combined with a secondary friction sensor to further improve finishing control.

A workpiece finishing sensor for the workpiece being finished is preferred. A sensor for the workpiece being finished selected from the group consisting of friction sensors, thermal sensors, optical sensors, acoustical sensors, and electrical sensors is preferred sensor for the workpiece being finished in this invention. Workpiece thermal sensors and workpiece friction sensors are non-limiting examples of preferred workpiece friction sensors. As used herein, a workpiece friction sensor can sense the friction between the interface of the workpiece being finished and the finishing element finishing surface during operative finishing motion.

Additional non-limiting preferred examples of workpiece finishing sensors will now be discussed. Preferred optical workpiece finishing sensors are discussed. Preferred non-optical workpiece finishing sensors are also discussed. The endpoint for planarization can be effected by monitoring the ratio of the rate of insulator material removed over a particular pattern feature to the rate of insulator material removal over an area devoid of an underlying pattern. The endpoint can detected by impinging a laser light onto the workpiece being polished and measuring the reflected light versus the expected reflected light as an measure of the planarization process. A system which includes a device for measuring the electrochemical potential of the slurry during processing which is electrically connected to the slurry, and a device for detecting the endpoint of the process, based on upon the electrochemical potential of the slurry, which is responsive to the electrochemical potential measuring device. Endpoint detection can be determined by an apparatus using an interferometer measuring device to direct at an unpatterned die on the exposed surface of the wafer to detect oxide thickness at that point. A semiconductor substrate and a block of optical quartz are simultaneously polished and an interferometer, in conjunction with a data processing system is then used to monitor the thickness and the polishing rate of the optical block to develop an endpoint detection method. A layer over a patterned semiconductor is polished and analyzed using optical methods to determine the end point. An energy supplying means for supplying prescribed energy to the semiconductor wafer is used to develop a detecting means for detecting a polishing end point to the polishing of film by detecting a variation of the energy supplied to the semiconductor wafer. The use of sound waves can be used during chemical mechanical polishing by measuring sound waves emanating from the chemical mechanical polishing action of the substrate against the finishing element. A control subsystem can maintain a wafer count, corresponding to how many wafers are finished and the control subsystem can regulate the backside pressure applied to each wafer in accordance with a predetermined function such that the backside pressure increases monotonically as the wafer count increases. The above methods are generally known to those skilled in the art. U.S. Pat. No. 5,081,796 to Schultz, U.S. Pat. No. 5,439,551 to Meikle et al., U.S. Pat. No. 5,461,007 to Kobayashi, U.S. Pat. No. 5,413,941 to Koos et al., U.S. Pat. No. 5,637,185 Murarka et al., U.S. Pat. No. 5,643,046 Katakabe et al., U.S. Pat. No. 5,643,060 to Sandhu et al., U.S. Pat. No. 5,653,622 to Drill et al., and U.S. Pat. No. 5,705,435 to Chen. are included by reference in their entirety and included herein for general guidance and modification by those skilled in the art.

Changes in lubrication, particularly active lubrication, at the operative finishing interface can significantly affect finishing rates and finishing performance in ways that current workpiece finishing sensors cannot handle effectively. For instance, current workpiece finishing sensors cannot effectively monitor and control multiple real time changes in lubrication, particularly active lubrication, and changes in finishing such as finishing rates. This renders some prior art workpiece finishing sensors less effective than desirable for controlling and stopping finishing when friction is adjusted or changed in real time. Secondary friction sensor subsystems as indicated above can help to improve real time control wherein the lubrication is changed during the finishing cycle time. Preferred secondary friction sensors include optical friction sensors and non-optical friction sensors. An optical friction sensor is a preferred friction sensor. Non-limiting preferred examples of optical friction sensors are an infrared thermal sensing unit such as a infrared camera and a laser adjusted to read minute changes of movement of the friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Electrical performance versus temperature such as conductivity, voltage, and resistance is measured. Those skilled in the thermal measurement arts are generally familiar with non-optical thermal sensors and their use. A change in friction can be detected by rotating the friction sensor in operative friction contact with the finishing element finishing surface with electric motors and measuring current changes on one or both motors. The current changes related to friction changes can then be used to produce a signal to operate the friction sensor subsystem. A friction sensor probe comprises a probe that can sense friction at the interface between a material which is separate and unconnected to the workpiece surface being finished and the finishing element finishing surface. Some illustrative secondary friction sensor motions are pulsed direction changes, pulsed pressure changes, and continuous motion such as circular, elliptical, and linear. An operative secondary friction sensor motion is an operative secondary friction sensor motion between the secondary friction sensor surface and the finishing element finishing surface. Further details of secondary friction sensors and their use is found in newly filed Patent Applications with private serial number 1DTL11599 filed on Nov. 5, 1999 with PTO Ser. No. 09/435,181 and having the title "In Situ Friction Detector for finishing for finishing semiconductor wafers" and Patent Application with private serial number 3DTCOFB32300 with filed on Mar. 29, 2000 with PTO Ser. No. 09/538,409 and having the tile "Improved semiconductor finishing control" and both are included in their entirety for general guidance and modification of those skilled in the art. Where the material changes with depth during the finishing of workpiece being finished, one can monitor friction changes with a secondary friction sensor having dissimilar materials even with active lubrication (or changing lubrication and therefore readily detect the end point or control the finishing in situ. As an additional example, the finishing rate can be correlated with the instantaneous lubrication at the operative finishing interface, a mathematical equation can be developed to monitor finishing rate with instantaneous lubrication information from the secondary sensor and the processor then in real time calculates finishing rates and indicates the end point to the controller.

As a preferred example, the pressure can be changed during finishing. With a friction sensor, a processor can rapidly calculate whether the effective coefficient of friction has changed. If the entire semiconductor wafer surface is covered with organic boundary layer lubrication, the effective coefficient of friction will remain very stable. If the semiconductor wafer surface has some regions free from organic boundary layer lubrication, the effective coefficient of friction will change if the percentage of the surface area covered by the organic boundary layer lubrication changes with the change in pressure. FIG. 5 discussed herein above shows a representative change in the effective coefficient of friction as the area fraction free from organic boundary lubrication changes. In this manner, a pressure change to the secondary friction sensor probe can be used for in situ process control of marginal lubrication. In this manner, a pressure change in the operative finishing interface can also be used for in situ process control of marginal lubrication. Changing the applied pressure to a friction sensor is a preferred method of in situ control for marginal lubrication and reducing the applied pressure to a friction sensor is a more preferred method of in situ control. Using a reducing pressure change is normally preferred because this minimizes the abraded particles from the semiconductor wafer surface which helps to reduce unwanted semiconductor wafer surface damage. An example of a reducing pressure change is if the normal pressure during finishing is 6 psi, then a reducing pressure change is to reduce the pressure to 5 or 4 psi.

Process Control Parameters

Preferred process control parameters include those control parameters which can be changed during processing and affect workpiece finishing. Control of the operative finishing motion is a preferred process control parameter. Examples of preferred operative finishing motions include relative velocity, pressure, and type of motion. Examples of preferred types of operative finishing motion include tangential motion, planar finishing motion, linear motion, vibrating motion, oscillating motion, and orbital motion. Finishing temperature is a preferred process control parameter. Finishing temperature can be controlled by changing the heat supplied to the platen or heat supplied to the finishing composition. Alternately, friction can also change the finishing temperature and can be controlled by changes in lubrication, applied pressure during finishing, and relative operative finishing motion velocity. Friction can be changed locally by changing the stiffness of the finishing element and or the organic boundary layer lubrication. Changes in lubricant can be effected by changing finishing composition(s) and/or feed rate(s). If the lubricant is dispersed in the finishing element, lubrication can be changed, for instance, by adjusting the finishing pressure or changing finishing elements during the finishing cycle time. A preferred group of process control parameters consists of parameters selected from the group consisting of wafer velocity relative to the finishing element finishing surface, platen velocity, polishing pattern, finishing temperature, force exerted on the operative finishing interface, finishing composition, finishing composition feed rate , and finishing pad conditioning Processor A processor is preferred to help evaluate the workpiece finishing sensor information. A processor can be a microprocessor, an ASIC, or some other processing means. The processor preferably has computational and digital capabilities. Non limiting examples of processing information include use of various mathematical equations, calculating specific parameters, memory look-up tables or databases for generating certain parameters such as historical performance or preferred parameters or constants, neural networks, fuzzy logic techniques for systematically computing or obtaining preferred parameter values. Input parameter (s) can include information on current wafers being polished such as uniformity, expected polish rates, preferred lubricants(s), preferred lubricant concentrations, entering film thickness and uniformity, workpiece pattern. Further preferred non-limiting processor capabilities including adding, subtracting, multiplying, dividing, use functions, look-up tables, noise subtraction techniques, comparing signals, and adjusting signals in real time from various inputs and combinations thereof.

Use of Information for Feedback and Controller

Controllers to control the finishing of workpieces are generally known in the art. Controllers generally use information at least partially derived from the processor to make changes to the process control parameters. A processor is preferably operatively connected to a sensor to gain current information about the process and the processor is also operatively connected to a controller which preferably controls the finishing control parameters. As used herein, a control subsystem is a combination of an operative sensor operatively connected to a processor which is operatively connected to a controller which in turn can change finishing control parameters.

An advantage of this invention is the additional degree of control it gives to the operator performing planarization and/or polishing. To better utilize this control, the use of feedback information to control the finishing control parameters is preferred and in situ control is more preferred. Controlling the finishing control parameters selected from the group consisting of finishing composition feed rates, finishing composition concentration, operative finishing motion, and operative finishing pressure is preferred to improve control of the finishing of the workpiece surface being finished and in situ control is more particularly preferred. Another preferred example of an finishing control parameter is to use a different finishing element for a different portion of the finishing cycle time such as one finishing element for the planarizing cycle time and a different finishing element for the polishing cycle time. Workpiece film thickness, measuring apparatus, and control methods are preferred methods of control. Mathematical equations including those developed based on process results can be used. Finishing uniformity parameters selected from the group consisting of Total Thickness Variation (TTV), Focal plane deviation (FPD), Within-Wafer Non-Uniformity (WIW NU), and surface quality are preferred. Average cut rate is a preferred finishing rate control parameter. Average finishing rate is a preferred finishing rate control parameter. Controlling finishing for at least a portion of the finishing cycle time with a finishing sensor subsystem to adjust in situ at least one finishing control parameter that affects finishing results is a preferred method of control finishing. Information feedback subsystems are generally known to those skilled in the art. Illustrative non limiting examples of wafer process control methods include U.S. Pat. No. 5,483,129 to Sandhu issued in 1996, U.S. Pat. No. 5,483,568 to Yano issued in 1996, U.S. Pat. No. 5,627,123 to Mogi issued in 1997, U.S. Pat. No. 5,653,622 to Drill issued in 1997, U.S. Pat. No. 5,657,123 to Mogi issued in 1997, U.S. Pat. No. 5,667,629 to Pan issued in 1997, and U.S. Pat. No. 5,695,601 to Kodera issued in 1997 are included herein for guidance and modification by those skilled in the art and are included herein by reference in their entirety.

Controlling at least one of the finishing control parameters using secondary friction sensor information combined with workpiece finishing sensor information is preferred and controlling at least two of the finishing control parameters using secondary friction sensor information combined with workpiece finishing sensor information is more preferred. Using a electronic finishing sensor subsystem to control the finishing control parameters is preferred. Feedback information selected from the group consisting of finishing rate information and product quality information such as surface quality information is preferred. Non-limiting preferred examples of process rate information include polishing rate, planarizing rate, and workpieces finished per unit of time. Non-limiting preferred examples of quality information include first pass first quality yields, focal plane deviation, total thickness variation, measures of non uniformity. Non-limiting examples particularly preferred for electronics parts include Total Thickness Variation (TTV), Focal plane deviation (FPD), Within-Wafer Non-Uniformity (WIW NU), and surface quality.

In situ process control systems relying on workpiece finishing sensors are generally known to those skilled in the CMP industry. Commercial CMP equipment advertised by Applied Materials and IPEC reference some of this equipment.

The use of lubricants in finishing, particularly boundary lubricants, in a preferred embodiment including secondary friction sensor(s), friction sensor controllers, and friction sensor subsystems are unknown in the industry.

Finishing Element Conditioning

A finishing element can be conditioned before use or between the finishing of workpieces. Conditioning a finishing element is generally known in the CMP field and generally comprises changing the finishing element finishing surface in a way to improve the finishing of the workpiece. As an example of conditioning, a finishing element having no basic ability or inadequate ability to absorb or transport an alternate finishing composition can be modified with an abrasive finishing element conditioner to have a new texture and/or surface topography to absorb and transport the alternate finishing composition. As a non-limiting preferred example, an abrasive finishing element conditioner having a mechanical mechanism to create a finishing element finishing surface which more effectively transports the alternate finishing composition is preferred. The abrasive finishing element conditioner having a mechanical mechanism to create a finishing element finishing surface which more effectively absorbs the alternate finishing composition is also preferred. An abrasive finishing element conditioner having amechanical mechanism comprising a plurality of abrasive points which through controlled abrasion can modify the texture or surface topography of a finishing element finishing surface to improve alternate finishing composition absorption and/or transport is preferred. An abrasive finishing element conditioner having a mechanical mechanism comprising a plurality of abrasive points comprising a plurality of diamonds which through controlled abrasion can modify the texture and/or surface topography of a finishing element finishing surface to improve alternate finishing composition absorption and/or transport is preferred.

Modifying a virgin finishing element finishing surface with a finishing element conditioner before use is generally preferred. Modifying a finishing element finishing surface with a finishing element conditioner a plurality of times is also preferred. Conditioning a virgin finishing element finishing surface can improve early finishing performance of the finishing element by exposing any lubricants in the finishing element and can expose new fixed abrasive particles which can also change finishing. Modifying a finishing element finishing surface with a finishing element conditioner a plurality of times during its useful life in order to improve the finishing element finishing surface performance over the finishing cycle time by exposing new, unused lubricant such as solid lubricant particles dispersed therein, is preferred. Conditioning a finishing element finishing surface a plurality of times during its useful life can keep the finishing element finishing surface performance higher over its useful lifetime by exposing fresh lubricant particles and or new abrasive particles to improve finishing performance and is also a preferred method. Conditioning a finishing surface by cleaning is preferred. Nondestruction conditioning is a preferred form of conditioning. Using feedback information, preferably information derived from friction sensor probes, to select when to modify the finishing element finishing surface with the finishing element conditioner is preferred. Using feedback information, preferably information derived from a friction sensor probe, to optimize the method of modifying the finishing element finishing surface with the finishing element conditioner is more preferred. Use of feedback information is discussed further herein in other sections. When using a fixed abrasive finishing element, a finishing element having three dimensionally dispersed fixed abrasives is preferred because during the finishing element conditioning process, material is often mechanically removed from the finishing element finishing surface and preferably this removal exposes fresh fixed abrasives in the finishing to alter finishing performance.

Nonlimiting examples of textures and topographies useful for improving transport and absorption of the alternate finishing composition and/or finishing element conditioners and general use are given in U.S. Pat. No. 5,216,843 to Breivogel, U.S. Pat. No. 5,209,760 to Wiand, U.S. Pat. No. 5,489,233 to Cook et. al., U.S. Pat. No. 5,664,987 to Renteln, U.S. Pat. No. 5,655,951 to Meikle et. al., U.S. Pat. No. 5,665,201 to Sahota, and U.S. Pat. No. 5,782,675 to Southwick and are included herein by reference in their entirety for general background and guidance and modification by those skilled in the art.

Cleaning Composition

After finishing the workpiece such as an electronic wafer, the workpiece is generally carefully cleaned before the next manufacturing process step. An aqueous lubricating composition or abrasive particles remaining on the finished workpiece can cause quality problems later on and yield losses.

An aqueous lubricating composition which can be removed from the finished workpiece surface by supplying a water composition to the finished workpiece is preferred and an aqueous lubricating composition which can be removed from the finished workpiece surface by supplying a hot water composition to the finished workpiece is also preferred. An example of a water composition for cleaning is a water solution comprising water soluble surfactants. An aqueous lubricating composition having an effective amount of surfactant which changes the surface tension of water to help clean abrasive and other adventitious material from the workpiece surface after finishing is particularly preferred.

An aqueous lubricating composition which can be removed from the finished workpiece surface by supplying deionized water to the finished workpiece to substantially remove all of the aqueous lubricating composition is preferred and an aqueous lubricating composition which can be removed from the finished workpiece surface by supplying hot deionized water to the finished workpiece to substantially remove all of the aqueous lubricating composition is also preferred. An aqueous lubricating composition which can be removed from the finished workpiece surface by supplying deionized water to the finished workpiece to completely remove the aqueous lubricating composition is more preferred and an aqueous lubricating composition which can be removed from the finished workpiece surface by supplying hot deionized water to the finished workpiece to completely remove the aqueous lubricating composition is also more preferred. Supplying a cleaning composition having a surfactant which removes aqueous lubricating composition from the workpiece surface just polished is a preferred cleaning step. An aqueous lubricating composition which lowers the surface tension of the water and thus helps remove any particles from the finished workpiece surface is preferred.

By using water to remove aqueous lubricating composition, the cleaning steps are lower cost and generally less apt to contaminate other areas of the manufacturing steps. A water cleaning based process is generally compatible with many electronic wafer cleaning process and thus is easier to implement on a commercial scale. Plasma cleaning can also be preferred for some applications and is generally known to those skilled in the semiconductor arts.

Further Comments on Method of Operation

Some particularly preferred embodiments directed at the method of finishing are now discussed. The interfice between the finishing element finishing surface and the workpiece being finished is referred to herein as the operative finishing interface.

Providing an abrasive finishing member finishing surface for finishing is preferred and providing a three dimensional abrasive finishing member finishing surface for finishing is more preferred and providing a fixed abrasive finishing surface for finishing is even more preferred and providing a three dimensional fixed abrasive finishing member finishing surface a finishing surface for finishing is even more particularly preferred. Fixed abrasive finishing generally produces less abrasive to clean from the workpiece surface during finishing. Providing the workpiece surface being finished proximate to the finishing surface is preferred and positioning the workpiece surface being finished proximate to the finishing surface is more preferred.

Supplying an operative finishing motion between the workpiece surface being finished and the finishing element finishing surface is preferred and applying an operative finishing motion between the workpiece surface being finished and the finishing element finishing surface is more preferred. The operative finishing motion creates the movement and pressure which supplies the finishing action such as chemical reactions, tribochemical reactions and/or abrasive wear. Applying an operative finishing motion in a manner to maintain a substantially parallel relationship between the discrete finishing member finishing surface and the workpiece surface being finished is preferred. Applying an operative finishing motion for forming a lubricating boundary layer is preferred. Applying an operative finishing motion that transfers finishing aid to the interface between the finishing surface and the workpiece surface being finished is preferred and applying an operative finishing motion that transfers the finishing aid, forming a marginally effective lubricating layer between the finishing surface and the workpiece surface being finished is more preferred and applying an operative finishing motion that transfers the finishing aid, forming a marginally effective lubricating boundary layer between the finishing surface and the workpiece surface being finished is even more preferred. The lubrication at the interface reduces the occurrence of high friction and related workpiece surface damage. Applying an operative finishing motion that transfers the finishing aid, forming a lubricating boundary layer between at least a portion of the finishing surface and the semiconductor wafer surface being finished is preferred and applying an operative finishing motion that transfers the finishing aid, forming a marginally effective lubricating layer between at least a portion of the finishing surface and the semiconductor wafer surface being finished so that abrasive wear occurs to the semiconductor wafer surface being finished is more preferred and applying an operative finishing motion that transfers the finishing aid, forming a marginally effective lubricating boundary layer between at least a portion of the finishing surface and the semiconductor wafer surface being finished so that tribochemical wear occur to the semiconductor wafer surface being finished is even more preferred and applying an operative finishing motion that transfers the finishing aid, differentially lubricating different regions of the heterogeneous semiconductor wafer surface being finished even more particularly preferred. With heterogeneous workpiece surfaces, the potential to differentially lubricate and finish a workpiece surface has high value where the differential lubrication is understood and controlled.

A finishing aid selected from the group consisting of a lubricating aid and chemically reactive aid is preferred. A finishing aid which reacts with the workpiece surface being finished is preferred and which reacts with a portion of the workpiece surface being finished is more preferred and which differentially reacts with heterogeneous portions of a workpiece surface being finished is even more preferred. By reacting with the workpiece surface, control of finishing rates can be improved and some surface defects minimized or eliminated. A finishing aid which reduces friction during finishing is also preferred because surface defects can be minimized.

Cleaning the workpiece surface reduces defects in the semiconductor later on in wafer processing.

Supplying a finishing aid to the workpiece surface being finished which changes the rate of a chemical reaction is preferred. Supplying a finishing aid to the workpiece surface being finished having a property selected from the group consisting of workpiece surface coefficient of friction change, workpiece finish rate change, a heterogeneous workpiece surface having differential coefficient of friction, and a heterogeneous workpiece surface having differential finishing rate change which reduces unwanted damage to the workpiece surface is particularly preferred. By supplying a finishing aid, preferably an organic lubricant, to operative finishing interface to change the coefficient of friction, the finishing aid cooperates in a new, unexpected manner with the finishing element and its discrete finishing members. The shear forces during finishing are reduced on the discrete finishing member thereby changing the shear induced motion of the discrete finishing member during finishing of the workpiece surface. This can reduce unwanted surface damage to the workpiece surface being finished.

Using the method of this invention to finish a workpiece, especially a semiconductor wafer, by controlling finishing for a period of time with an electronic control subsystem connected electrically to the finishing equipment control mechanism to adjust in situ at least one finishing control parameter that affect finishing selected from the group consisting of the finishing rate and the finishing uniformity is preferred. Finishing control parameters are selected from the group consisting of the finishing composition, finishing composition feed rate, finishing temperature, finishing pressure, operative finishing motion velocity and type, and finishing element type and condition change are preferred. The electronic control subsystem is operatively connected electrically to the lubrication control mechanism. The measurement and control subsystem can be separate units and/or integrated into one unit. A preferred method to measure finishing rate is to measure the change in the amount of material removed in angstroms per unit time in minutes (.ANG./min). Guidance on the measurement and calculation for polishing rate for semiconductor part is found in U.S. Pat. No. 5,695,601 to Kodera et. al. issued in 1997 and is included herein in its entirety for illustrative guidance.

An average finishing rate range is preferred, particularly for workpieces requiring very high precision finishing such as in processing electronic wafers. Average cut rate is used as a preferred metric to describe preferred finishing rates. Average cut rate is metric generally known to those skilled in the art. For electronic workpieces, and particularly for semiconductor wafers, a cut rate of from 100 to 25,000 Angstroms per minute on at least a portion of the workpiece is preferred and a cut rate of from 200 to 15,000 Angstroms per minute on at least a portion of the workpiece is more preferred and a cut rate of from 500 to 10,000 Angstroms per minute on at least a portion of the workpiece is even more preferred and a cut rate of from 500 to 7,000 Angstroms per minute on at least a portion of the workpiece is even more particularly preferred and a cut rate of from 1,000 to 5,000 Angstroms per minute on at least a portion of the workpiece is most preferred. A finishing rate of at least 100 Angstroms per minute for at least one of the regions on the surface of the workpiece being finished is preferred and a finishing rate of at least 200 Angstroms per minute for at least one of the materials on the surface of the workpiece being finished is preferred and a finishing rate of at least 500 Angstroms per minute for at least one of the regions on the surface of the workpiece being finished is more preferred and a finishing rate of at least 1000 Angstroms per minute for at least one of the regions on the surface of the workpiece being finished is even more preferred where significant removal of a surface region is desired. During finishing there are often regions where the operator desires that the finishing stop when reached such as when removing a conductive region (such as a metallic region) over a non conductive region (such as a silicon dioxide region). For regions where it is desirable to stop finishing (such as the silicon dioxide region example above), a finishing rate of at most 1500 Angstroms per minute for at least one of the regions on the surface of the workpiece being finished is preferred and a finishing rate of at most 500 Angstroms per minute for at least one of the materials on the surface of the workpiece being finished is preferred and a finishing rate of at most 200 Angstroms per minute for at least one of the regions on the surface of the workpiece being finished is more preferred and a finishing rate of at most 100 Angstroms per minute for at least one of the regions on the surface of the workpiece being finished is even more preferred where significant removal of a surface region is desired. The finishing rate can be controlled lubricants and with the process control parameters discussed herein.

The average cut rate can be measured for different materials on the surface of the semiconductor wafer being finished. For instance, a semiconductor wafer having a region of tungsten can have a cut rate of 6,000 Angstroms per minute and region of silica cut rate of 500 Angstroms per minute. As used herein, selectivity is the ratio of the cut rate of one region divided by another region. As an example the selectivity of the tungsten region to the silica region is calculated as 6,000 Angstroms per minute divided by 500 Angstroms per minute or selectivity of tungsten cut rate to silica cut rate of 12. An lubricating properties of the finishing element can change the selectivity. It is currently believed that this is due to differential lubrication in the localized regions. Changing the lubricating properties of the finishing element to advantageously adjust the selectivity during the processing of a group of semiconductor wafer surfaces or a single semiconductor wafer surface is preferred. Changing lubricating properties of the finishing element to advantageously adjust the cut rate during the processing of a group of semiconductor wafer surfaces or a single semiconductor wafer surface is preferred. Adjusting the lubricating properties of the finishing element by changing finishing elements proximate a heterogeneous surface to be finished is preferred. A finishing element with high initial cut rates can be used initially to improve semiconductor wafer cycle times. Changing to a finishing element having dispersed lubricants and a different selectivity ratio proximate a heterogeneous surface to be finished is preferred. Changing to a finishing element having dispersed lubricants and a high selectivity ratio proximate a heterogeneous surface to be finished is more preferred. In this manner customized adjustments to cut rates and selectivity ratios can be made proximate to critical heterogeneous surface regions. Commercial CMP equipment is generally known to those skilled in the art which can change finishing elements during the finishing cycle time of a semiconductor wafer surface. As discussed above, finishing a semiconductor wafer surface only a portion of the finishing cycle time with a particular finishing element having dispersed lubricants proximate a heterogeneous surface is particularly preferred.

Finishing a semiconductor wafer in with the discrete finishing members in contact with at least 3 high finishing rate local regions measured in angstroms per minute is preferred and in contact with at least 4 high finishing rate local regions measured in angstroms per minute is more preferred and in contact 5 high finishing rate local regions measured in angstroms per minute is even more preferred. Finishing a semiconductor wafer in with the discrete finishing members in abrasive contact with at least 3 high finishing rate local regions measured in angstroms per minute is preferred and in abrasive contact with at least 4 high finishing rate local regions measured in angstroms per minute is more preferred and in abrasive contact 5 high finishing rate local regions measured in angstroms per minute is even more preferred. This leads to high local regions having high finishing rates (in the areas of higher pressure and/or lower lubrication) and improved planarity on the semiconductor wafer surface. FIG. 9 is an artist's representation of some local high finishing rate regions and some local low finishing rate regions. Reference Numeral 800 represents a portion of a semiconductor surface having two high local regions. Reference Numeral 802 represent high local regions (unwanted raised regions) on the semiconductor surface being finished. Reference Numeral 804 represent low local regions on the semiconductor surface being finished proximate to the high local regions. Reference Numeral 810 represents the discrete finishing member finishing surface in local contact with the high local regions (Reference Numeral 802). Reference Numeral 812 represents the discrete finishing member surface displaced from but proximate to the high local regions (unwanted raised regions). As shown the discrete finishing member can reduce pressure and/or lose actual contact with the low local regions on the semiconductor proximate to the high local regions (unwanted raised regions). This leads to high local regions (unwanted raised regions) having high finishing rates and improved planarity on the semiconductor wafer surface. As shown in the FIG. 9, the area of contact with the high local region is small which in turn raises the finishing pressure applied by the stiff discrete finishing member finishing surface and this increased pressure increases the finishing rate measured in angstroms per minute at the high local region. This higher pressure on the high local region also increases frictional heat which can further increase finishing rate measured in angstroms per minute in the local high region. When using a boundary layer lubrication, lubrication on the high local region can be reduced due to the higher temperature and/or pressure which further increases friction and finishing rate measured in angstroms per minute. Higher stiffness discrete finishing member finishing surfaces (higher flexural modulus discrete finishing members) apply higher pressures to the high local regions which can further improve planarization, finishing rates, and within die non-uniformity. Finishing using finishing elements of this in invention wherein the high local regions have a finishing rate measured in angstroms per minute of at least 1.6 times faster than in the proximate low local region measured in angstroms per minute is preferred and wherein the high local regions have a finishing rate of at least 2 times faster than in the proximate low local region is preferred and wherein the high local regions have a finishing rate of at least 3 times faster than in the proximate low local region is preferred. Where there is no contact with the proximate low local region, the finishing rate in the low local region can be very small and thus the ratio between the finishing rate in the high local region to finishing rate in the low local region can be large. Finishing using finishing elements of this in invention wherein the high local regions have a finishing rate measured in angstroms per minute of from 1.6 to 500 times faster than in the proximate low local region measured in angstroms per minute is preferred and wherein the high local regions have a finishing rate of from 2 to 300 times faster than in the proximate low local region is preferred and wherein the high local regions have a finishing rate of from 3 to 200 times faster than in the proximate low local region is preferred. By having the each discrete finishing member in contact with at least 3 increased finishing rate local high regions, the semiconductor wafer surface is more effectively planarized. During finishing, preferably the unitary resilient body compresses and urges discrete finishing member against semiconductor wafer surface being finished. By adjusting the flexural modulus of the discrete finishing member finishing surface, resilience of the unitary resilient body, and the other control parameters discussed herein, finishing and planarization of semiconductor wafer surfaces can be accomplished. This invention allows unique control of finishing.

Generally a die has at least one unwanted raised region created prior to finishing which is related to the location high pattern density. Each semiconductor wafer generally has many die with the same repeating topograghy relating to the unwanted raised region which in turn is generally related to a location of high pattern density. Finishing wherein the unwanted raised regions have a temperature of at least 3 degrees centigrade higher than in the proximate low local region is preferred and finishing wherein the unwanted raised regions have a temperature of at least 7 degrees centigrade higher than in the proximate low local region is preferred and finishing wherein the unwanted raised regions have a temperature of at least 10 degrees centigrade higher than in the proximate low local region is preferred. Finishing with stiff discrete finishing members, preferably having a flexural modulus of at least 20,000 psi., can increase the difference in temperature of the unwanted raised regions as compared to the proximate low local regions. Finishing with preferred organic boundary lubricating layers can increase the difference in temperature of the unwanted raised regions as compared to the proximate low local regions. Higher localized temperature gradients can aid planarization.

Using finishing of this invention to remove raised surface perturbations and/or surface imperfections on the workpiece surface being finished is preferred. Using the method of this invention to finish a workpiece, especially a semiconductor wafer, at a planarizing rate and/or planarizing uniformity according to a controllable set of operational parameters that upon variation change the planarizing rate and/or planarizing uniformity and wherein at least two operational parameters are selected from the group consisting of the type of lubricant, quantity of lubricant, and time period lubrication is preferred. Using the method of this invention to polish a workpiece, especially a semiconductor wafer, wherein an electronic control subsystem connected electrically to an operative lubrication feed mechanism adjusts in situ the subset of operational parameters that affect the planarizing rate and/or the planarizing uniformity and wherein the operational parameters are selected from the group consisting of the type of lubricant, quantity of lubricant, and time period lubrication is preferred. The electronic control subsystem is operatively connected electrically to the operative lubrication feed mechanism.

Using the method of this invention to polish or planarize a workpiece, especially a semiconductor wafer, supplying lubrication moderated by a finishing element having at least a discrete finishing member and a unitary resilient body is preferred. Forming a lubricating boundary layer in the operative finishing interface with a finishing element having at least a discrete finishing member and a unitary resilient body is more preferred. Forming a lubricating boundary layer in the operative finishing interface with a finishing element having at least a discrete finishing member, the discrete finishing member comprising a multiphase polymeric composition, and a unitary resilient body is even more preferred. A finishing element having a unitary resilient body which is free of contact with the workpiece surface during finishing is preferred for finishing some workpieces because control of the finishing pressures in the operative finishing interface of the discrete finishing members can be more versatile. Applying a operative finishing motion forming a organic boundary lubricating layer separating at least a portion of the discrete finishing member finishing surface from the workpiece surface being finished while the unitary resilient body is separated by more than the thickness of the organic boundary lubricating thickness is even more preferred. In other words, applying a operative finishing motion wherein the unitary resilient body is free of contact with the workpiece surface is preferred for some finishing operations.

Applying a variable pressure to the backside surface of the discrete finishing member is preferred. Applying a variable pressure to the backside surface of the discrete finishing member with the unitary resilient body is more preferred. Applying a pressure which varies across the backside surface of the discrete finishing member is preferred. Applying a pressure which varies across at least a portion of the backside surface of the discrete finishing member is preferred. Particularly preferred is wherein this variable pressure is applied with the unitary resilient body and wherein the unitary resilient body is against a substantially flat and inflexible finishing element support surface and more particularly preferred is wherein this variable pressure is applied with the unitary resilient body and wherein the unitary resilient body is against a flat and inflexible finishing element support surface. Non limiting illustrative examples of substantially flat and inflexible finishing support surfaces are the platens used in many commercial chemical mechanical polishing tools. Substantially flat and inflexible platens are generally known to those skilled in the art and are commercially available from IPEC Planar and Strasbaugh. Platens having a rotary motion are preferred because of their general availability in the industry and their good stability and proven track record.

Finishing the workpiece being finished with a plurality of finishing elements where at least two of the finishing elements and wherein each finishing element has a plurality of discrete finishing members is preferred. Preferred examples of different finishing elements consist of finishing elements selected from the group having different discrete finishing members and different unitary resilient bodies. Preferred examples of discrete finishing members comprise discrete finishing members having different shapes, different sizes, different abrasives, different types of abrasives, different finishing aids, different hardness, different resilience, different composition, different porosity, and different flexural modulus. Preferred examples of unitary resilient body comprise unitary resilient bodies having different shapes, different sizes, different finishing aids, different hardness, different resilience, different composition, different porosity, and different flexural modulus. By using different finishing elements, one can finish the workpiece surface in stages. By staging the finishing, unwanted damage to the workpiece surface can generally be reduced.

EXAMPLE

A unitary finishing element is prepared. The unitary resilient body is subpad style T66541 commercially available from Fruedenberg. The subpad is a porous structure having fibers, 20 inches in diameter, and is about 0.03" thick.

A composite sheet of phenolic organic synthetic plastic reinforced with cotton fibers with a thickness of about 0.03 inches is cut into ⅞ inch diameter disks with a hole saw. The phenolic organic synthetic plastic is believed to have a flexural modulus of about 400,000 psi and a Rockwell M hardness of about 100. The disks are then sanded using an ordinary portable circular sander with 120 grit sand paper available commercially from the 3M Company to form a 45 degree chamfer on the edge. These disks are then used as the discrete finishing members (with the discrete finishing member finishing surface having a smaller diameter than the backside of the discrete finishing members). The backside of the discrete finishing members are sanded with emery cloth having a 200 grit abrasive surface to improve bonding of the discrete finishing members to the unitary resilient body. The discrete finishing members are bonded to the 20 inch diameter in a hexagonal close packed pattern under pressure with PROBOND polyurethane glue commercially available from Elmer's Products, Inc. Columbus, Ohio. A release sheet of nonstick polyolefin backed by a Neoprene foam is used to help apply pressure uniformly. Preferred clean room cleanliness protocol is not available for prototype manufacture and thus some larger than desired particle contamination is present.

The discrete finishing members are fixedly attached to the unitary resilient body. Cohesive failure occurs in the unitary resilient body when some are forcefully removed alternate unitary finishing elements.

Using generally known CMP finishing protocol such as rotating CMP equipment such as Strasbaugh or IPEC, a silica slurry such as Cabot SEMI-SPERSE® 12, 15 doped oxide wafers are finished. A flood slurry feed is used. Finishing parameters such as operative finishing interface pressure, operative finishing motion, and slurry feeds were optimized using techniques generally known to those skilled in the art and an preferred set of conditions was determined within the normal ranges of screened variables. Further testing was done using the preferred finishing conditions. No wafer slip-out problems occur. Within wafer non-uniformity was good with an average of 600 angstoms. Within die uniformity matched current best processes. Even with overpolish of 60 seconds (60 seconds past target step height), within wafer nonuniformity and within die nonuniformity is maintained. Little or no finishing element conditioning was found to be needed. Finishing longevity is expected to be prolonged by the reduced need for conditioning.

Some unwanted surface defects were found. These are currently believed due to the large particle contamination during manufacture of the unitary finishing elements having discrete finishing members. Preferred finishing method manufacturing methods and cleanliness as taught in this specification are expected to eliminate the unwanted surface defects on wafer finishing.

In summary, the prototype unitary finishing element demonstrates advantages with a new method of cooperating between its elements to improve die planarity, global planarity, and finishing performance.

SUMMARY

Illustrative nonlimiting examples useful technology have referenced by their patents numbers and all of these patents are included herein by reference in their entirety for further general guidance and modification by those skilled in the arts.

Applicant currently prefers a unitary resilient body having a Shore Hardness A of about 60 with discrete finishing members bonded thereto and where the discrete finishing members have a surface area of about 2 to 6 die. For die designs with high line pattern density regions relatively close together, a flexural modulus of 100,000 to 300,000 psi is preferred. For die designs with high line pattern density regions relatively farther apart, a flexural modulus of 500,000 to 2,000,000 psi is preferred. The optional third layer member shown in FIGS. 4*b* and 4*c* as Reference Numerals 410 and 430 respectively is selected based on evaluations to improve the particular finishing of a selected semiconductor wafer topography. When increased flexibility is in the motions represented by Reference Numeral 460 and 470 of FIGS. 4*b* and 4*c*, a third layer member having a shore hardness of less than the Shore hardness of the unitary resilient body is preferred and a third layer member having a Flexural modulus of less than the flexural modulus of the unitary resilient body is also preferred. When decreased flexibility is desired in the motions represented by Reference Numeral 460 and 470 of FIGS. 4*b* and 4*c*, a third layer member having a Shore hardness of greater than the Shore hardness of the unitary resilient body is preferred and a third layer member having a Flexural modulus of greater than the flexural modulus of the unitary resilient body is also preferred. Illustrative preferred organic polymers and polymer systems are described herein above such as under the unitary resilient body and in the discrete finishing member sections. Applying a variable pressure to the backside surface of the finishing element as illustrated in FIGS. 5*a* and 5*b* for can be particularly preferred to help achieve proper motions during finishing of the discrete finishing members in particular finishing operations. The unitary resilient body and the discrete finishing members operate in a new and useful manner to produce a new and useful result.

For finishing of semiconductor wafers having low-k dielectric layers, finishing aids, more preferably lubricating aids, are preferred. Illustrative nonlimiting examples of low-k dielectrics are low-k polymeric materials, low-k porous materials, and low-k foam materials. A high flexural modulus organic synthetic resin comprising an engineering polymer is also preferred. A high flexural modulus organic synthetic resin containing even higher modulus organic synthetic resin particles can also be preferred .

The scope of the invention should be determined by the appended claims and their legal equivalents, rather than by the preferred embodiments and details are discussed herein.

I claim:

1. A unitary finishing element having a plurality of discrete finishing members for finishing a semiconductor wafer surface comprising:

discrete finishing members wherein:

each discrete finishing member has a surface area of less than the surface area of the semiconductor wafer surface being finished;

each discrete finishing member has a discrete finishing member finishing surface and a finishing member body;

each finishing member body is comprised of a continuous region of higher flexural modulus organic synthetic resin; and a ratio of the shortest distance across in centimeters of the discrete finishing member body to the thickness in centimeters of each discrete finishing member body is at least 10/1;

a unitary resilient body comprised of an organic polymer wherein the unitary resilient body has a plurality of discrete finishing members fixedly attached to the unitary resilient body in such a manner that each discrete finishing member is separate from its nearest discrete finishing member; and the unitary resilient body of organic polymer has a lower flexural modulus than the higher flexural modulus organic synthetic resin in the finishing member body.

2. The unitary finishing element for finishing the semiconductor wafer according to claim 1 wherein the ratio of the flexural modulus of the finishing member body to the flexural modulus of the unitary resilient body is greater than 10 to 1.

3. The unitary finishing element for finishing the semiconductor wafer according to claim 1 wherein each discrete finishing member has a three dimensional discrete synthetic resin particle finishing surface.

4. The unitary finishing element for finishing the semiconductor wafer according to claim 1 wherein the discrete finishing member comprises a multiphase polymeric composition.

5. The unitary finishing element for finishing the semiconductor wafer according to claim 1 wherein each discrete finishing member comprises a multiphase polymeric composition comprising:

a continuous phase of organic synthetic resin comprised of polymer "A"; and discrete synthetic resin particles comprised of polymer "B".

6. The unitary finishing element for finishing the semiconductor wafer according to claim 1 wherein each discrete finishing member comprises a multiphasc polymeric composition comprising:

a continuous phase of organic synthetic resin comprised of polymer "A";

discrete synthetic resin particles comprised of polymer "B"; and a compatibilizing agent comprised of polymer "C".

7. The unitary finishing element for finishing the semiconductor wafer according to claim 1 wherein each discrete finishing member comprises a synthetic polymer having a modulus of elasticity of at most 4,000,000 psi.

8. A unitary finishing element having a plurality of discrete finishing members for finishing a semiconductor wafer having a plurality of dies comprising:

a plurality of discrete finishing members wherein:

each discrete finishing member has a discrete finishing member finishing surface and a finishing member body;

each finishing member body is comprised of a continuous region of material having a higher flexural modulus; and each discrete finishing member finishing surface has a surface area of less than the surface area of the semiconductor wafer being finished and more than the die surface area;

a uniary resilient body comprised of an organic polymer and wherein the unitary resilient body has the plurality of separate and distinct finishing members fixedly attached to the unitary resilient body; and wherein the unitary resilient body of organic polymer having a lower flexural modulus than the higher flexural modulus material in the finishing member body; and the discrete finishing members are separated from their nearest discrete finishing member neighbor by at least ½ times the thickness of the discrete finishing member thickness in centimeters.

9. The unitary finishing element having the plurality of discrete finishing members for finishing the semiconductor wafer having the plurality of dies of claim 8 wherein a ratio of the area of the surface of the discrete finishing member finishing surface area to area of the die is from 1/1 to 20/1.

10. The unitary finishing element having the plurality of discrete finishing members for finishing the semiconductor wafer having the plurality of dies of claim 8 wherein a ratio of the area of the surface of the discrete finishing member finishing surface area to area of the die is from 2/1 to 15/1.

11. The unitary finishing element having the plurality of discrete finishing members for finishing the semiconductor wafer having the plurality of dies of claim 8 wherein:

the semiconductor wafer has a plurality of regions of higher device integration density on the semiconductor wafer and a plurality of regions of lower device integration; and wherein each discrete finishing member has a surface area sufficient to simultaneously cover at least five regions of higher device integration during finishing of the semiconductor wafer.

12. A method of finishing a semiconductor wafer being finished with a unitary finishing element having a plurality of discrete finishing members comprising the steps of:

providing a unitary finishing element comprising:

the plurality of discrete finishing members wherein:

each discrete finishing member has a surface area of less than the surface area of the semiconductor wafer being finished;

each discrete finishing member has a discrete finishing member finishing surface and a finishing member body; and each finishing member body is comprised of a continuous region of material having a higher flexural modulus;

a unitary resilient body comprised of an organic polymer and wherein the unitary resilient body has the plurality of separate and distinct finishing members fixedly attached to the unitary resilient body; and the unitary resilient body of organic polymer has a lower flexural modulus than the higher flexural modulus material in the finishing member body;

positioning the semiconductor wafer being finished proximate to the unitary finishing element with a finishing element support;

applying an operative finishing motion with a finishing pressure between the semiconductor wafer surface being finished and the discrete finishing members in the unitary finishing element; and finishing at a higher finishing rate measured in angstroms per minute on a plurality of higher local regions as compared to a plurality of low local regions proximate to the higher local regions on the semiconductor wafer surface being finished.

13. The method of finishing the semiconductor wafer being finished with the unitary finishing element having the plurality of discrete finishing members according to claim 12 further comprising the step of supplying a finishing composition to the operative finishing interface before applying the operative finishing motion.

14. The method of finishing the semiconductor wafer being finished with the unitary finishing element having the plurality of discrete finishing members according to claim 12 wherein applying the operative finishing motion keeps the discrete finishing member finishing surfaces substantially parallel with the semiconductor wafer surface being finished.

15. The method of finishing the semiconductor wafer being finished with the unitary finishing element having the plurality of discrete finishing members according to claim 12 wherein the finishing element support comprises support on a substantially flat and inflexible finishing element support surface.

16. The method of finishing the semiconductor wafer being finished with he unitary finishing element having the plurality of discrete finishing members according to claim 12 wherein the finishing element support consists essentially of support on a substantially flat and inflexible finishing element support surface.

17. The method of finishing a semiconductor wafer being finished with the unitary finishing element having the plurality of discrete finishing members according to claim 16 wherein the finishing pressure comprises at least in part applying a variable pressure to the backside surface of a plurality of the discrete finishing members.

18. The method of finishing the semiconductor wafer being finished with the unitary finishing element having the plurality of discrete finishing members according to claim 12, having the additional step of supplying an organic boundary lubricant to the operative finishing interface and wherein applying the operative finishing motion forms an organic boundary lubricating layer on the semiconductor wafer surface.

19. The method of finishing the semiconductor wafer being finished with the unitary finishing element having the plurality of discrete finishing members according to claim 12 wherein the semiconductor wafer surface being finished has unwanted raised regions and a proximate low local region and wherein the unwanted raised regions have a temperature of at least 7 degrees centigrade higher than in the proximate low local region.

20. The method of finishing the semiconductor wafer being finished with the unitary finishing element having the plurality of discrete finishing members according to claim 12 wherein the operative finishing motion applies movement to each discrete finishing member finishing surface which is within 1 degree of parallel with the semiconductor wafer surface being finished during finishing.

21. A process for chemical mechanical finishing with a multiphase polymeric composition, the multiphase polymeric composition comprising:

a multiphase synthetic polymer composition having a continuous phase of thermoplastic synthetic polymer "A" and a synthetic polymer "B" and wherein the multiphase composition has at least two distinct glass transition temperatures; and a compatibilizing polymer "C";

and the process for chemical mechanical finishing comprises the steps of:

applying the multiphase polymeric composition to a semiconductor wafer surface; and operatively finishing a semiconductor wafer with the multiphase polymeric composition.

22. The process for chemical mechanical finishing with the multiphase polymeric composition according to claim 21 wherein polymer "B" comprises a crosslinked polymer.

23. The process for chemical mechanical finishing with the multiphase polymeric composition according to claim 21 wherein the discrete synthetic resin particles are dynamically formed during melt mixing and polymer "B" comprises a crosslinked polymer rendered substantially more heat resistant than the noncrosslinked polymer "B".

24. The process for chemical mechanical finishing with the multiphase polymeric composition according to claim 21 wherein at least one of the polymers has been post crosslinked after shaping.

25. The process for chemical mechanical finishing with the multiphase polymeric composition, the multiphase polymeric composition comprising:

a multiphase synthetic polymer composition having at least one filtered polymer which removes particles having a maximum dimension of 20 microns or more capable of scratching a semiconductor wafer surface, the filtering done before adding the at least one filtered polymer to the multiphase polymeric composition;

and the process for chemical mechanical finishing comprising the steps of:

applying the multiphase polymeric composition to a semiconductor wafer surface; and operatively finishing a semiconductor wafer with the multiphase polymeric composition.

26. The process for chemical mechanical finishing with the multiphase polymeric composition according to claim 25 wherein at least one polymer is filtered to remove particles having a maximum dimension of 1 micron or more capable of scratching a semiconductor wafer surface.

27. The process for chemical mechanical finishing with the multiphase polymeric composition according to claim 25 wherein at least one filtered polymer has a number average molecular weight of at least 5,000.

28. A method for finishing a semiconductor wafer surface being finished with a multiphase polymeric composition, the multiphase polymeric composition comprising:

a multiphase synthetic polymer composition having:

a continuous phase of thermoplastic synthetic polymer "A";

discrete particles comprising synthetic polymer "B" dispersed in the continuous phase of thermoplastic synthetic polymer "A"; and wherein the multiphase composition has at least two distinct glass transition temperatures; and a compatibilizing agent "C";

and the process for finishing comprises the steps of:

applying the multiphase polymeric composition to a semiconductor wafer surface; and operatively finishing a semiconductor wafer with the multiphase polymeric composition.

29. The method for finishing the semiconductor wafer surface being finished with the multiphase polymeric composition according to claim 28 wherein the multiphase polymeric composition is included in the discrete finishing members of a unitary finishing element.

30. The method for finishing the semiconductor wafer surface being finished with the multiphase polymeric composition according to claim 28 wherein the compatibilizing agent "C" comprises a grafted polymer.

31. The method for finishing the semiconductor wafer surface being finished with the multiphase polymeric composition according to claim 28 wherein the compatibilizing agent "C" comprises a block copolymer.

32. The method for finishing the semiconductor wafer surface being finished with the multiphase polymeric composition according to claim 28 wherein the compatibilizing agent "C" forms a polymeric mixture with higher Tensile Strength as measured by ASTM D 638 than that of the same polymeric mixture in the absence of the compatibilizing agent.

33. The method for finishing the semiconductor wafer surface being finished with the multiphase polymeric composition according to claim 28 wherein the compatibilizing agent "C" forms a polymeric mixture with higher Fatigue Endurance as measured by ASTM D 671 than that of the same polymeric mixture in the absence of the compatibilizing agent.

34. The method for finishing the semiconductor wafer surface being finished with the multiphase polymeric composition according to claim 28 wherein the discrete particles comprising synthetic polymer "B" comprise a polymer selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers.

35. The method for finishing the semiconductor wafer surface being finished with the multiphase polymeric composition according to claim 28 wherein the synthetic polymer "B" comprises a polyolefin polymer.

36. The method for finishing the semiconductor wafer surface being finished with the multiphase polymeric composition according to claim 28 wherein the synthetic polymer "B" comprises an elastomer.

37. A process for finishing a semiconductor wafer surface with a multiphase polymeric composition, the multiphase polymeric composition comprising:

a multiphase synthetic polymer composition having:

a continuous phase of synthetic polymer "A";

discrete particles comprising synthetic polymer "B" dispersed in the continuous phase of synthetic polymer "A"; and wherein the multiphase composition has at least two distinct glass transition temperatures; and a compatibilizing agent "C";

and the process for finishing comprises the steps of:

applying the multiphase polymeric composition to a semiconductor wafer surface; and operatively finishing a semiconductor wafer with the multiphase polymeric composition.

38. The method for finishing the semiconductor wafer surface being finished with the multiphase polymeric composition according to claim 37 wherein the multiphase polymeric composition is included in the discrete finishing members of a unitary finishing element.

39. The method for finishing the semiconductor wafer surface being finished with the multiphase polymeric composition according to claim 38 wherein the compatibilizing agent "C" comprises a grafted polymer.

40. The method for finishing the semiconductor wafer surface being finished with the multiphase polymeric composition according to claim 38 wherein the compatibilizing agent "C" comprises a block copolymer.

41. The method for finishing the semiconductor wafer surface being finished with the multiphase polymeric composition according to claim 38 wherein the compatibilizing agent "C" forms a polymeric mixture with higher Tensile Strength as measured by ASTM D 638 than that of the same polymeric mixture in the absence of the compatibilizing agent.

42. The method for finishing the semiconductor wafer surface being finished with the multiphase polymeric composition according to claim 38 wherein the compatibilizing agent "C" forms a polymeric mixture with higher Fatigue Endurance as measured by ASTM D 671 than that of the same polymeric mixture in the absence of the compatibilizing agent.

43. The method for finishing the semiconductor wafer surface being finished with the multiphase polymeric composition according to claim 38 wherein the discrete particles comprising synthetic polymer "B" comprise polymers selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers.

44. A process for finishing a semiconductor wafer surface with a multiphase polymeric composition, the multiphase polymeric composition comprising:

a multiphase synthetic polymer composition having:

a continuous phase of synthetic polymer "A";

discrete particles comprising synthetic polymer "B" dispersed in the continuous phase of synthetic polymer "A"; and wherein the synthetic polymer "A" is dynamically reacted with the synthetic polymer "B" forming a multiphase polymeric mixture with higher Ultimate Tensile Strength as measured by ASTM D 638 than that of the same multiphase polymeric mixture in the absence of a dynamic reaction between the two synthetic polymers; and wherein the mulfiphase composition has at least two distinct glass transition temperatures;

and the process for finishing comprises the steps of:

applying the multiphase polymeric composition to a semiconductor wafer surface; and operatively finishing a semiconductor wafer with the multiphase polymeric composition.

45. The process for finishing the semiconductor wafer surface being finished with the multiphase polymeric composition according to claim 44 wherein the multiphase polymeric composition is included in the discrete finishing members of a unitary finishing element.

46. The process for finishing the semiconductor wafer surface being finished with the multiphase polymeric composition according to claim 44 wherein the discrete particles comprising synthetic polymer "B" comprise a polymer selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers.

47. The process for finishing the semiconductor wafer surface being finished with the multiphase polymeric composition according to claim 44 wherein the synthetic polymer "A" comprises a thermoplastic synthetic resin polymer.

48. A process for finishing a semiconductor wafer surface with a multiphase polymeric composition, the multiphase polymeric composition comprising:

a multiphase synthetic polymer composition having:

a continuous phase of synthetic polymer "A";

discrete particles comprising synthetic polymer "B" dispersed in the continuous phase of thermoplastic synthetic polymer "A" and wherein synthetic polymer "B" comprises a polymer selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutaienes, polyisoprenes, EPDM elastomers,, and styrene butadiene elastomers; and wherein the synthetic polymer "A" is dynamically reacted with the synthetic polymer "B" forming a multiphase polymeric mixture with a higher Fatigue Endurance as measured by ASTM D 671 than that of the same multiphase polymeric mixture in the absence of the a dynamically reaction between the two synthetic resins is preferred; and wherein the multiphase composition has at least two distinct glass transition temperatures;

and the process for finishing comprises the steps of:

applying the multiphase polymeric composition to a semiconductor wafer surface; and operatively finishing a semiconductor wafer with the multiphase polymeric composition.

49. The process for finishing the semiconductor wafer surface being finished with the multiphase polymeric composition according to claim 48 wherein the multiphase polymeric composition is included in the discrete finishing members of a unitary finishing element.

50. The process for finishing the semiconductor wafer surface being finished with the multiphase polymeric composition according to claim 48 wherein synthetic polymer "B" comprises a polyolefn polymer.

51. The process for finishing the semiconductor wafer surface being finished with the multiphase polymeric composition according to claim 48 wherein the synthetic polymer "A" comprises a thermoplastic synthetic resin polymer.

52. The unitary finishing element of claim 1 wherein the discrete finishing member finishing surfaces have at most a 3 micron difference in planarity of the active finishing surface.

53. The unitary finishing element of claim 1 wherein the discrete finishing member finishing surfaces comprise a multiphase polymeric mixture having at least two polymers which form two different and distinct polymeric regions in the mixture.

54. The unitary finishing element of claim 1 wherein the discrete finishing members have a flexural modulus of at least 20,000 psi as measured by ASTM 790 B at 73 degrees Fahrenheit.

55. The unitary finishing element of claim 1 wherein the discrete finishing members comprise a composite having fibers.

56. The unitary finishing element of claim 1 wherein the discrete finishing members comprise a composite having nonscratching fibers.

57. The unitary finishing element of claim 1 wherein the unitary finishing element has different discrete finishing members.

58. The unitary finishing element of claim 1 wherein the unitary finishing element has discrete finishing members having different flexural modulus as measured by ASIM 790 B at 73 degrees Fahrenheit.

59. The unitary finishing element of claim 9 wherein the discrete finishing members comprise a composite having nonscratching fibers.

60. The unitary finishing element of claim 9 wherein the unitary finishing element has different discrete finishing members.

61. The unitary finishing element of claim 9 wherein the discrete finishing member finishing surfaces comprise an organic synthetic polymer.

62. The unitary finishing element of claim 11 wherein the discrete finishing member finishing surfaces comprise an organic synthetic polymer.

63. The unitary finishing element of claim 11 wherein the discrete finishing members comprise a composite having fibers.

64. The unitary finishing element of claim 11 wherein the unitary finishing element has discrete finishing members having different flexural modulus as measured by ASTM 790 B at 73 degrees Fahrenheit.

65. The method of finishing according to claim 12 wherein the discrete finishing member finishing surface has at most a 3 micron difference in planarity of the active finishing surface.

66. The method of finishing according to claim 12 wherein the high local regions have a finishing rate of at least 3 times faster than in the proximate low local regions.

67. The process according to claim 21 wherein the step of applying the multiphase polymeric composition to the semiconductor wafer surface comprises applying an abrasive surface of the multiphase polymeric composition to the semiconductor wafer surface.

68. The process according to claim 26 wherein the step of applying the multiphase polymeric composition to the semiconductor wafer surface comprises applying an abrasive surface of the multiphase polymeric composition to the semiconductor wafer surface.

69. The process according to claim 28 wherein the step of applying the multiphase polymeric composition to the semiconductor wafer surface comprises applying an abrasive surface of the multiphase polymeric composition to the semiconductor wafer surface.

70. The process according to claim 28 wherein the compatibilizing agent "C" comprises a polymer having a chemically reactive functional group.

71. The process according to claim 37 wherein the step of applying the multiphase polymeric composition to the semiconductor wafer surface comprises applying an abrasive surface of the multiphase polymeric composition to the semiconductor wafer surface.

72. The process according to claim 37 wherein the compatibilizing agent "C" comprises a polymer having a chemically reactive functional group.

73. The process according to claim 37 wherein the compatibilizing agent "C" comprises a graft polymer.

74. The process according to claim 37 wherein the compatibilizing agent "C" comprises a block copolymer.

75. The process of claim 44 wherein the step of applying the multiphase polymeric composition to the semiconductor wafer surface comprises applying an abrasive surface of the multiphase polymeric composition to the semiconductor wafer surface.

76. The process of claim 48 wherein the step of applying the multiphase polymeric composition to the semiconductor wafer surface comprises applying an abrasive surface of the multiphase polymeric composition to the semiconductor wafer surface.

* * * * *